US009600979B2

(12) United States Patent
Hornik et al.

(10) Patent No.: US 9,600,979 B2
(45) Date of Patent: Mar. 21, 2017

(54) WAGERING GAMES EMPLOYING A MEGA SYMBOL

(71) Applicant: WMS Gaming Inc., Waukegan, IL (US)

(72) Inventors: Jeremy M. Hornik, Chicago, IL (US); Joel R. Jaffe, Glenview, IL (US); Daniel P. Louie, Chicago, IL (US); Jeremie D. Moll, Chicago, IL (US); Jeffry L. Nauman, Yorkville, IL (US); Jamie W. Vann, Chicago, IL (US)

(73) Assignee: Bally Gaming, Inc., Las Vegas, NV (US)

( * ) Notice: Subject to any disclaimer, the term of this patent is extended or adjusted under 35 U.S.C. 154(b) by 668 days.

(21) Appl. No.: 13/835,026

(22) Filed: Mar. 15, 2013

(65) Prior Publication Data

US 2014/0274288 A1 Sep. 18, 2014

(51) Int. Cl.
*G07F 17/34* (2006.01)
*G07F 17/32* (2006.01)

(52) U.S. Cl.
CPC ..... *G07F 17/34* (2013.01); *G07F 17/326* (2013.01)

(58) Field of Classification Search
USPC ..... 463/19, 20, 25, 30
See application file for complete search history.

(56) References Cited

U.S. PATENT DOCUMENTS 5,833,537 A 11/1998 Barrie
6,056,642 A 5/2000 Bennett
6,089,977 A 7/2000 Bennett
6,251,013 B1 6/2001 Bennett
6,270,411 B1 8/2001 Gura
6,565,433 B1 5/2003 Baerlocher
(Continued)

FOREIGN PATENT DOCUMENTS

GB 2092797 A 8/1982
GB 2096376 A 10/1982
(Continued)

OTHER PUBLICATIONS

U.S. Appl. No. 13/783,273, filed Mar. 2, 2013, Dion Aoki et al., Wagering Game with Reel Array Having Extended Symbol Visually Overlaying Adjacent Reel.

*Primary Examiner* — Paul A D'Agostino
*Assistant Examiner* — Brandon Gray
(74) *Attorney, Agent, or Firm* — Nixon Peabody LLP

(57) ABSTRACT

A method in a gaming system comprises receiving a wager and displaying an array having a plurality of array positions. Each of the plurality of array positions is populated by at least one of a plurality of symbols, which include a mega symbol configured to occupy at least two array positions on each of at least two adjacent columns of the array. In response to at least a portion of the mega symbol displayed in the array, the method includes determining a functionality for the mega symbol based on a number of array positions on which the mega symbol is displayed, the portion of the mega symbol displayed, the size of the mega symbol displayed, a random determination, the received wager, or a turnover amount over a plurality of plays. A payout is awarded based on the symbols displayed in the array and the determined functionality of the mega symbol.

26 Claims, 65 Drawing Sheets

(56) References Cited

U.S. PATENT DOCUMENTS

| | | | | |
|---|---|---|---|---|
| 6,612,927 | B1 | 9/2003 | Slomiany | |
| 6,731,313 | B1 | 5/2004 | Kaminkow | |
| 6,837,790 | B1 | 1/2005 | Kaminkow | |
| 6,918,832 | B2 | 7/2005 | Baerlocher | |
| 6,981,635 | B1 | 1/2006 | Hughs-Baird | |
| 2002/0047238 | A1 | 4/2002 | Ainsworth et al. | 273/292 |
| 2003/0027626 | A1 | 2/2003 | Marks | |
| 2003/0186737 | A1 | 10/2003 | Bennett | |
| 2003/0236115 | A1 | 12/2003 | Chamberlain | |
| 2004/0097280 | A1 | 5/2004 | Gauselmann | |
| 2004/0229679 | A1 | 11/2004 | Anderson | |
| 2005/0049030 | A1 | 3/2005 | Tachikawa | |
| 2005/0282607 | A1 | 12/2005 | Gauselmann | |
| 2006/0058097 | A1 | 3/2006 | Berman | |
| 2006/0084497 | A1 | 4/2006 | Marks | |
| 2006/0287060 | A1 | 12/2006 | Yoshimi | |
| 2008/0045322 | A1 | 2/2008 | Berman | |
| 2008/0146319 | A1* | 6/2008 | Yoshizawa | 463/21 |
| 2009/0075722 | A1* | 3/2009 | Louie et al. | 463/20 |
| 2009/0117983 | A1 | 5/2009 | Visser | 463/20 |
| 2009/0221352 | A1 | 9/2009 | Nakano | |
| 2009/0227345 | A1 | 9/2009 | Yoshizawa | |
| 2009/0270165 | A1 | 10/2009 | Dias Pires | |
| 2011/0201406 | A1 | 8/2011 | Jaffe et al. | |
| 2011/0223985 | A1 | 9/2011 | Mizue | |
| 2012/0088567 | A1 | 4/2012 | Aoki | |
| 2013/0184050 | A1 | 7/2013 | Zoble | |
| 2013/0225268 | A1* | 8/2013 | Caputo | G07F 17/323 463/25 |
| 2014/0087830 | A1 | 3/2014 | Gobe | |

FOREIGN PATENT DOCUMENTS

| | | |
|---|---|---|
| GB | 2097160 A | 10/1982 |
| GB | 2119991 A | 11/1983 |
| GB | 2137392 A | 10/1984 |
| WO | WO 03083795 | 10/2003 |
| ZA | 200300725 | 10/2004 |

* cited by examiner

WAGERING GAMES EMPLOYING A MEGA SYMBOL

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming apparatus and methods and, more particularly, to wagering games employing a mega symbol.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

SUMMARY OF THE INVENTION

According to one aspect of the present invention, a gaming system comprises one or more input devices, one or more display devices, one or more processors, and one or more memory devices storing instructions. When the instructions are executed by the one or more processors, the gaming system receives, via at least one of the one or more input devices, an input indicative of a wager. The gaming system also displays on the at least one display device an array having a plurality of array positions. Each of the plurality of array positions is populated by at least one of a plurality of symbols. The plurality of symbols include a mega symbol configured to occupy at least two array positions on each of at least two adjacent columns of the array. In response to at least a portion of the mega symbol being displayed in the array, the gaming system determines a functionality for the mega symbol from a plurality of potential functionalities based on the number of array positions on which the at least a portion of the mega symbol is displayed. The gaming system further awards a payout based on the symbols displayed in the array and the determined functionality of the mega symbol.

According to another aspect of the present invention, a gaming system comprises one or more input devices, one or more display devices, one or more processors, one or more memory devices storing instructions. When the instructions are executed by the one or more processors, the gaming system receives, via at least one of the one or more input devices, an input indicative of a wager. The gaming system also displays on the at least one display device an array comprising a plurality of array positions. Each of the plurality of array positions is populated by at least one of a plurality of symbols. The plurality of symbols include a mega symbol configured to occupy at least two array positions on each of at least two adjacent columns of the array. The gaming system determines a size of the mega symbol from a plurality of different potential sizes. The size of the mega symbol is a maximum number of array positions on which the mega symbol is configured to be displayed on the array. The gaming system further spins and stops a plurality of symbol-bearing reels to populate the plurality of array positions with the at least one of the plurality of symbols. The gaming system also evaluates the symbols in the array positions of the array to determine whether the array includes a winning outcome. The gaming system additionally awards a payout for any evaluated winning outcomes.

According to yet another aspect of the present invention, a gaming system comprises one or more input devices, one or more display devices, one or more processors, one or more memory devices storing instructions. When the instructions are executed by the one or more processors, the gaming systems receives, via at least one of the one or more input devices, an input indicative of a wager. The gaming system also displays on the at least one display device an array comprising a plurality of array positions. Each of the plurality of array positions is populated by at least one of a plurality of symbols. The plurality of symbols include a first mega symbol and a second mega symbol. The first mega symbol and the second mega symbol are configured to occupy at least two array positions on each of at least two adjacent columns of the array. The first mega symbol and the second mega symbol each have a respective functionality. In response to at least a portion of the first mega symbol overlapping with at least a portion of the second mega symbol, the gaming system changes the functionality of at least one of the first mega symbol or the second mega symbol. The gaming system also awards a payout based on the symbols displayed in the array and the respective functionalities of the first mega symbol and the second mega symbol.

According to another aspect of the invention, a computer-implemented method in a gaming system comprises receiving a wager in response to an input via at least one input device and displaying on the at least one display device an array having a plurality of array positions. Each of the plurality of array positions is populated by at least one of a plurality of symbols. The plurality of symbols include a mega symbol configured to occupy at least two array positions on each of at least two adjacent columns of the array. In response to at least a portion of the mega symbol being displayed in the array, the method further includes determining a functionality for the mega symbol from a plurality of potential functionalities based on at least one of a number of array positions on which the at least a portion of the mega symbol is displayed, the portion of the mega symbol displayed in the array, the size of the mega symbol displayed in the array, a random determination, the received wager, or a turnover amount over a plurality of plays of a wagering game. The method also includes awarding a payout based on the symbols displayed in the array and the determined functionality of the mega symbol.

According to yet another aspect of the invention, computer readable storage media is encoded with instructions for directing a gaming system to perform the above methods.

Additional aspects of the invention will be apparent to those of ordinary skill in the art in view of the detailed description of various embodiments, which is made with reference to the drawings, a brief description of which is provided below.

Figure 1:
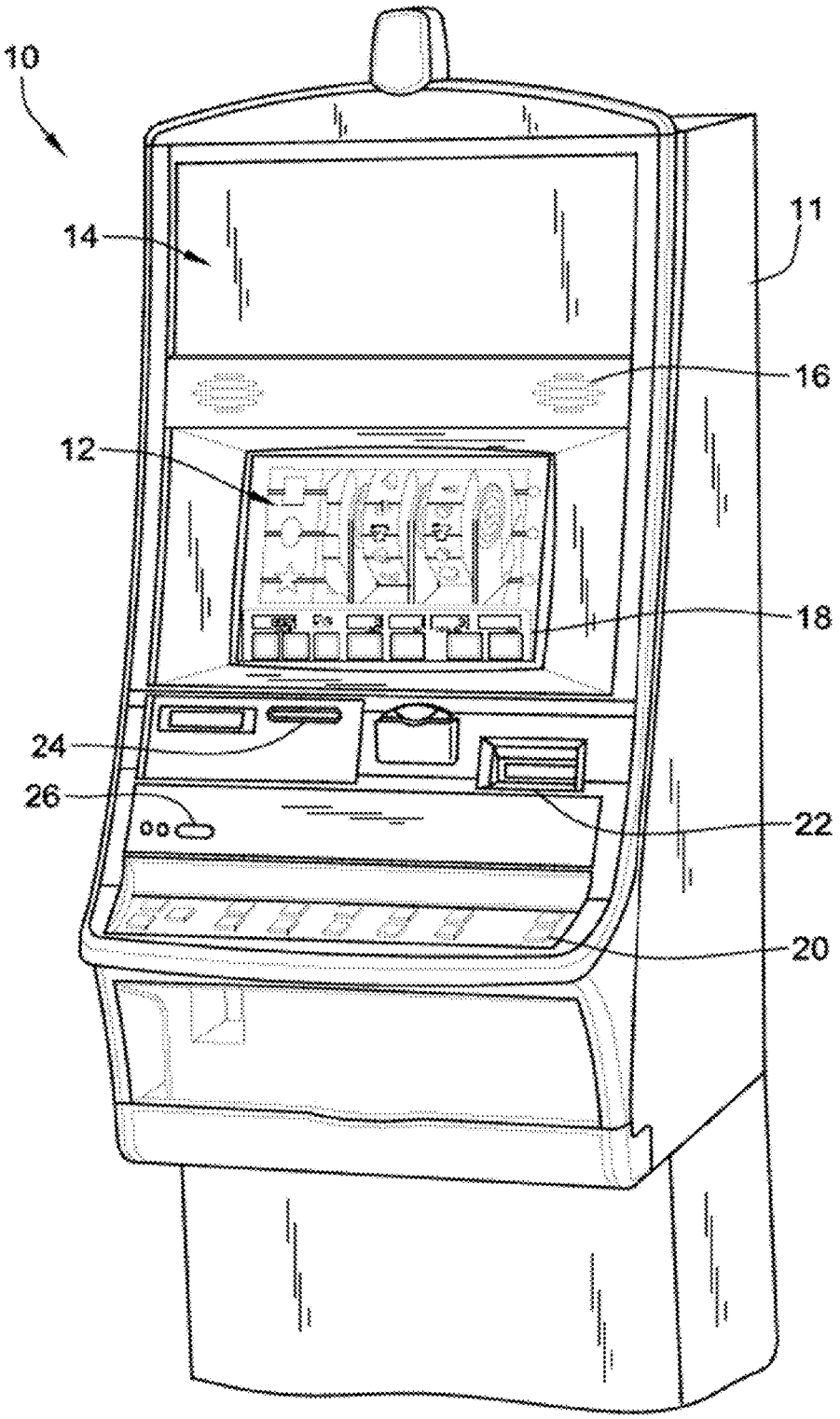
FIG. 1 (PRIOR ART)
FIG. 1 is a perspective view of a free-standing gaming terminal according to an embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. For purposes of the present detailed description, the singular includes the plural and vice versa (unless specifically disclaimed); the words "and" and "or" shall be both conjunctive and disjunctive; the word "all" means "any and all"; the word "any" means "any and all"; and the word "including" means "including without limitation."

Referring to FIG. 1, there is shown a gaming terminal 10 similar to those used in gaming establishments, such as casinos. With regard to the present invention, the gaming terminal 10 may be any type of gaming terminal and may have varying structures and methods of operation. For example, in some aspects, the gaming terminal 10 is an electromechanical gaming terminal configured to play mechanical slots, whereas in other aspects, the gaming terminal is an electronic gaming terminal configured to play a video casino game, such as slots, keno, poker, blackjack, roulette, craps, etc. The gaming terminal 10 may take any suitable form, such as floor-standing models as shown, handheld mobile units, bartop models, workstation-type console models, etc. Further, the gaming terminal 10 may be primarily dedicated for use in conducting wagering games, or may include non-dedicated devices, such as mobile phones, personal digital assistants, personal computers, etc. Exemplary types of gaming terminals are disclosed in U.S. Pat. No. 6,517,433, titled "Reel Spinning Slot Machine With Superimposed Video Image," U.S. Patent Application Publication Nos. US2010/0069160, titled "Handheld Wagering Game Machine And Docking Unit," and US2010/0234099, titled "Wagering Game System With Docking Stations" which are incorporated herein by reference in their entireties.

The gaming terminal 10 illustrated in FIG. 1 comprises a cabinet 11 that may house various input devices, output devices, and input/output devices. By way of example, the gaming terminal 10 includes a primary display area 12, a secondary display area 14, and one or more audio speakers 16. The primary display area 12 or the secondary display area 14 may be a mechanical-reel display, a video display, or a combination thereof in which a transmissive video display is disposed in front of the mechanical-reel display to portray a video image superimposed upon the mechanical-reel display. The display areas may variously display information associated with wagering games, non-wagering games, community games, progressives, advertisements, services, premium entertainment, text messaging, emails, alerts, announcements, broadcast information, subscription information, etc. appropriate to the particular mode(s) of operation of the gaming terminal 10. The gaming terminal 10 includes a touch screen(s) 18 mounted over the primary or secondary areas, buttons 20 on a button panel, bill validator 22, information reader/writer(s) 24, and player-accessible port(s) 26 (e.g., audio output jack for headphones, video headset jack, USB port, wireless transmitter/receiver, etc.). It should be understood that numerous other peripheral devices and other elements exist and are readily utilizable in any number of combinations to create various forms of a gaming terminal in accord with the present concepts.

Input devices, such as the touch screen 18, buttons 20, a mouse, a joystick, a gesture-sensing device, a voice-recognition device, and a virtual input device, accept player input(s) and transform the player input(s) to electronic data signals indicative of the player input(s), which correspond to an enabled feature for such input(s) at a time of activation (e.g., pressing a "Max Bet" button or soft key to indicate a player's desire to place a maximum wager to play the wagering game). The input(s), once transformed into electronic data signals, are output to a CPU for processing. The electronic data signals are selected from a group consisting essentially of an electrical current, an electrical voltage, an electrical charge, an optical signal, an optical element, a magnetic signal, and a magnetic element.

Figure 2:
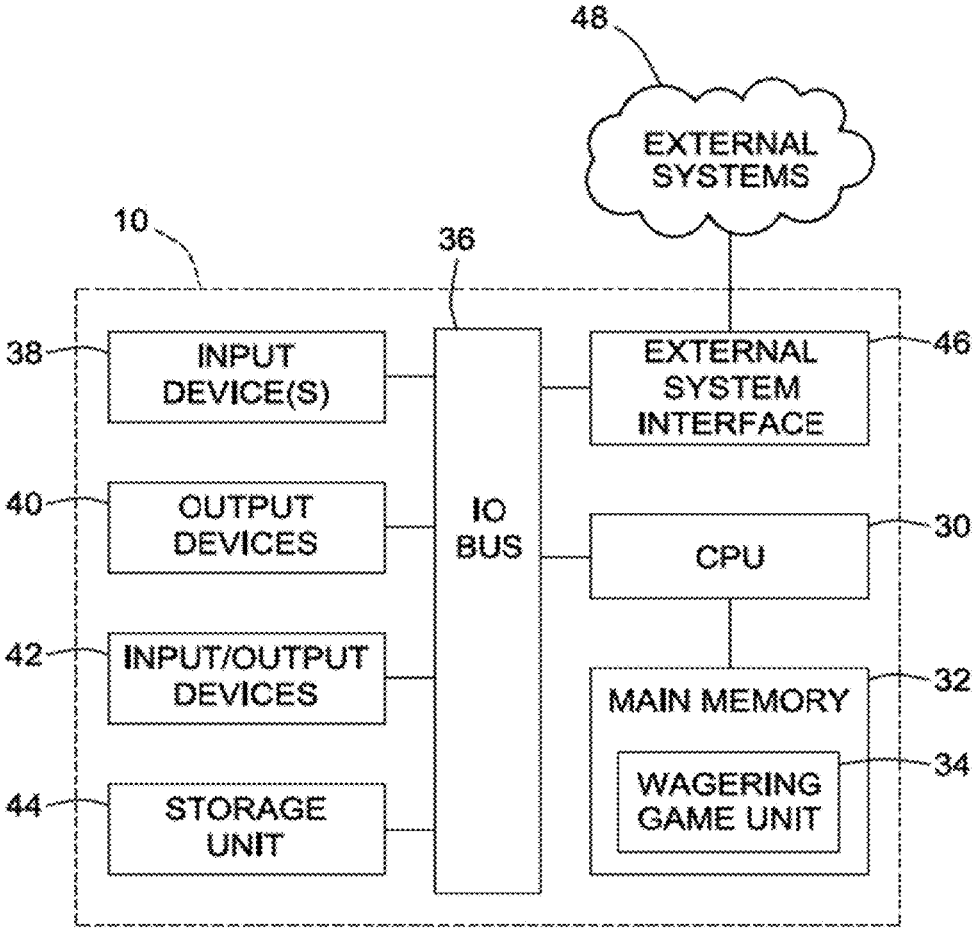
FIG. 2 (PRIOR ART)
FIG. 2 is a schematic view of a gaming system according to an embodiment of the present invention.

Turning now to FIG. 2, there is shown a block diagram of the gaming-terminal architecture. The gaming terminal 10 includes a central processing unit (CPU) 30 connected to a main memory 32. The CPU 30 may include any suitable processor(s), such as those made by Intel and AMD. By way of example, the CPU 30 includes a plurality of microprocessors including a master processor, a slave processor, and a secondary or parallel processor. CPU 30, as used herein, comprises any combination of hardware, software, or firmware disposed in or outside of the gaming terminal 10 that is configured to communicate with or control the transfer of data between the gaming terminal 10 and a bus, another computer, processor, device, service, or network. The CPU 30 comprises one or more controllers or processors and such one or more controllers or processors need not be disposed proximal to one another and may be located in different devices or in different locations. The CPU 30 is operable to execute all of the various gaming methods and other processes disclosed herein. The main memory 32 includes a wagering game unit 34. In one embodiment, the wagering game unit 34 may present wagering games, such as video poker, video black jack, video slots, video lottery, etc., in whole or part.

The CPU 30 is also connected to an input/output (I/O) bus 36, which can include any suitable bus technologies, such as an AGTL+frontside bus and a PCI backside bus. The I/O bus 36 is connected to various input devices 38, output devices 40, and input/output devices 42 such as those discussed above in connection with FIG. 1. The I/O bus 36 is also connected to storage unit 44 and external system interface 46, which is connected to external system(s) 48 (e.g., wagering game networks).

The external system 48 includes, in various aspects, a gaming network, other gaming terminals, a gaming server, a remote controller, communications hardware, or a variety of other interfaced systems or components, in any combination. In yet other aspects, the external system 48 may comprise a player's portable electronic device (e.g., cellular phone, electronic wallet, etc.) and the external system interface 46 is configured to facilitate wireless communication and data transfer between the portable electronic device and the CPU 30, such as by a near-field communication path operating via magnetic-field induction or a frequency-hopping spread spectrum RF signals (e.g., Bluetooth, etc.).

The gaming terminal 10 optionally communicates with the external system 48 such that the terminal operates as a thin, thick, or intermediate client. In general, a wagering game includes an RNG for generating a random number, game logic for determining the outcome based on the randomly generated number, and game assets (e.g., art, sound, etc.) for presenting the determined outcome to a player in an audio-visual manner. The RNG, game logic, and game assets are contained within the gaming terminal 10 ("thick client" gaming terminal), the external system 48 ("thin client" gaming terminal), or are distributed therebetween in any suitable manner ("intermediate client" gaming terminal).

The gaming terminal 10 may include additional peripheral devices or more than one of each component shown in FIG. 2. Any component of the gaming terminal architecture may include hardware, firmware, or tangible machine-readable storage media including instructions for performing the operations described herein. Machine-readable storage media includes any mechanism that stores information and provides the information in a form readable by a machine (e.g., gaming terminal, computer, etc.). For example, machine-readable storage media includes read only memory (ROM), random access memory (RAM), magnetic disk storage media, optical storage media, flash memory, etc.

Figure 3:
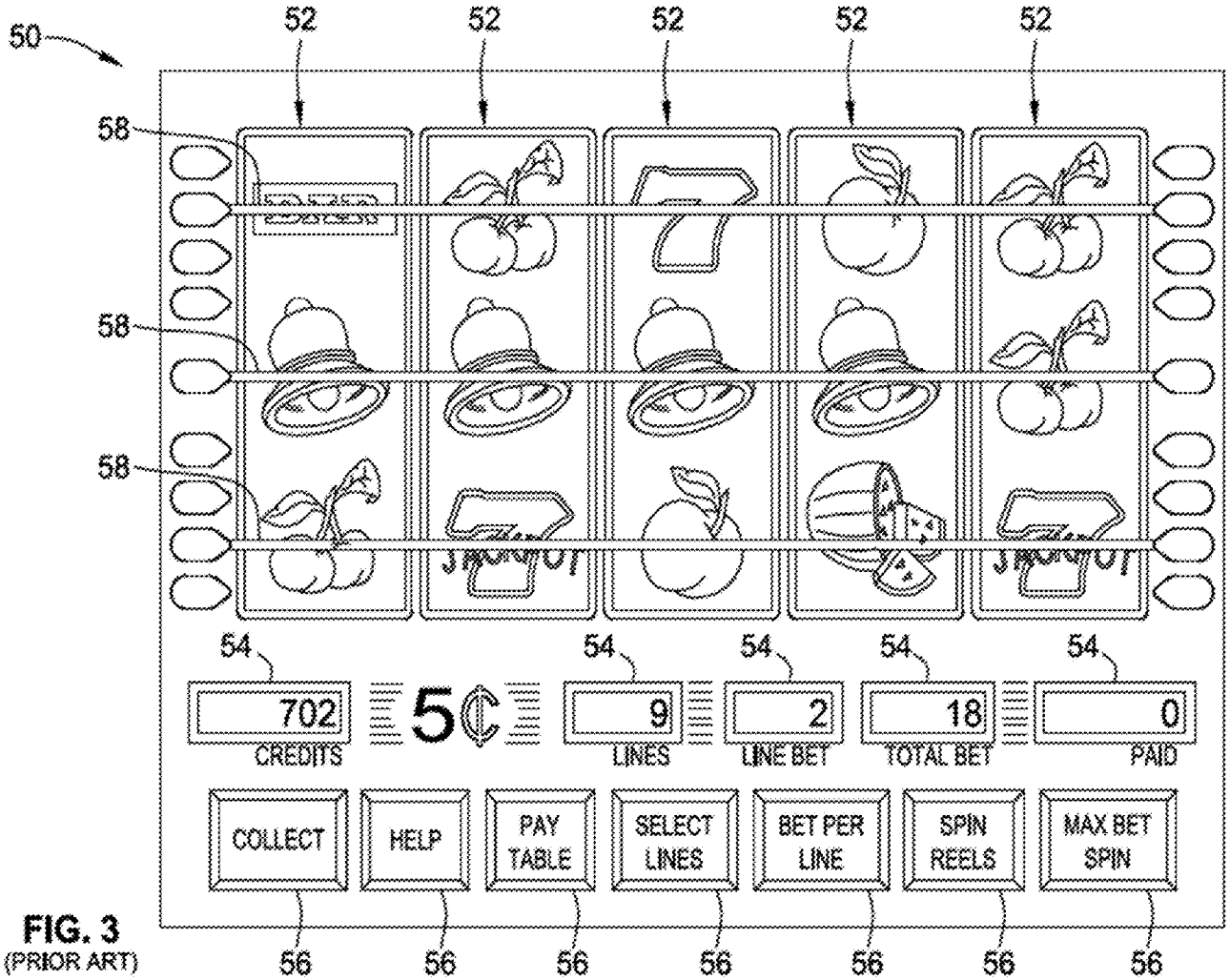
FIG. 3 (PRIOR ART)
FIG. 3 is an image of an exemplary basic-game screen of a wagering game displayed on a gaming terminal, according to an embodiment of the present invention.

Referring now to FIG. 3, there is illustrated an image of a basic-game screen 50 adapted to be displayed on the primary display area 12 or the secondary display area 14. The basic-game screen 50 portrays a plurality of simulated symbol-bearing reels 52. Alternatively or additionally, the basic-game screen 50 portrays a plurality of mechanical reels or other video or mechanical presentation consistent with the game format and theme. The basic-game screen 50 also advantageously displays one or more game-session credit meters 54 and various touch screen buttons 56 adapted to be actuated by a player. A player can operate or interact with the wagering game using these touch screen buttons or other input devices such as the buttons 20 shown in FIG. 1. The CPU operate(s) to execute a wagering game program causing the primary display area 12 or the secondary display area 14 to display the wagering game.

In response to receiving an input indicative of a wager, the reels 52 are rotated and stopped to place symbols on the reels in visual association with paylines such as paylines 58. The wagering game evaluates the displayed array of symbols on the stopped reels and provides immediate awards and bonus features in accordance with a pay table. The pay table may, for example, include "line pays" or "scatter pays." Line pays occur when a predetermined type and number of symbols appear along an activated payline, typically in a particular order such as left to right, right to left, top to bottom, bottom to top, etc. Scatter pays occur when a predetermined type and number of symbols appear anywhere in the displayed array without regard to position or paylines. Similarly, the wagering game may trigger bonus features based on one or more bonus triggering symbols appearing along an activated payline (i.e., "line trigger") or anywhere in the displayed array (i.e., "scatter trigger"). The wagering game may also provide mystery awards and features independent of the symbols appearing in the displayed array.

In accord with various methods of conducting a wagering game on a gaming system in accord with the present concepts, the wagering game includes a game sequence in which a player makes a wager and a wagering game outcome is provided or displayed in response to the wager being received or detected. The wagering game outcome is then revealed to the player in due course following initiation of the wagering game. The method comprises the acts of conducting the wagering game using a gaming apparatus, such as the gaming terminal 10 depicted in FIG. 1, following receipt of an input from the player to initiate the wagering game. The gaming terminal 10 then communicates the wagering game outcome to the player via one or more output devices (e.g., primary display 12 or secondary display 14) through the display of information such as, but not limited to, text, graphics, static images, moving images, etc., or any combination thereof. In accord with the method of conducting the wagering game, the CPU transforms a physical player input, such as a player's pressing of a "Spin Reels" touch key, into an electronic data signal indicative of an instruction relating to the wagering game (e.g., an electronic data signal bearing data on a wager amount).

In the aforementioned method, for each data signal, the CPU (e.g., CPU 30) is configured to process the electronic data signal, to interpret the data signal (e.g., data signals corresponding to a wager input), and to cause further actions associated with the interpretation of the signal in accord with computer instructions relating to such further actions executed by the controller. As one example, the CPU causes the recording of a digital representation of the wager in one or more storage media (e.g., storage unit 44), the CPU, in accord with associated computer instructions, causing the changing of a state of the storage media from a first state to a second state. This change in state is, for example, effected by changing a magnetization pattern on a magnetically coated surface of a magnetic storage media or changing a magnetic state of a ferromagnetic surface of a magneto-optical disc storage media, a change in state of transistors or capacitors in a volatile or a non-volatile semiconductor memory (e.g., DRAM), etc. The noted second state of the data storage media comprises storage in the storage media of data representing the electronic data signal from the CPU (e.g., the wager in the present example). As another example, the CPU further, in accord with the execution of the instructions relating to the wagering game, causes the primary display 12, other display device, or other output device (e.g., speakers, lights, communication device, etc.) to change from a first state to at least a second state, wherein the second state of the primary display comprises a visual representation of the physical player input (e.g., an acknowledgement to a player), information relating to the physical player input (e.g., an indication of the wager amount), a game sequence, an outcome of the game sequence, or any combination thereof, wherein the game sequence in accord with the present concepts comprises acts described herein. The aforementioned executing of computer instructions relating to the wagering game is further conducted in accord with a random outcome (e.g., determined by a RNG) that is used by the CPU to determine the outcome of the game sequence, using a game logic for determining the outcome based on the randomly generated number. In at least some aspects, the CPU is configured to determine an outcome of the game sequence at least partially in response to the random parameter.

Referring now to FIGS. 4-25C, embodiments of a wagering game employing one or more mega symbols 156 will be described. FIGS. 4A-6 illustrate images of exemplary game screens 150A-150F that portray a plurality of symbol-bearing reels 152A-152E having a plurality of symbols 154 (i.e., the "A", "K", "Q", and "J" symbols illustrated in FIGS. 4A-25C) and a mega symbol 156. The reels 152A-152E include a leftmost first reel 152A, which is adjacent to a second reel 152B. The second reel 152B is adjacent to a central third reel 152C, which is adjacent to a fourth reel 152D. The fourth reel 152D is adjacent to a rightmost reel 152E. The portions of the plurality of symbol-bearing reels 152A-152E displayed (e.g., in the primary display area 12 and/or the secondary display area 14) form a five-by-four array 151 (e.g., five reels, each four symbol positions high). Accordingly, as illustrated, the five-by-four array includes 20 unique, individual positions (i.e., five array columns, each four "array positions" high). It should be understood that the array 151 can have a size other than five-by-four such as, for example, a five-by-three array, an eight-by-twenty array, etc.

The plurality of symbols 154 are symbols respectively associated with dedicated symbol positions of respective reels 152A-152E. Upon the reels 152A-152E coming to rest after a spin of a wagering game, each of the plurality of symbols 154 displayed within the array 151 occupies a single array position within the array 151. The symbols 154 in the symbol positions of the reels 152A-152E that are not in visual association with the array 151 are not displayed.

In contrast to the symbols 154, which can occupy a single position of the array 151, the mega symbol 156 is a symbol that is associated with multiple positions of the array 151. More particularly, a mega symbol 156 is a symbol that is configured to occupy at least two symbol positions on each of at least two adjacent reels 152A-152E (e.g., at least two array positions on each of at least two adjacent columns of the array 151) when displayed in the array 151. Thus, a mega symbol 156 has a minimum size of two-by-two positions. For example, in FIG. 4A, a two-by-two mega symbol 156 is displayed in the array 151 across the first reel 152A and the second reel 152B. As another example, in FIG. 4B, a three-by-three mega symbol 156 is displayed in the array 151 across the first reel 152A, the second reel 152B, and the third reel 152C. As yet another example, in FIG. 4C, a five-by-four sized mega symbol 156 is displayed covering the entire five-by-four array 151 (i.e., covering all positions of the array 151). As will be apparent from the descriptions below, the mega symbol 156 can have other sizes (i.e., a size ranging from two-by-two positions to the size of the array 151) and/or other positions within the array 151 than those illustrated in FIGS. 4A-4C.

Although the examples illustrated and described herein generally include rectangular and/or square shaped mega symbols 156, it should be understood that the mega symbols 156 can have other shapes so long as the mega symbol 156 is configured to occupy at least two symbol positions on each at least two adjacent reels 152A-152E. The mega symbols 156 may take on other forms both symmetrical and asymmetrical as well, such as a two by four sized mega symbol, a mega symbol stretching three array columns and having a height of two in the first column, three in the second column, and two in the third column, etc.

During play of a wagering game, the reels 152A-152E can be rotated and stopped to place the symbols 154 and/or one or more mega symbols 156 in visual association with the array 151. According to some aspects of the present disclosure, the mega symbol(s) 156 can be indexed to symbol positions on two or more of the reels 152A-152E. For example, in FIG. 4A, the mega symbol 156 can be indexed to both the first reel 152A and the second reel 152B such that the first reel 152A and the second reel 152B both move the mega symbol 156 through the array 151. The reels 152A-152E on which the mega symbol 156 is indexed can be shown to spin and stop in synchronization. In some instances, the reels can appear to be combined as illustrated, for example, in FIG. 4D. Although the first reel 152A and the second reel 152B appear to be combined in FIG. 4D, the array 151 still includes 20 unique, individual array positions as described above.

The final stopping position, with respect to the array 151, of the mega symbol 156 and the symbols 154 on the reels 152A-152E to which the mega symbol 156 is indexed can be determined by a single determination. For example, in FIG. 4A and FIG. 4D, the position of the mega symbol 156 and the symbols 154 on the reels 152A, 152B can be determined by a single determination. The positions of the symbols 154 on the remaining reels 152C, 152D, 152E are each separately determined such that the stopping position of all symbols 154, 156 displayed within the array 151 can be determined by a total of four determinations (i.e., one determination for both the first reel 152A and the second reel 152B, one determination for the third reel 152C, one determination for the fourth reel 152D, and one determination for the fifth reel 152E). In the example illustrated in FIG. 4B, the mega symbol 156 can be indexed to the reels 152A, 152B, 152C such that the stopping positions of all symbols 154, 156 with respect to the array 151 can be determined by a total of three determinations (i.e., one determination for the reels 152A, 152B, 152C, one determination for the reel 152D, and one determination for the reel 152E). Similarly, in the example illustrated in FIG. 4C, the mega symbol 156 can be indexed to all of the reels 152A-152E such that the stopping positions of all symbols 154, 156 with respect to the array 151 can be determined by one determination.

Figure 5:
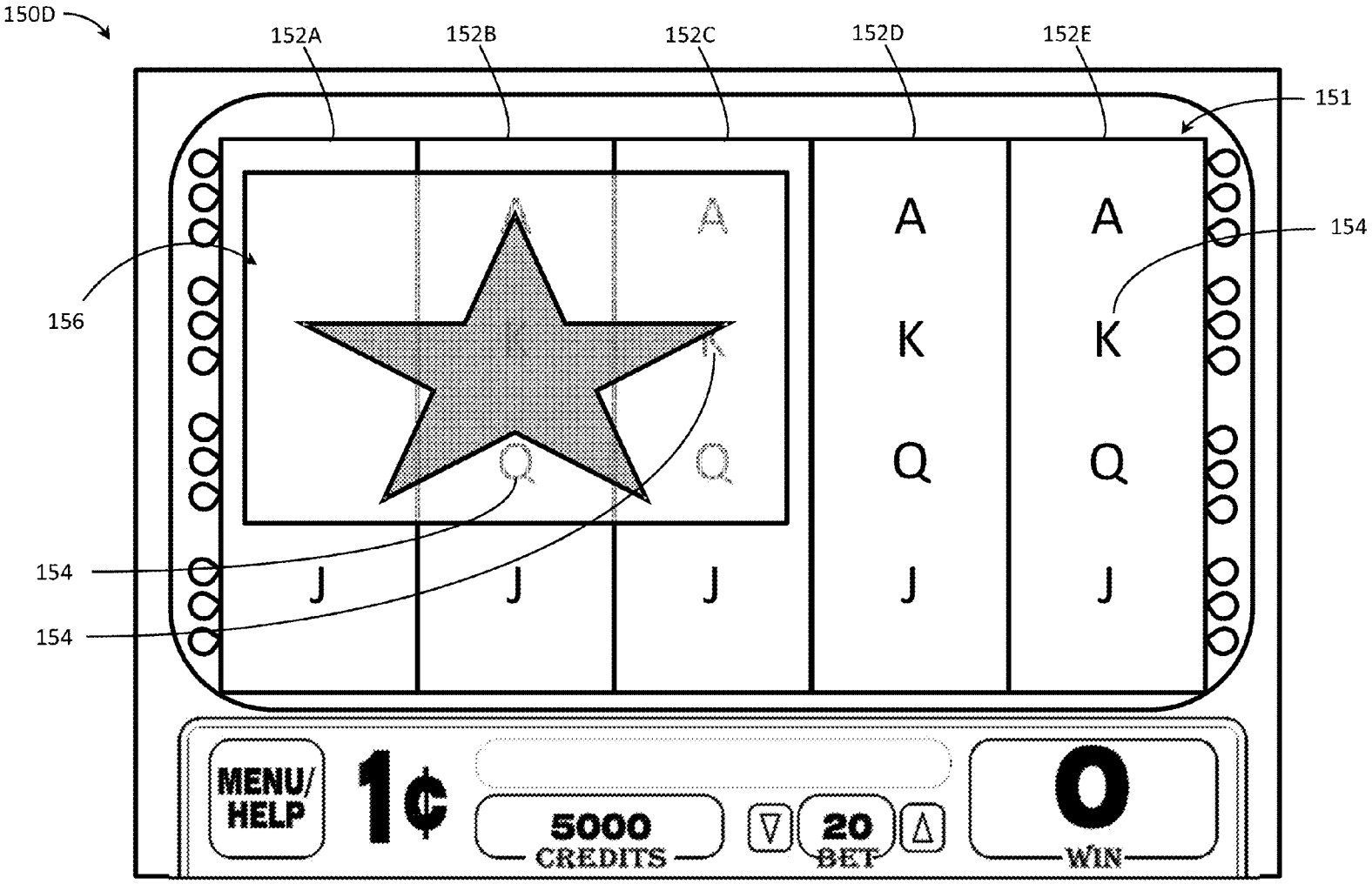
FIG. 5 is an image of an exemplary game screen of a wagering game displayed on a gaming terminal, according to an embodiment of the present invention.

According to additional and/or alternative aspects of the present disclosure, the mega symbol 156 can be indexed to only one of the reels 152A-152E such that only a single reel 152A-152E moves the mega symbol 156 through the array 151. The portion of the mega symbol 156 that is not indexed to a reel 152A-152E overlaps with (or extends over) the symbols 154 on the adjacent reel(s) 152A-152E (e.g., as shown in FIG. 5 in which the mega symbol 156 is indexed to the first reel 152A and extends over the reels 152B, 152C). That is, the mega symbol 156 can occupy symbol positions on only one reel 152A-152E but occupy array positions in multiple columns of the array 151 by overlapping with the symbols 154 of the adjacent reels 152A-152E when the mega symbol 156 is displayed within the array 151. Because the mega symbol 156 overlaps with the adjacent reels 152A-152E, some array positions are occupied by both the mega symbol 156 and the symbols 154 of the adjacent reels 152A-152E when the mega symbol 156 is stopped in visual association with the array 151.

In some instances, the mega symbol 156 can be visible within the array 151 while the symbols 154 overlapping with the mega symbol 156 are not visible as shown, for example, in FIGS. 4A-4D. In other instances, the mega symbol 156 and the symbols 154 on the adjacent reels 152A-152E that overlap with the mega symbol 156 can be visible (e.g., as shown in FIG. 5), as will be described in detail below.

When the mega symbol 156 is indexed to a single reel 152A-152E, the stopping position of the mega symbol 156 and the symbols 154 can be determined by one determination for each of the reels 152A-152E. For example, in FIG. 4B and FIG. 5, the mega symbol 156 can be indexed to the first reel 152A and extend over the second reel 152B and the third reel 152C. The final stopping positions of the mega symbol 156 and the other symbols 156 of the reels 152A, 152B, 152C with respect to the array 151 are determined by three determinations (i.e., one determination for the reel 152A to which the mega symbol 156 is indexed and one determination for each reel 152B, 152C over which the mega symbol 156 extends). The positions of the symbols 154 on the remaining reels 152D, 152E can each be separately determined such that the stopping position of all symbols 154, 156 displayed within the array 151 requires a total of five determinations (i.e., one determination for each reel 152A-152E).

Figure 4A:
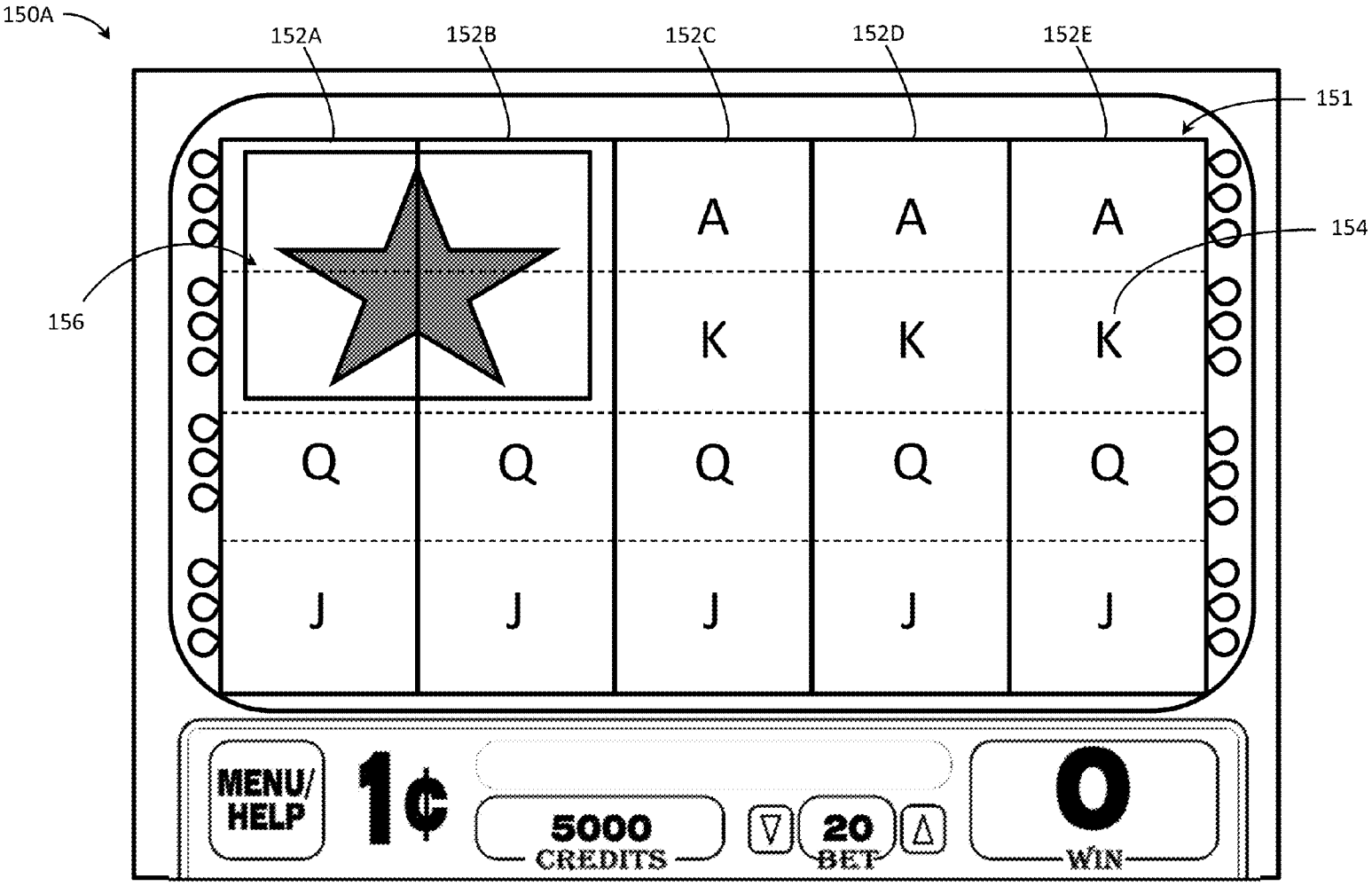
FIGS. 4A-4D are images of exemplary game screens of a wagering game displayed on a gaming terminal, according to an embodiment of the present invention.
Figure 4B:
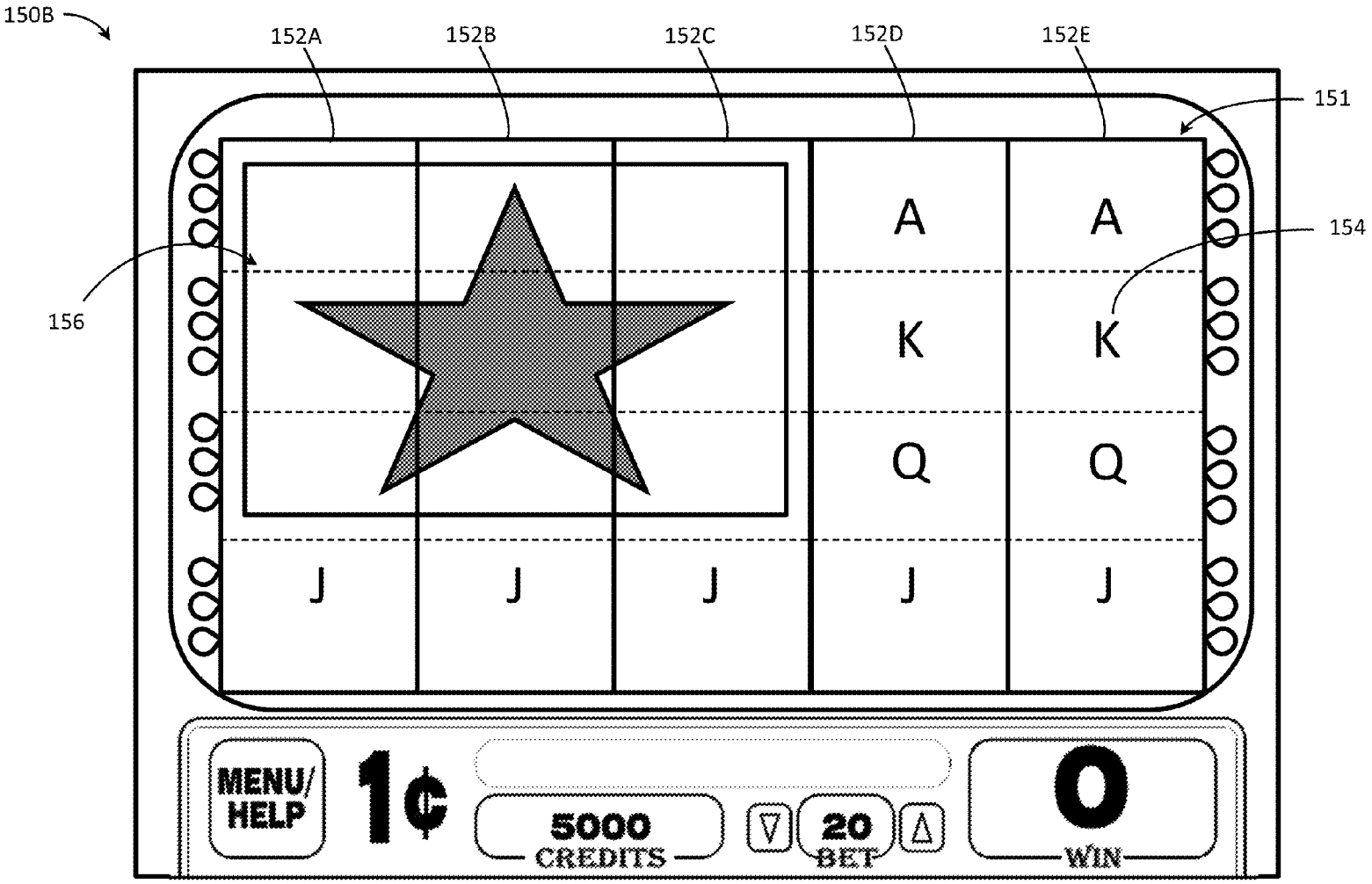
Figure 4C:
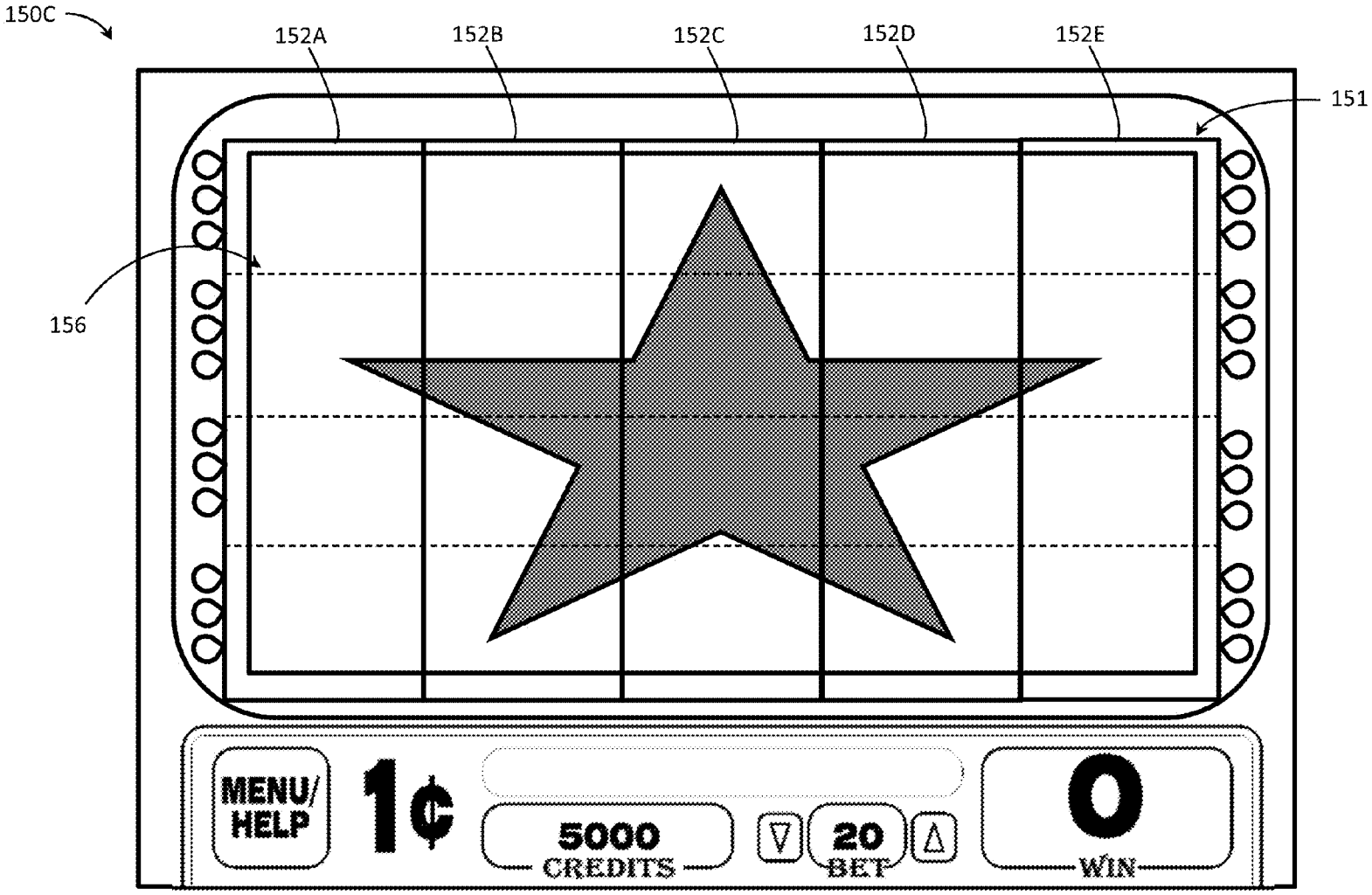
Figure 4D:
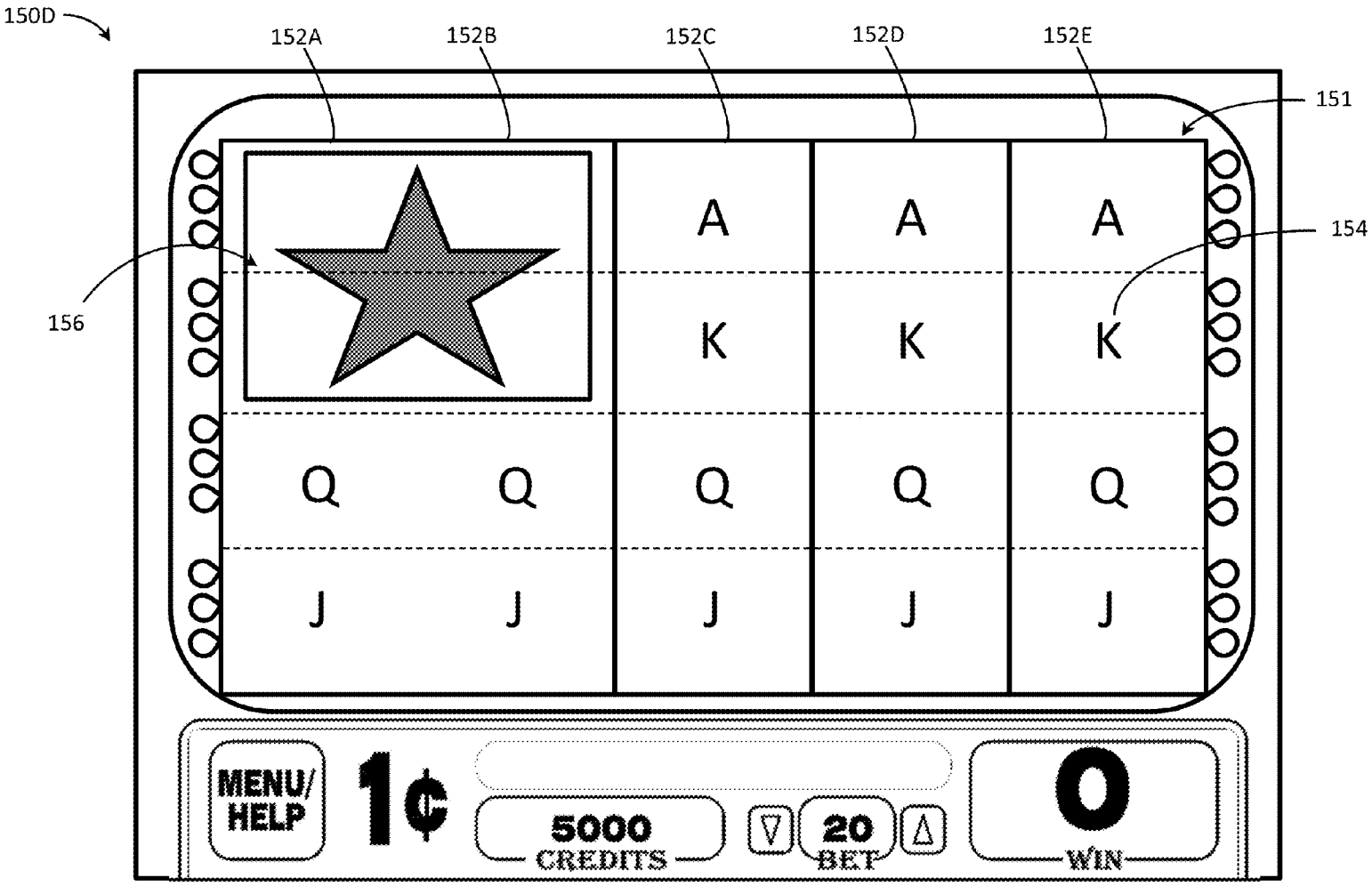

With the mega symbol 156 indexed to a single reel, the spinning and stopping of the reels can be visually portrayed such that the reel on which the mega symbol 156 is indexed and the adjacent reels overlapping with the mega symbol 156 appear to spin and stop in synchronization (e.g., in FIG. 4D, the mega symbol 156 can be indexed to the reel 152B, overlap the reel 152A, and the reels 152A, 152B appear to be combined or otherwise spin and stop in synchronization). Alternatively, the reel on which the mega symbol 156 is indexed can spin and stop separately from the adjacent reels over which the mega symbol 156 extends (e.g., in FIG. 4B, the first reel 152A and the mega symbol 156 indexed thereto can stop while the second reel 152B and the third reel 152C continue to spin).

It should be understood that the mega symbol 156 can be indexed to any one of the reels 152A-152E so as to extend over adjacent reels 152A-152E. Additional details for a symbol such as the mega symbol 156 being indexed to a single reel and extending over one or more adjacent reels is disclosed in U.S. patent application Ser. No. 13/783,273, titled "Wagering Game With Reel Array Having Extended Symbol Visually Overlaying Adjacent Reel" and filed on Mar. 2, 2013, which is herein incorporated by reference in its entirety.

According to additional and/or alternative aspects of the present disclosure, the mega symbol 156 can be indexed to none of the reels 152A-152E. Instead, as shown for example in FIG. 6, the mega symbol 156 can be indexed to a special reel 153 overlapping with (or extending over) the symbol-bearing reels 152A-152E. The special reel 153 consists of blanks 155 and the mega symbol 156. The final stopping position of the mega symbol 156 and the symbols 154 on the reels 152A-152E are each determined independently. Accordingly, the final position of the symbols 154 and the mega symbol 156 with respect to the array 151 can be determined by six determinations (i.e., one determination for each reel 152A-152E and one determination for the special reel 153).

In some instances, the mega symbol 156 indexed to the special reel 153 can be visible within the array 151 while the symbols 154 overlapping with the mega symbol 156 are not visible as shown, for example, in FIGS. 4A-4D. In other instances, both the mega symbol 156 indexed to the special reel 153 and the symbols 154 that overlap with the mega symbol 156 can be visible, as will be described in detail below.

Figure 6:
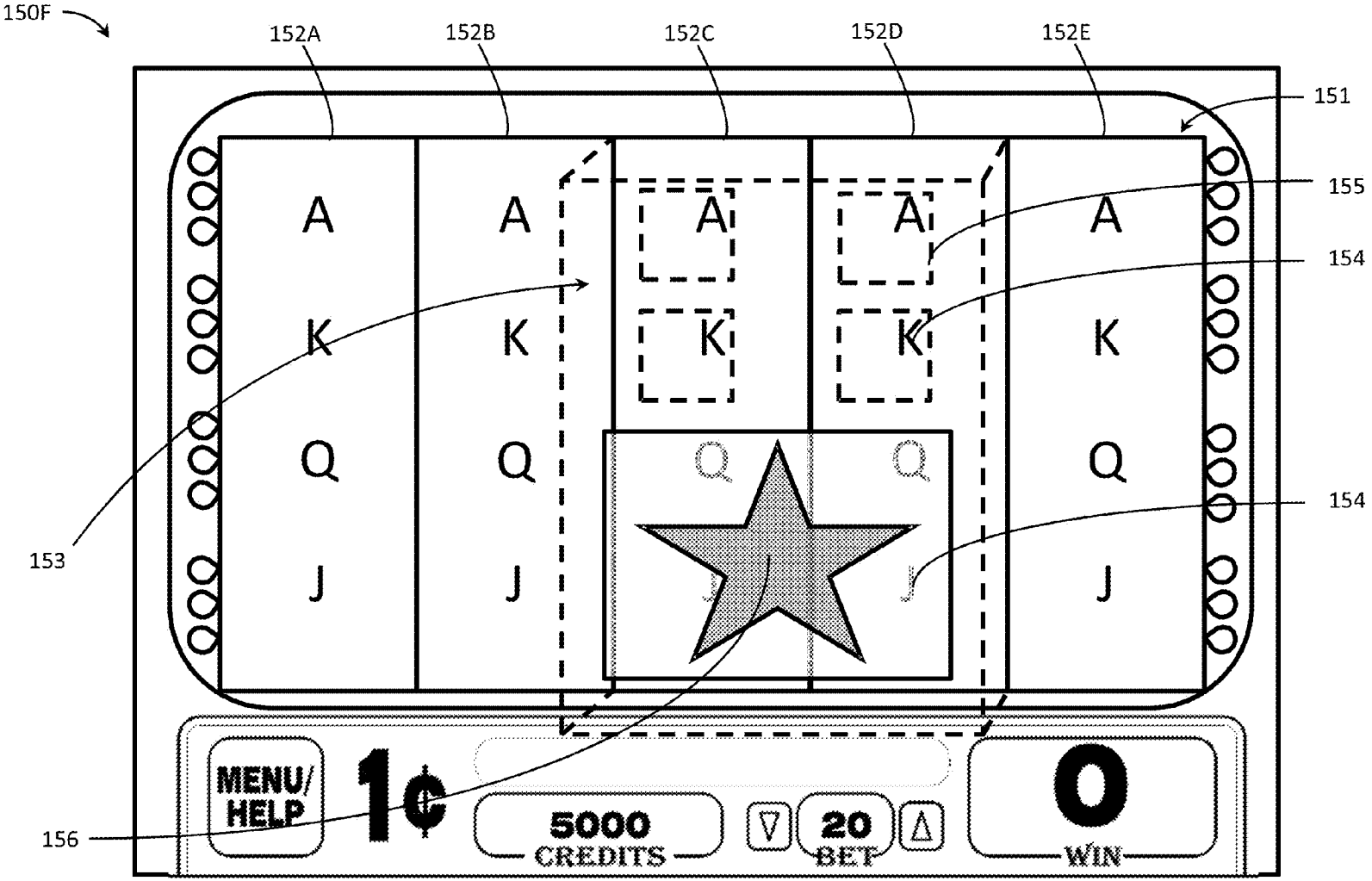
FIG. 6 is an image of an exemplary game screen of a wagering game displayed on a gaming terminal, according to an embodiment of the present invention.

With the mega symbol 156 indexed to a special reel 153, the spinning and stopping of the reels 152A-152E can be visually portrayed such that the special reel 153 and the reels 152A-152E that overlap with the special reel 153 appear to spin and stop in synchronization (e.g., in FIG. 6, the reels 152C, 152D and the special reel 153 can appear to be combined or to otherwise spin and stop in synchronization). Alternatively, the special reel 153 can spin and stop separately from the reels 152A-152E (e.g., in FIG. 6, the reels 152C and 152D can individually and separately stop while the special reel 153 continues to spin or vice versa).

It is contemplated that, according to some aspects, the reel(s) 152A-152E and/or the special reel(s) 153 to which the mega symbol 156 is indexed does not change from one spin to the next and/or one series of spins to the next. According to alternative aspects, the reel(s) 152A-152E and/or the special reel(s) 153 to which the mega symbol 156 is indexed can change from one spin to the next and/or from one series of spins to the next (i.e., the mega symbol 156 can change positions within the array 151 from one spin to the next and/or from one series of spins to the next).

As described above, according to some aspects of the present disclosure, the mega symbol(s) 156 can overlap with (or occupy the same array positions as) the symbols 154 on the reels 152A-152E. In the exemplary game screens 150A-150D illustrated in FIGS. 4A-4D, the mega symbol 156 is visually displayed within the array 151 such that the symbols 154 on the reels 152A-152E that overlap with the mega symbol 156 are not visible (and, thus, may not form part of an outcome to a wagering game). According to additional and/or alternative aspects of the present disclosure, both the mega symbol 156 and the symbols 154 on the reels 152A-152E that overlap with the mega symbol 156 can be visible within the array 151 (and, thus, may also form part of an outcome to a wagering game).

Figure 7A:
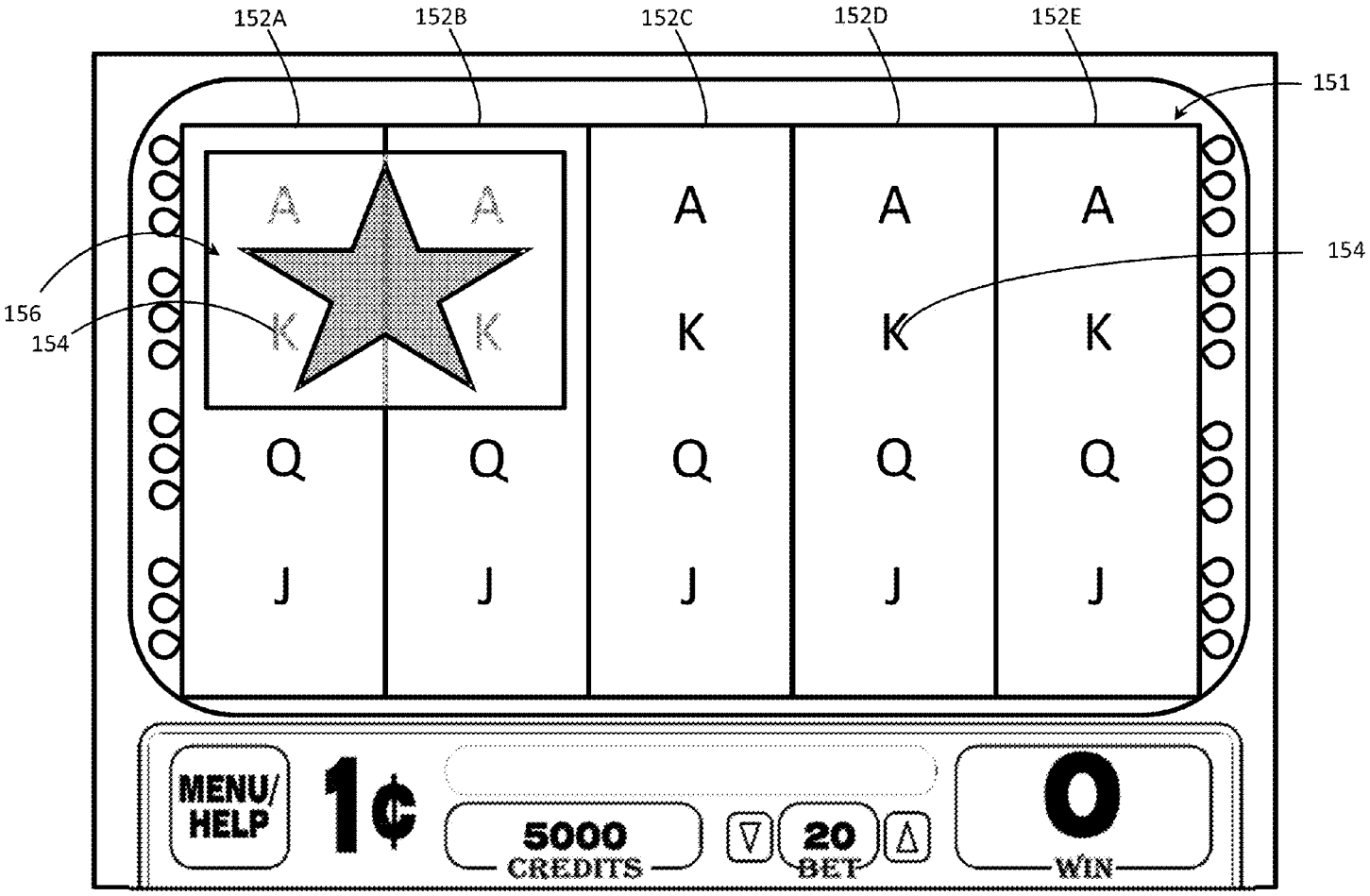
FIGS. 7A-7F are images of exemplary game screens of a wagering game displayed on a gaming terminal, according to an embodiment of the present invention.
Figure 7B:
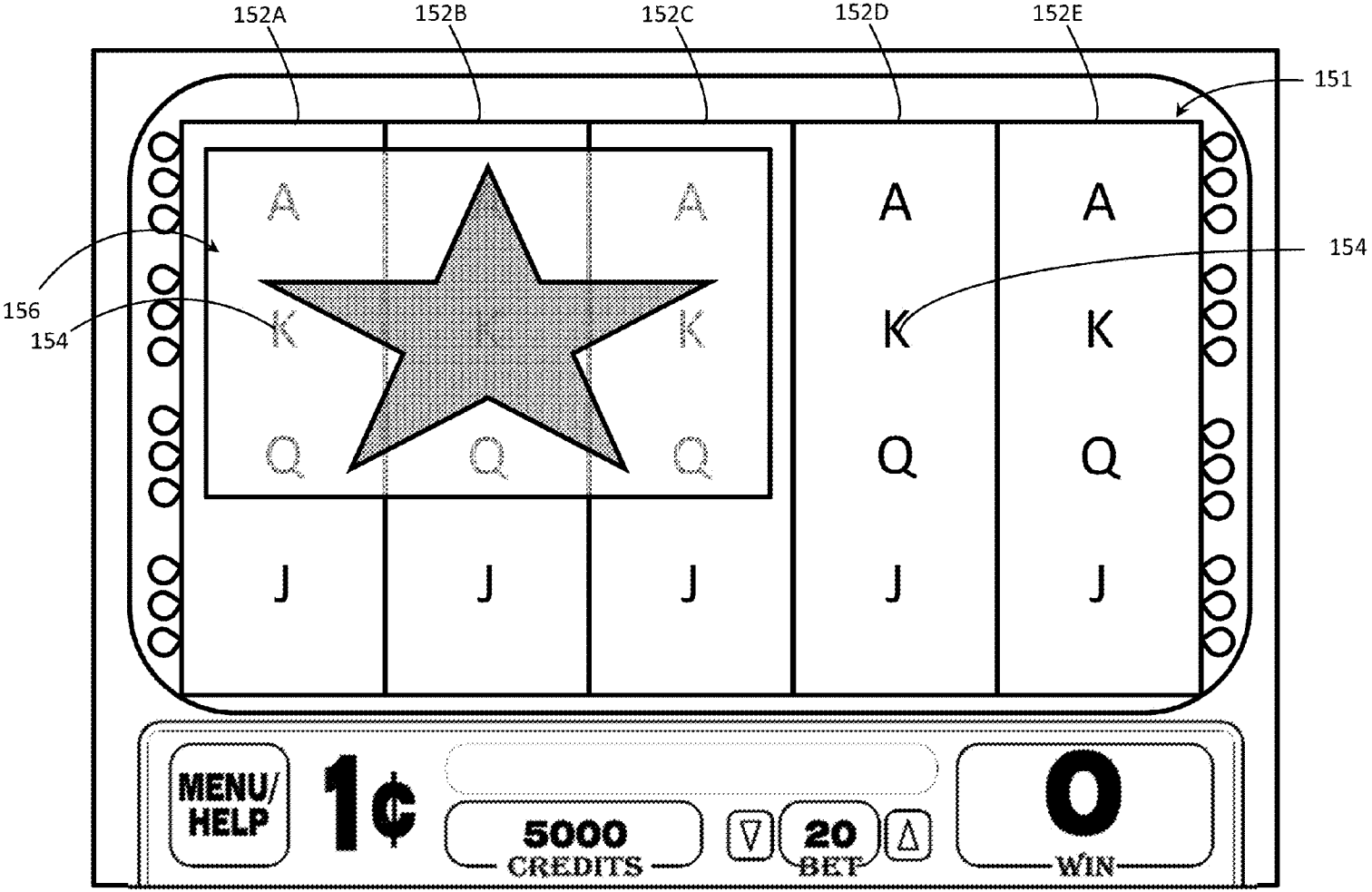

For example, the mega symbol 156 can be displayed with transparency to allow the symbols 154 on the reels 152A-152E that overlap with the mega symbol 156 in the array 151 to also be visible. As shown in FIGS. 7A and 7B, the mega symbol 156 is displayed with transparency such that the symbols 154 on the reels 152A-152E that co-occupy an array position with the mega symbol 156 are also visible in the array 151. It is contemplated that, according to other aspects of the present disclosure, one or more of the symbols 154 can additionally and/or alternatively be displayed with transparency. For example, a mega symbol 156 can be indexed to a special reel 153 disposed on a layer below the reels 152A-152E and the mega symbol 156 is visible within the array 151 due to the symbols 154 being displayed with transparency.

Figure 7C:
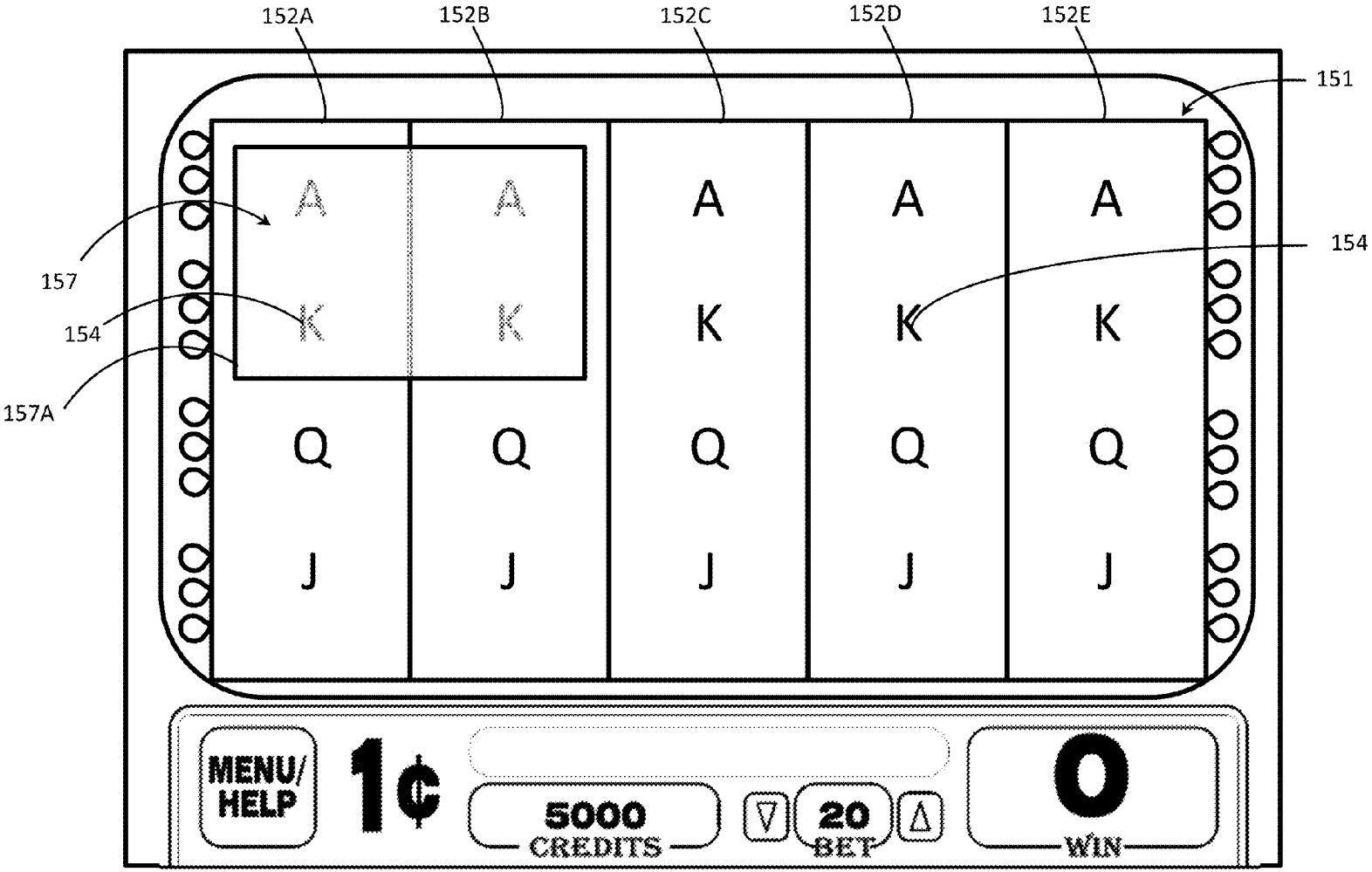
Figure 7D:
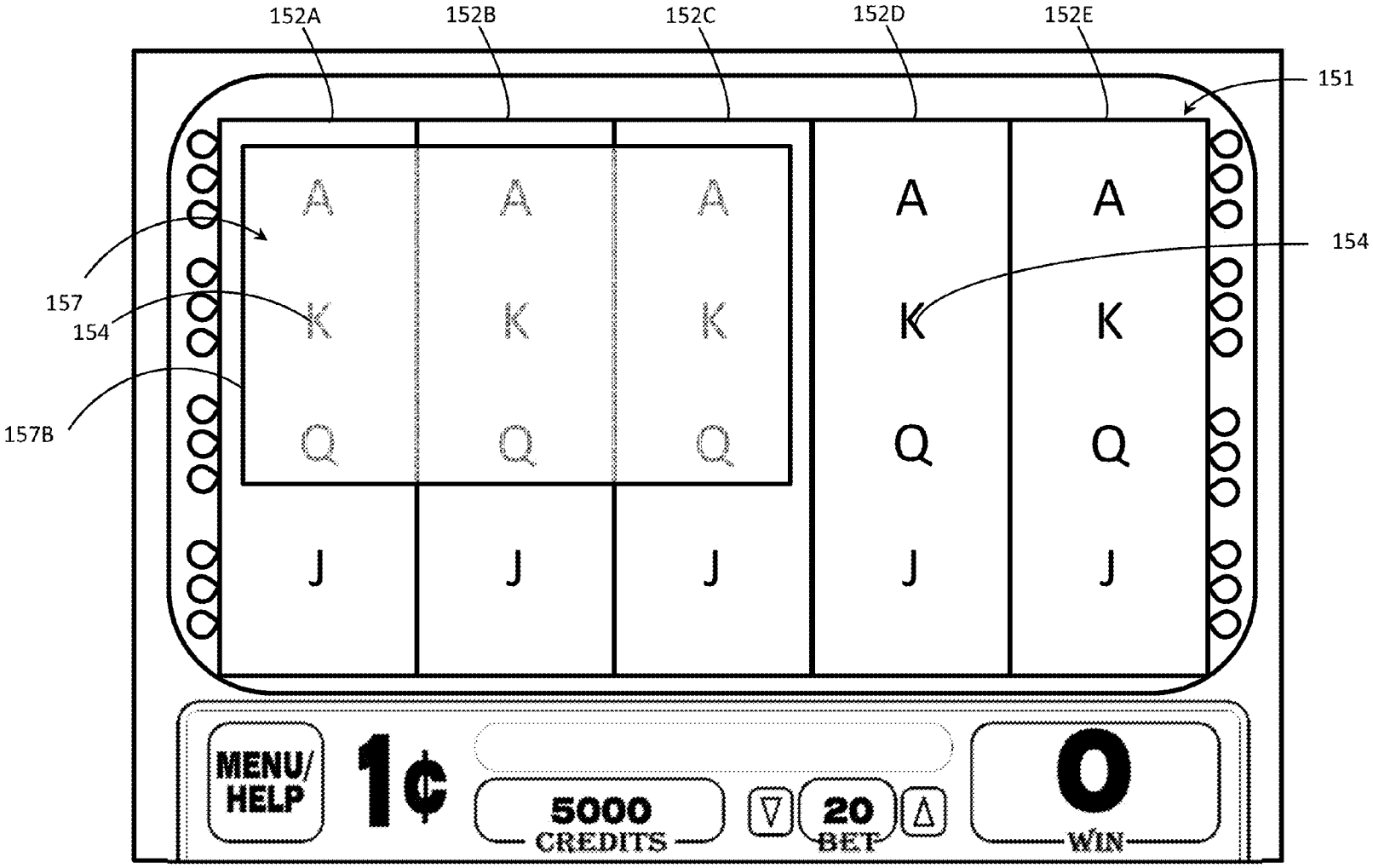

As another example, the mega symbol can be displayed as a frame (i.e., a "frame mega symbol" 157) around the symbols 154 that overlap with the frame mega symbol 157 (or co-occupy an array position with a frame mega symbol 157). As shown in FIG. 7C, the frame mega symbol 157 has a size of two-by two on the reels 152A-152B as indicated by the frame 157A. In FIG. 7D, the frame mega symbol 157 extends across the reels 152A, 152B, 152C for three symbol positions on each reel 152A, 152B, 152C as indicated by the frame 157B.

Figure 7E:
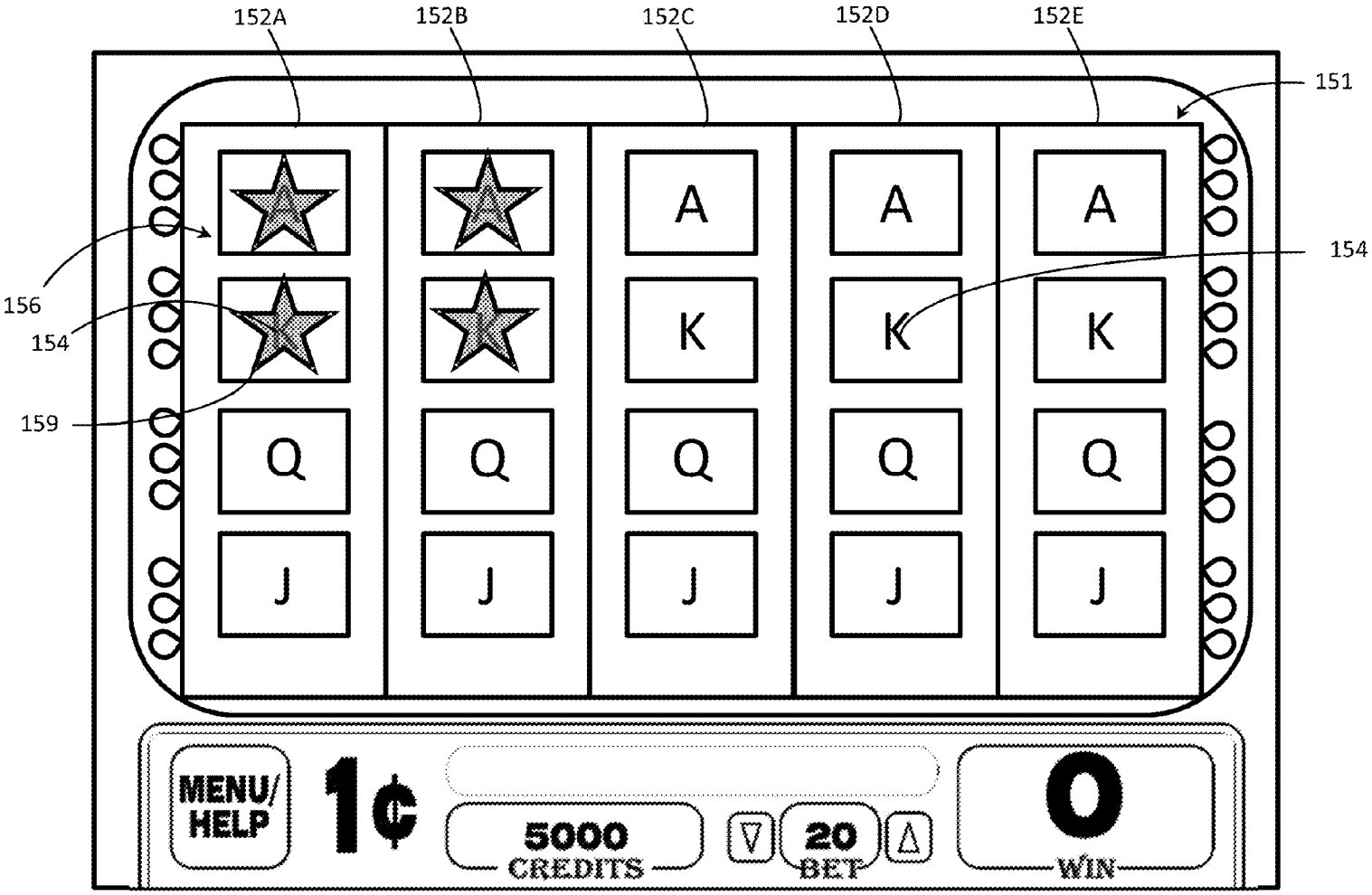
Figure 7F:
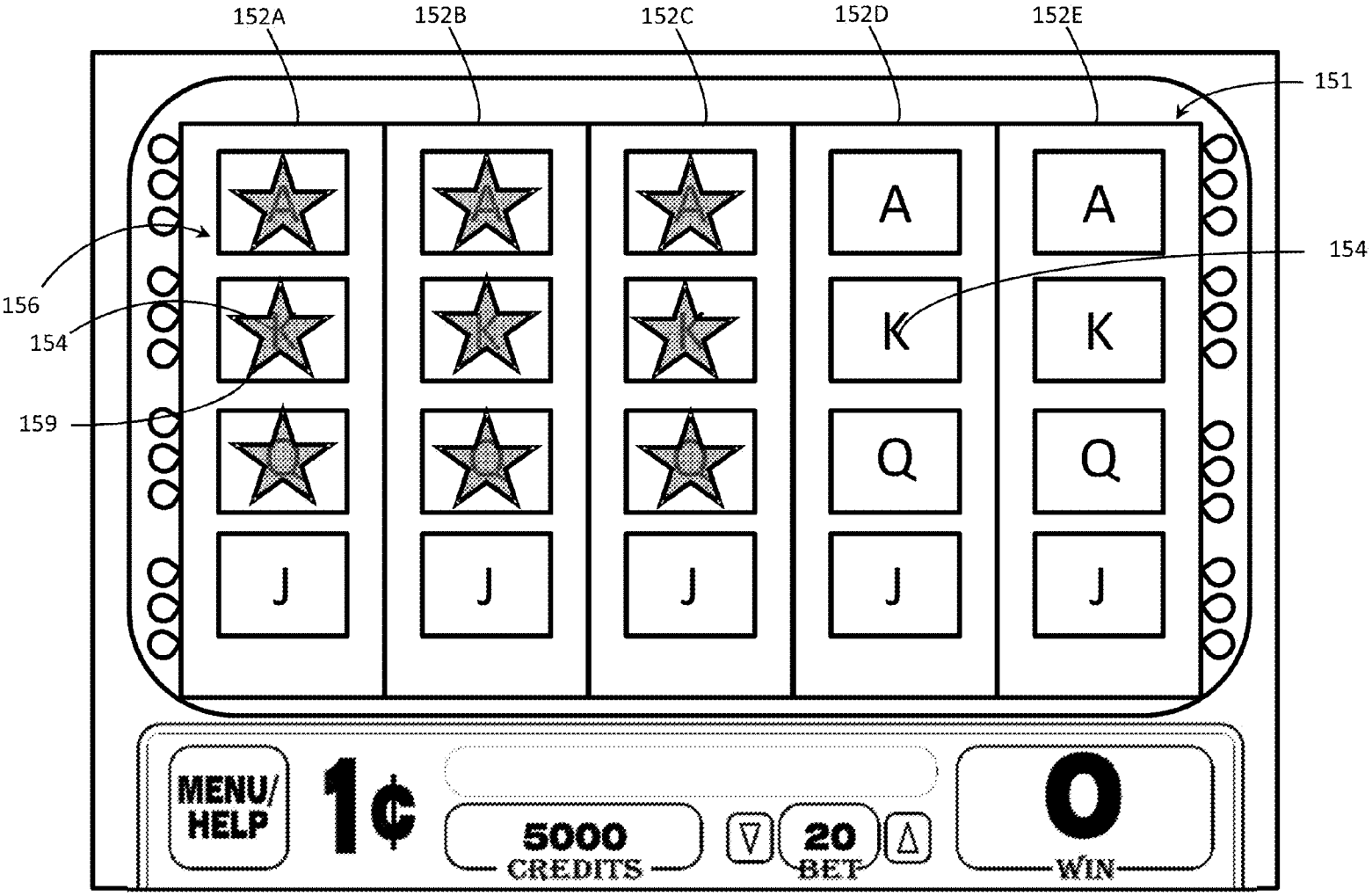

As yet another example, the mega symbol 156 can be displayed as a watermark 159 on the symbols 154 of the reels 152A-152E that overlap with the mega symbol 156. As shown in FIG. 7E and FIG. 7F, the mega symbols 156 illustrated in FIG. 7A and FIG. 7B, respectively are shown via a watermark 159 on the symbols 154 of the reels 152A-152E that overlap with the mega symbols 156.

When an outcome of a wagering game includes a mega symbol 156 (or, in according to some aspects, at least a portion of a mega symbol 156), the mega symbol 156 can be evaluated as one or more symbols in accordance with a pay table and/or in accordance with one or more functionalities associated with the mega symbol 156.

Figure 8A:
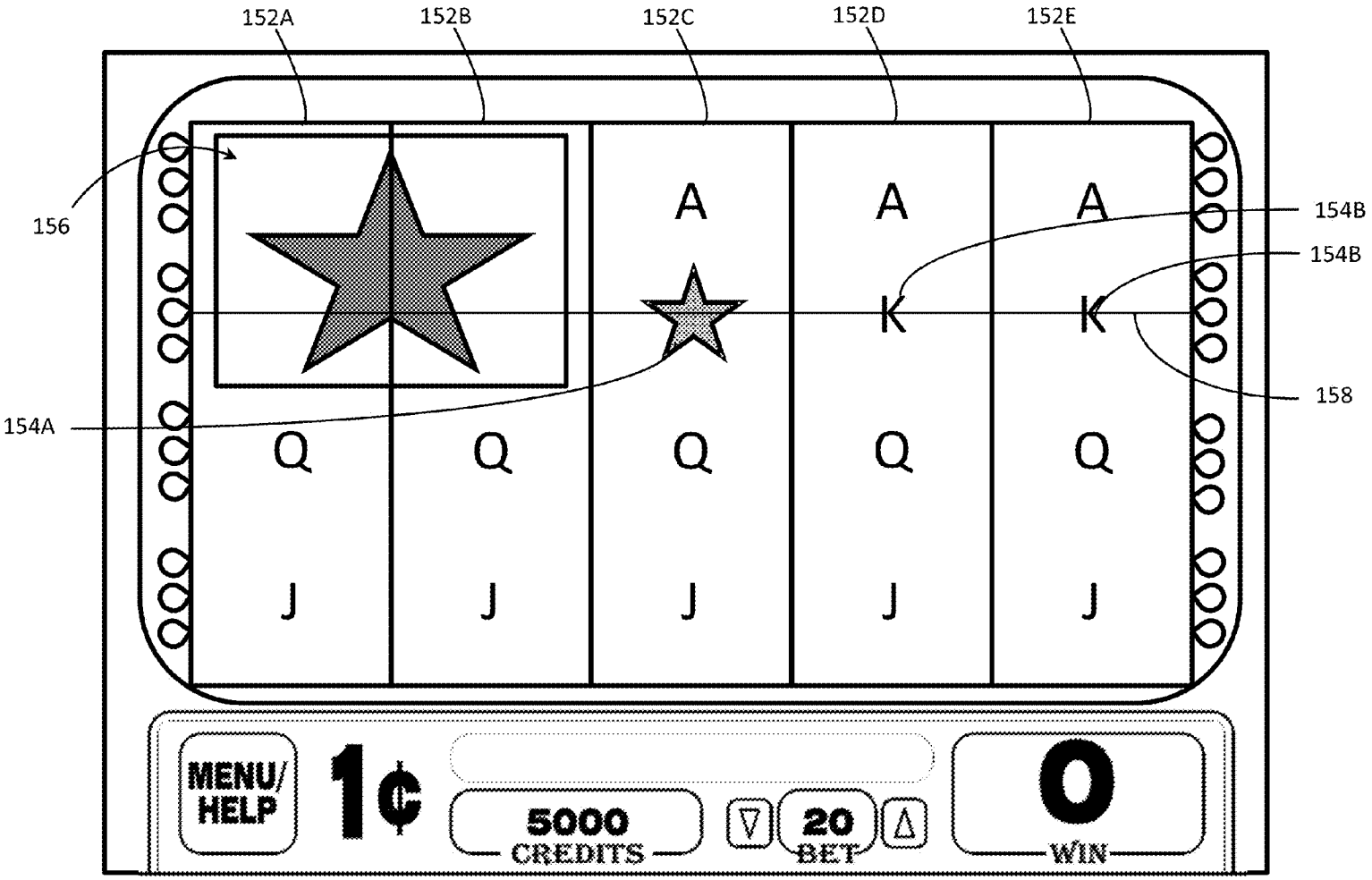
FIGS. 8A-8C are images of exemplary game screens of a wagering game displayed on a gaming terminal, according to an embodiment of the present invention.

According to some aspects of the present disclosure, the mega symbol 156 can be evaluated in accordance with a pay table as a single symbol. That is, the pay table can provide line pays or scatter pays that include one or more mega symbols 156 (or, in some aspects, portions thereof). As such, a payout can be awarded based on the mega symbol(s) 156 and/or the mega symbol(s) 156 in combination with one or more of the symbols 154. For example, FIG. 8A illustrates an outcome of a wagering game including a combination of a mega symbol 156, a "star" symbol 154A (i.e., a non-mega symbol 154 occupying a single reel position on the reel 152C), and two "K" symbols 154B on an active payline 158. In one exemplary implementation, the pay table can award a scatter pay based on the mega symbol 156 alone. In another exemplary implementation, the pay table can include a line pay for the four symbol combination of the mega symbol 156, the "star" symbol 154A, and two "K" symbols 154B on the active payline 158.

Figure 8B:
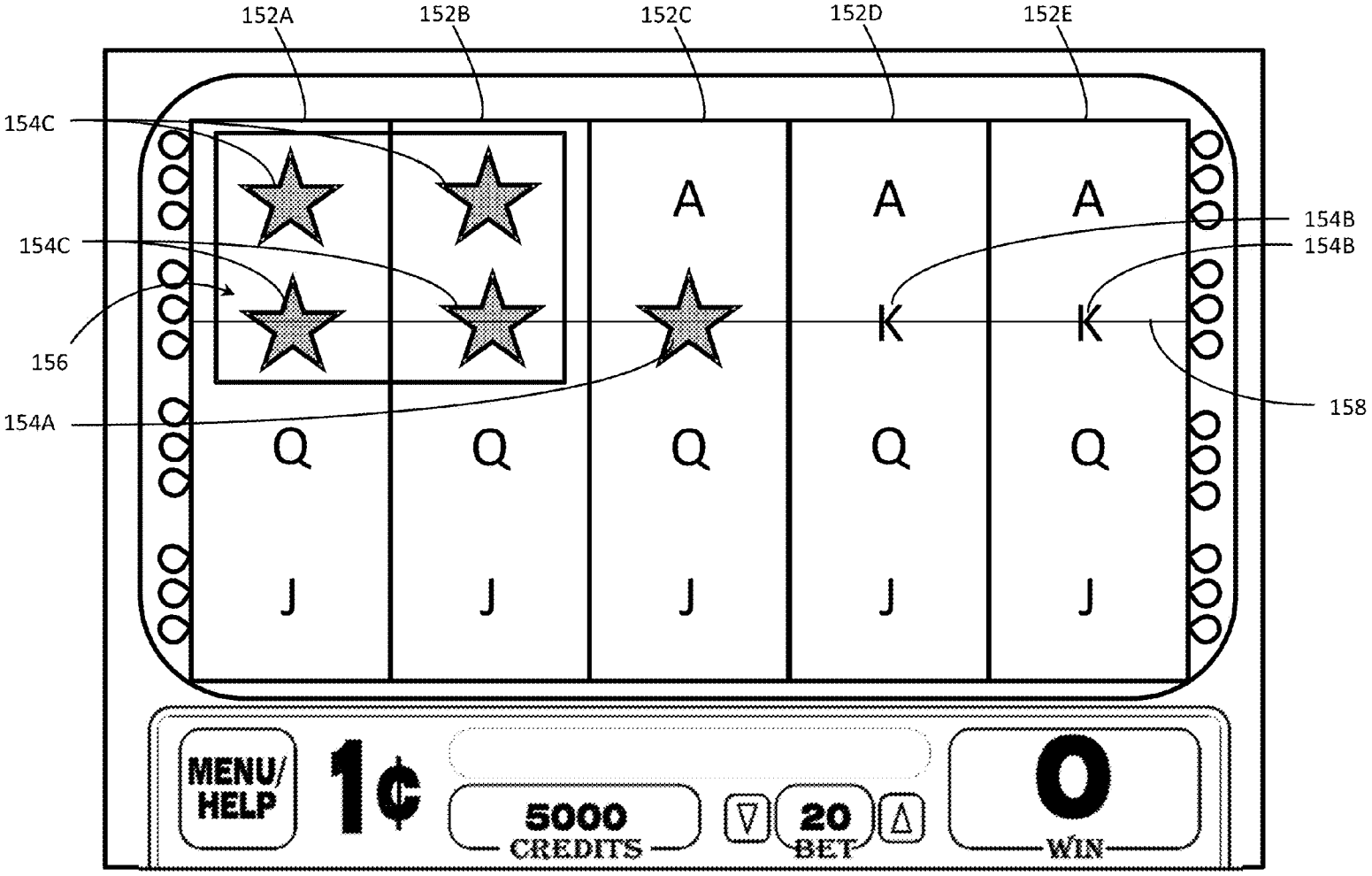

According to additional and/or alternative aspects of the present disclosure, the mega symbol(s) 156 can be evaluated as a plurality of symbols 154C such that each array position occupied by the mega symbol 156 is considered to be occupied by an individual symbol 154C of a type indicated by the mega symbol 156 (e.g., a "star" type of symbol is indicated by an image on the mega symbol 156 of FIG. 8A). For example, FIG. 8B conceptually illustrates the mega symbol 156 of FIG. 8A evaluated as a plurality of symbols 154C in accordance with a pay table. In the illustrated example of FIG. 8A and FIG. 8B, the mega symbol 156 is displayed on the top two positions of the first reel 152A and the top two positions of the second reel 152B. As such, the active payline 158 in both FIG. 8A and FIG. 8B includes the "star" mega symbol 156, the "star" symbol 154A (i.e., a non-mega symbol 154), and two "K" symbols 154B. As shown in FIG. 8B, the mega symbol 156 can be evaluated as a plurality of symbols 154C such that the symbol combination on the activate payline 158 is three "star" symbols 154 (i.e., two "star" symbols 154C on the reels 152A, 152B from the mega symbol 156 and one "star" symbol 154A on the reel 152C) and two "K" symbols 154B.

Figure 8C:
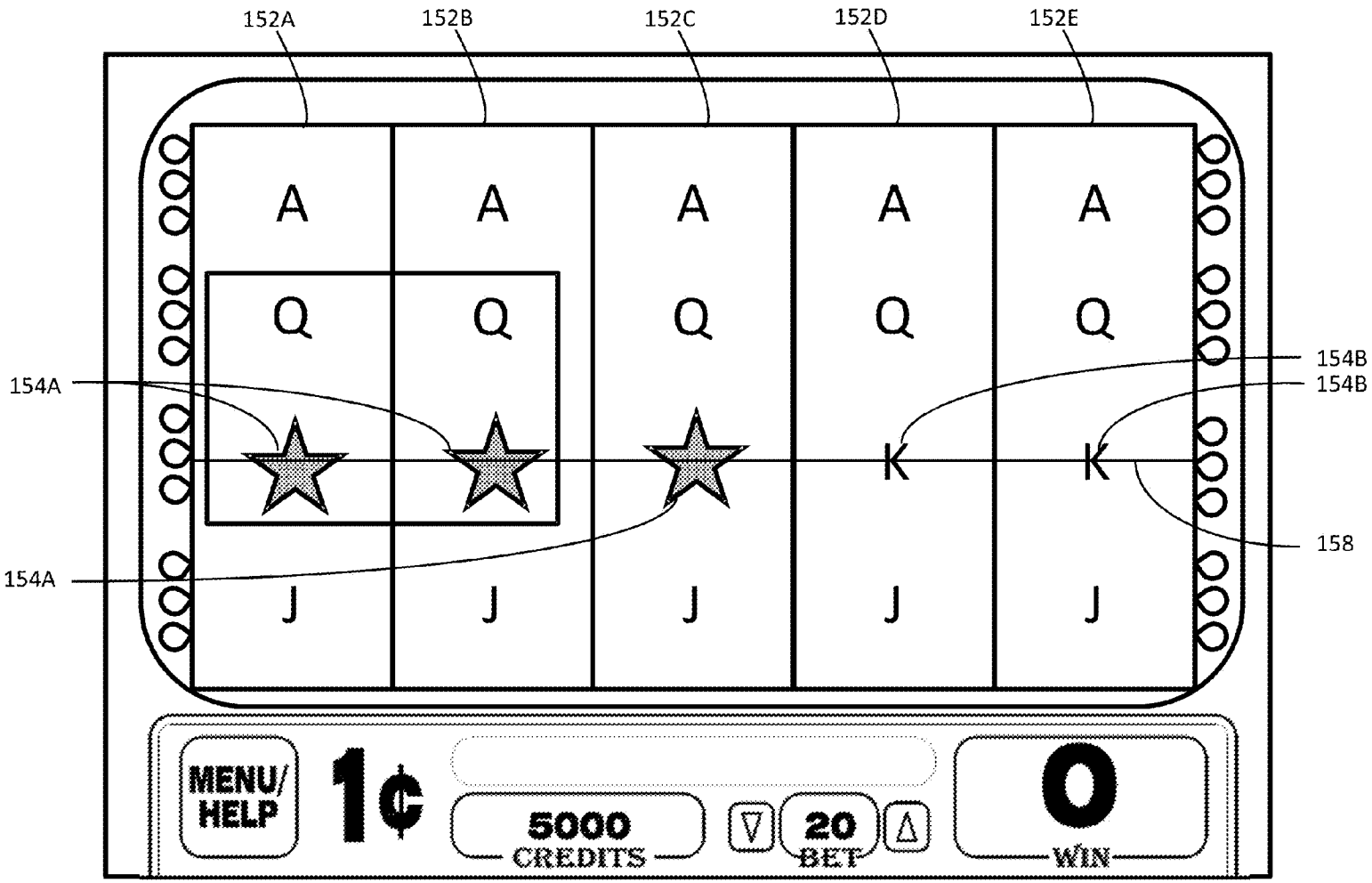

To demonstrate the difference between evaluating the mega symbol 156 as a single symbol and evaluating the mega symbol 156 as a plurality of symbols 154C, FIG. 8C shows a different outcome for a wagering game that does not include the mega symbol 156. Rather, FIG. 8C shows an exemplary outcome with a symbol combination of three "star" symbols 154A and two "K" symbols 154B on the active payline 158. The symbol combination on the active payline 158 of FIG. 8C can achieve the same payout as the symbol combination on the active payline 158 of FIG. 8A if the mega symbol 156 of FIG. 8A is evaluated as a plurality of symbols 154C but can achieve a different payout if the mega symbol 156 of FIG. 8A is evaluated as a single symbol 156.

Although FIGS. 8A-8B do not illustrate symbols 154 overlapping with the mega symbol 156, it should be understood that, according to some aspects, the exemplary evaluations of the mega symbol 156 described and illustrated with respect to FIGS. 8A-8B can also be applied to a mega symbol 156 with transparency, framing, watermarking, and/or other characteristics allowing the symbols 154 overlapping with the mega symbol 156 to be visible. Indeed, unless expressly stated to the contrary, it should be understood that many aspects of the present disclosure can be utilized in either context (i.e., symbols 154 overlapping with a mega symbol 156 are visible or are not visible).

Figure 9A:
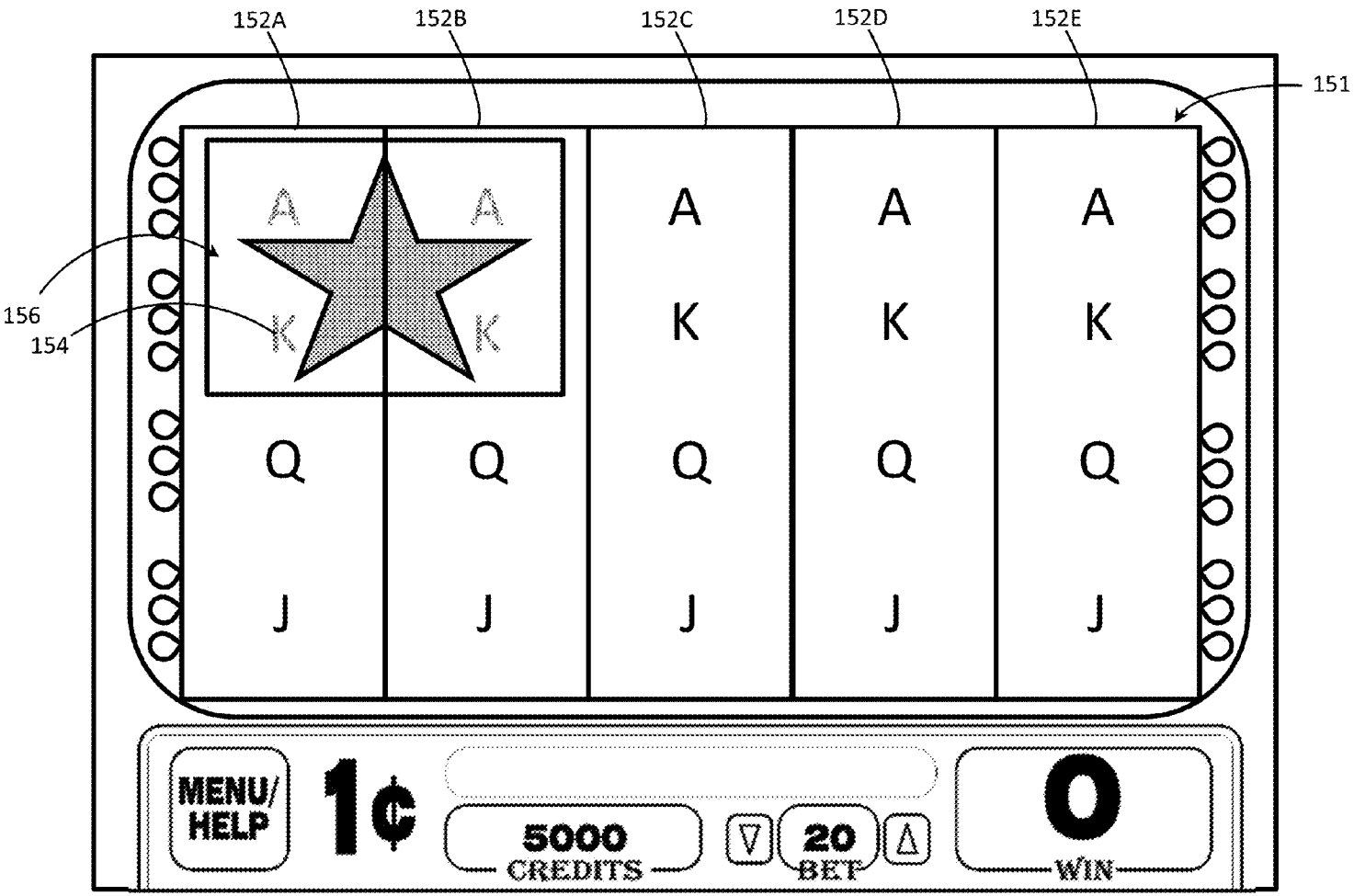
FIGS. 9A-9B are images of exemplary game screens of a wagering game displayed on a gaming terminal, according to an embodiment of the present invention.
Figure 9B:
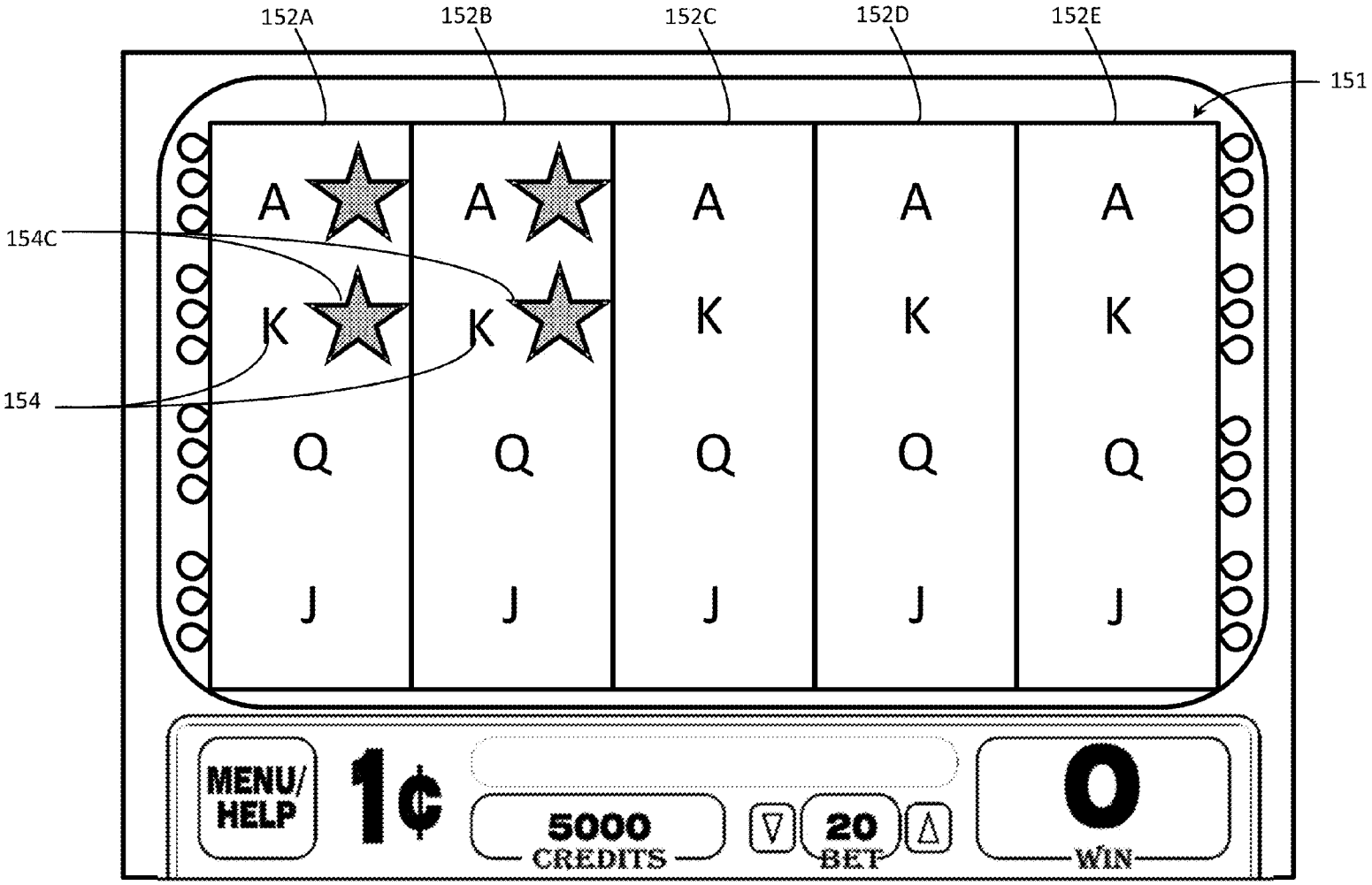

According to additional and/or alternative aspects, if the mega symbol(s) 156 and the symbols 154 overlapping with the mega symbol(s) 156 are both displayed in the array 151 (e.g., via a transparency, a frame 157, a watermark 159, etc.), each of the array positions occupied by the overlapping symbols 154, 156 can be evaluated as having two symbols—(1) the symbol 154 in the array position and (2) a symbol 154C indicated by the mega symbol(s) 156 in the array position. For example, FIG. 9A illustrates an exemplary outcome of a wagering game in which a mega symbol 156 is displayed on the reels 152A, 152B, and a plurality of symbols 154 are displayed in respective positions of the array 151. FIG. 9B conceptually illustrates the mega symbol 156 and the symbols 154 evaluated as two symbols in each of the overlapped array positions. As shown in FIG. 9B, the array positions occupied by the overlapping symbols 154, 156 in FIG. 9A include the symbol 154 on the reels 152A, 152B as well as a symbol 154C of the type indicated by the mega symbol 156 (i.e., a "star" symbol 154C for the mega symbol 156).

In some implementations, a pay table can include a line pay(s) and/or a scatter pay(s) for symbol combinations including both the symbols 154 on the reels 152A-152E and the symbols 154C indicated by the mega symbol 156. For example, the pay table can include a line pay for a symbol combination including more than five symbols (e.g., a payout for a combination of five "A" symbols 154 and two "star" symbols 154C in FIG. 9B).

According to additional and/or alternative implementations, the array 151 can be evaluated more than once with different symbols in the overlapped array positions. For example, the array 151 can be first evaluated with the symbols 154 in the overlapped array positions and then evaluated a second time with the symbols 154C from the mega symbol 156 in the overlapped array positions. For example, the first evaluation can include the two "A" symbols 154 and the two "K" symbols 154 in the respective overlapped array positions and the second evaluation can include four "star" symbols 154C in the respective overlapped array positions of FIGS. 9A and 9B.

According to additional and/or alternative aspects of the present disclosure, the mega symbol(s) 156 can have an associated functionality that can be applied to the mega symbol 156, the symbols 154 overlapping with the mega symbol 156, and/or a combination of symbols 154, 156 including at least one of the mega symbol 156 or a symbol 154 overlapping with the mega symbol 156. As non-limiting examples, the functionality of the mega symbol(s) 156 can include one or more multipliers, wilds, automatic nudges, different pay tables, pay table upgrades, extra wilds, scatter conversions, individual reel re-spins, free spins, morphs, automatic wager increases, hold symbols, symbol movements, additional pay lines, bonus triggers, combinations thereof, and/or the like.

A multiplier functionality can be provided to multiply a payout or other outcome awarded to the player. The magnitude of the multiplier (e.g., 2× multiplier or 3× multiplier) can be a randomly determined or a fixed value. The magnitude of the multiplier can be predetermined (i.e., determined prior to a play of the wagering game) or dynamically determined (i.e., during and/or after a play of the wagering game), as described below.

A wild functionality can be provided to allow one or more symbols to be evaluated as one or more other symbols on the reels that would complete a winning combination.

An automatic nudge functionality is advantageous in situations where a better payout can be achieved by moving one or more symbols on one (or multiple) reels either up or down across a payline.

A different-pay-table functionality implements a different and higher-paying pay table, awarding larger payouts for various symbol combinations. For example if a combination of three "cherry" symbols normally pays out 200% of the original wager, the different-pay-table functionality may result in a payout of 300% of the original wager for the same combination. Similarly, if a combination of three "7" symbols normally pays out 500% of the original wager, the different-pay-table functionality may result in a payout of 1000% of the original wager for the same combination.

An upgrade functionality causes a winning symbol combination to move up at least one winning symbol combination on the pay table for the gaming terminal 10. For example, a lower-paying combination of three "cherry" symbols may pay out as if the player had achieved three "3-bars" symbols, a better combination.

An extra-wild functionality causes one or more symbols that are normally a regular symbol, such as a "cherry" symbol or a "1-bar" symbol, to become a wild symbol.

The scatter conversions functionality converts a line pay payout into a scatter payout, such that a winning combination of symbols need not be located all on a single active payline.

The right-to-left functionality allows "right-to-left" combinations (i.e., combinations starting on the right-most reel and extending left across the reels) to win, in addition to the standard winning "left-to-right" combinations.

The re-spin functionality re-spins one or more of the reels if the player does not achieve any winning combination and/or a winning combination associated with an award above a predetermined amount, giving the player an additional chance to get a winning combination and/or a better winning combination.

The morph functionality allows one or more symbols on the reels to morph into other symbols that are more beneficial. For example, a mega symbol 156 can cause one or more of the symbols 154 overlapping with the mega symbol 156 to morph into a type of symbol indicated by the mega symbol 156. In some instances, all symbols 154 that overlap with the mega symbol 156 can morph. In other instances, only symbols 154 of one or more predetermined types (e.g., a "K" symbol or a "seven" symbol) that overlap with the mega symbol 156 can morph. In still other instances, the symbols 154 overlapping with the mega symbol 156 can morph only if those symbols 154 include a watermark associated with the mega symbol 156. As another example, if the mega symbol 156 is fully displayed within the array 151, the symbols 154 bearing the watermark can morph into a type of symbol indicated by the mega symbol 156 regardless of whether the watermarked symbols (and/or other predetermined symbols) overlap with the mega symbol 156. The watermark can be an image that is the same as or similar to an image displayed in connection with the mega symbol 156. It is contemplated that symbols capable of morphing can be identified in ways other than a watermark.

The hold symbol functionality holds one or more symbols in a certain position within the array so that, after respinning, a final symbol combination across the reels takes into account the held symbol.

The symbol movement functionality allows one or more symbols to move to other locations along a payline if it would result in a better outcome (e.g., a higher award).

A winning combination typically results in a payout that is generally proportionate to the amount wagered. For example, when five credits are wagered and the player achieves a winning combination, the payout may be at least five times as large as it would have been if only one credit had been wagered. In one exemplary implementation, the increased-wager functionality can treat a winning combination as though the player had bet the maximum amount, thereby effectively increasing the wagered amount, resulting in a higher payout. For example, if the player had only wagered one of five possible credits, the increased-wager functionality would treat the player's wager as though five credits had been wagered.

Figure 10A:
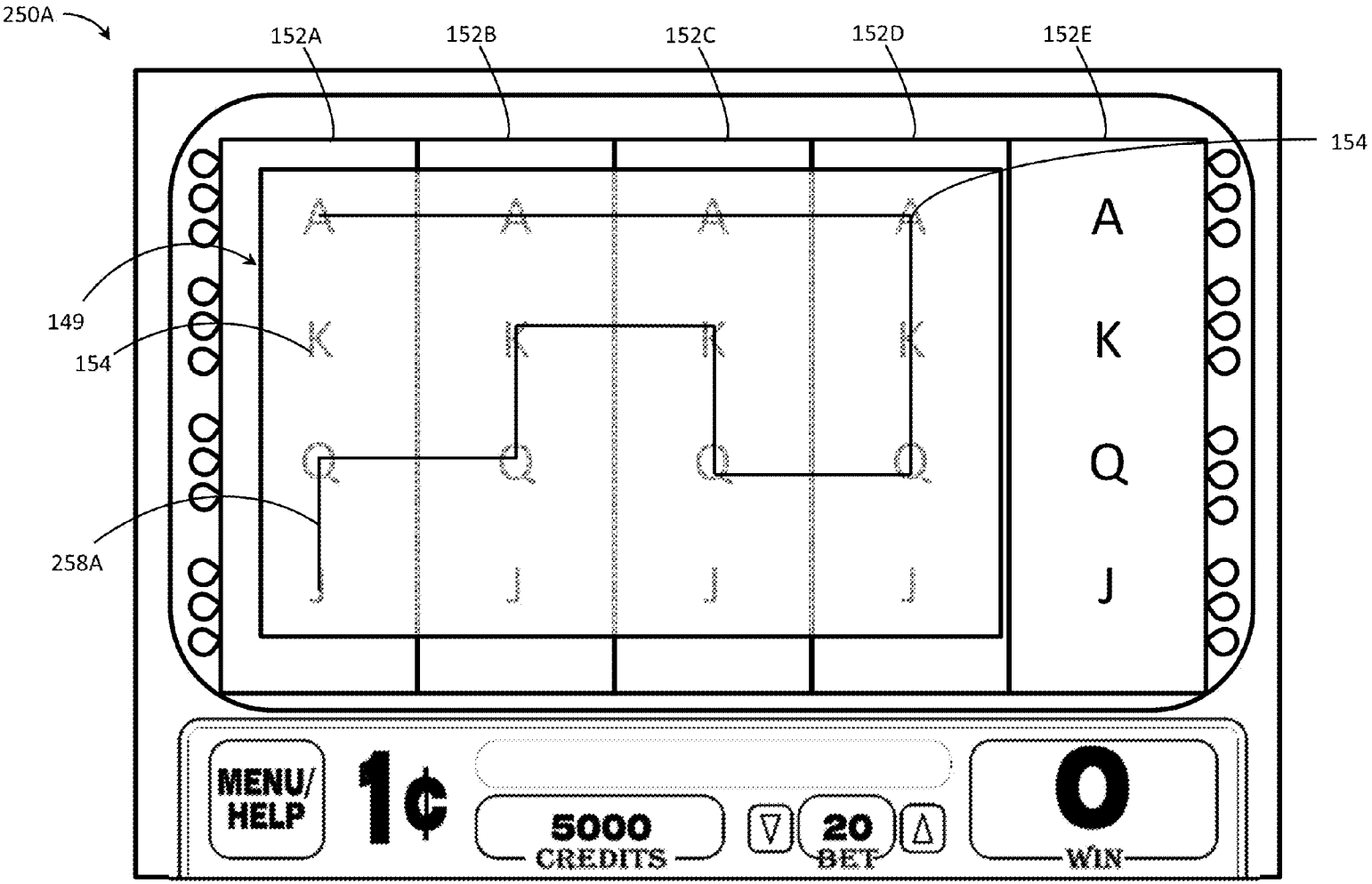
FIGS. 10A-10B are images of exemplary game screens of a wagering game displayed on a gaming terminal, according to an embodiment of the present invention.
Figure 10B:
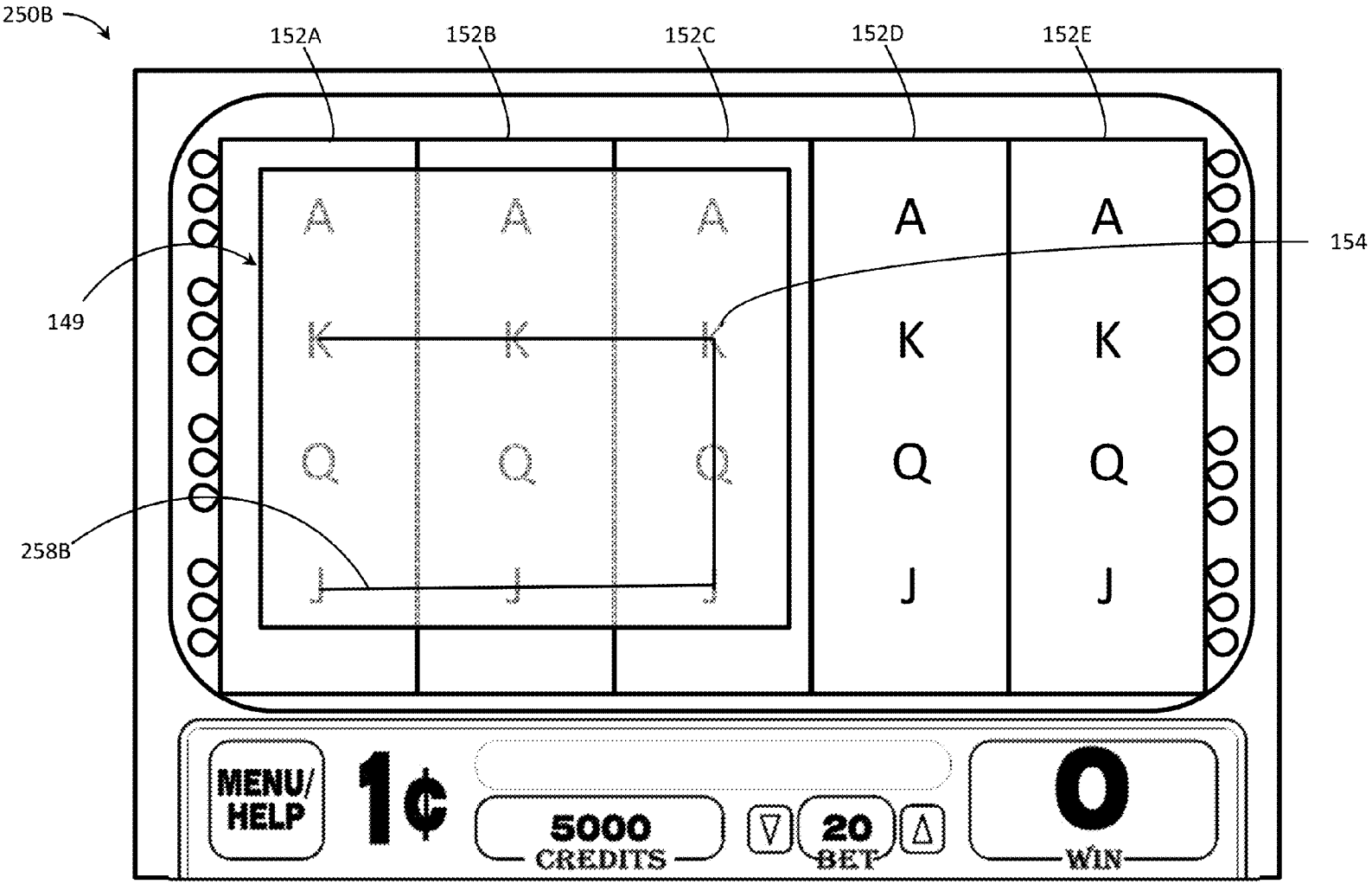

The mega-activated-pay-lines functionality can allow for new pay lines including a plurality of array positions that overlap with a mega symbol 156 to be activated. For example, FIGS. 10A-10B illustrate two exemplary screen shots 250A, 250B in which a mega-activated-pay-lines functionality is provided by an activation mega symbol 149. As shown in FIGS. 10A-10B, a mega-activated pay line 258A, 258B includes a plurality of array positions occupied by the activation mega symbol 149 so as to provide additional and/or unique opportunities for winning combinations based on the symbols 154 overlapping with the activation mega symbol 149.

It should be understood that the functionalities of the mega symbol(s) 156 described above are provided as examples of potential functionalities. It is contemplated that other functionalities can be employed in connection with the mega symbols 156 described herein. Additionally, it is contemplated that the mega symbol(s) 156 can include an indication on the face of the mega symbol(s) 156 of the functionality or the functionalities associated with the mega symbol(s) 156 (e.g., via text, symbols, images, color, etc.).

According to some aspects of the present disclosure, the functionality can be provided for a mega symbol 156 only if the mega symbol 156 occupies the entire array 151 (as shown, e.g., in FIG. 4C). For example, a different-pay-table functionality can be provided when a mega symbol 156 is displayed in all array positions of an array 151, as shown in FIG. 4C. As another example, a multiplier functionality can be applied to the payouts for the winning combinations of the symbols 154 when a mega symbol 156 is displayed in all array positions of the array 151.

Figure 11A:
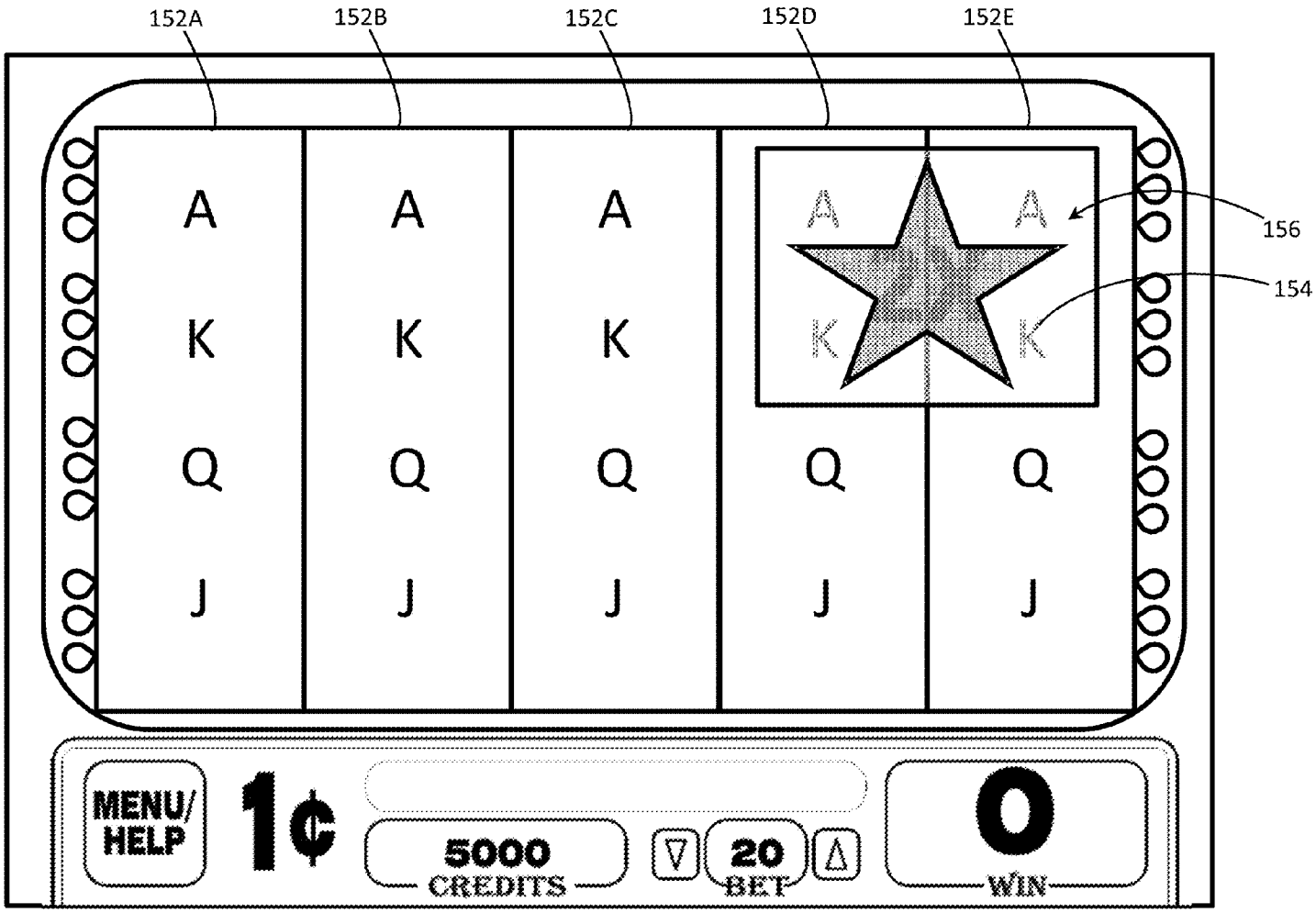
FIGS. 11A-11B are images of exemplary game screens of a wagering game displayed on a gaming terminal, according to an embodiment of the present invention.
Figure 11B:
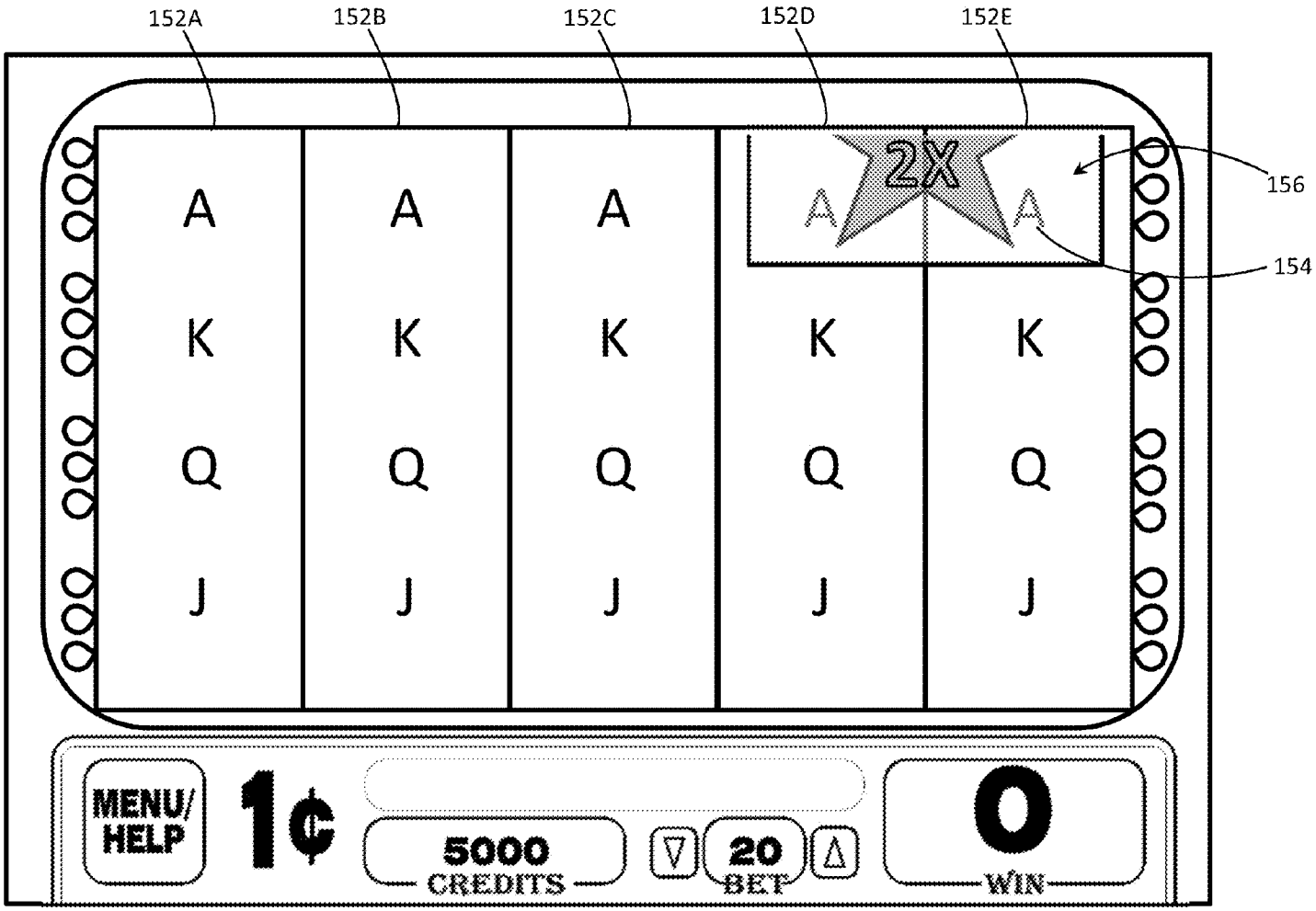

According to additional and/or alternative aspects of the present disclosure, the functionality associated with a mega symbol 156 is provided only if the entire mega symbol 156 is displayed within the array 151. For examples, FIGS. 11A and 11B illustrate exemplary outcomes of a wagering game in which a mega symbol includes a 2× multiplier functionality. As shown in FIG. 11A, the entire mega symbol 156 is displayed within the array 151 and, thus, the 2× multiplier functionality is active for an evaluation of the outcome. By contrast, in FIG. 11B, the mega symbol 156 is only partially displayed within the array 151 and, thus, the 2× multiplier functionality is not active for an evaluation of the outcome. As shown, for example, in FIGS. 11A-11B, the mega symbol 156 can include an indication of the functionality associated with the mega symbol 156.

As described above, according to various aspects of the present disclosure, the 2× multiplier functionality can be applied to the mega symbol 156, the symbols 154 overlapping with the mega symbol 156 (i.e., the "A" symbols and the "K" symbols on the reels 152D, 152E in FIG. 11A), and/or a combination of symbols 154, 156 including at least one of the mega symbol 156 or a symbol 154 overlapping with the mega symbol 156. For example, if a pay table included a scatter pay that awards 100 credits in response to the outcome including the mega symbol 156 being displayed entirely within the array 151, the player can be awarded 200 credits (i.e., 100 credits for the scatter pay multiplied by the 2× multiplier functionality associated with the mega symbol 156). As another example, if the pay table includes a line pay that awards 200 credits for an outcome including the mega symbol 156 displayed entirely within the array 151 in combination with three "K" symbols, the player can be awarded 400 credits (i.e., 200 credits for the line play multiplied by the 2× multiplier functionality associated with the mega symbol 156). As still another example, if the pay table includes a line pay that awards 500 credits for an outcome including five "K" symbols, the player can be awarded 1000 credits because at least one of the "K" symbols 154 overlaps with the mega symbol 156. In yet another example, if the pay table includes the line pay that awards 500 credits for an outcome including five "K" symbols, the player can be awarded 2000 credits because two of the "K" symbols 154 overlap with the mega symbol 156 (i.e., the 2× multiplier functionality can be applied to each overlapped symbol 154 as opposed to the entire combination of five "K" symbols, as described in the previous example).

According to additional and/or alternative aspects of the present disclosure, the functionality associated with the mega symbol 156 can be provided if at least a portion of the mega symbol 156 is displayed within the array 151. It is contemplated that, according to some aspects, the pay table can include line pays, scatter pays, and/or bonus triggers based on a portion of the mega symbol 156 being displayed within the array 151.

According to additional and/or alternative aspects of the present disclosure, the functionality of a mega symbol 156 can remain the same (or fixed) for all plays of a wagering game. According to alternative aspects of the present disclosure, the functionality of the mega symbol 156 can vary from one spin to the next or from one series of spins to the next. That is, the type of functionality and/or the magnitude of the functionality can vary from one spin to the next and/or from one series of spins to the next.

For example, the functionality associated with one or more mega symbols 156 can be based on a wager amount for a single play and/or a turnover amount over a plurality of plays of a wagering game. In one exemplary implementation, a mega symbol 156 can be associated with a 2× multiplier for a wager of two credits, a 3× multiplier for a wager of three credits, a 4× multiplier for a wager of four credits, and a 5× multiplier for a wager of five credits. In another exemplary implementation, the mega symbol 156 can be associated with a 2× multiplier functionality for a wager of two credits, a 2× multiplier functionality and a wild functionality for a wager of three credits, a pay table upgrade functionality for a wager of four credits, and a free-spins functionality for a wager of five credits. In yet another exemplary implementation, the mega symbol 156 can be associated with a first bonus trigger functionality for a max bet wager and a second bonus trigger functionality for a wager amount that is less than the max bet amount such that different opportunities to achieve the same or different bonus awards can be triggered based on the mega symbol 156 displayed in the array 151.

As another example, the functionality associated with the one or more mega symbols 156 can be randomly determined before, during, and/or after a play of the wagering game. That is, the functionality of the mega symbol(s) 156 for one or more plays of a wagering game can be randomly determined from a plurality of potential functionalities. In some instances, each of the plurality of potential functionalities has the same odds of being randomly determined for each of the one or more of the mega symbol(s) 156. In other instances, the odds of the potential functionalities being determined for the mega symbol(s) 156 can be differently weighted such that some potential functionalities are more likely than others. It is contemplated, that according to some aspects, the weighting(s) can be based on the wager amount (and/or a turnover amount). As such, the functionalities considered to be more advantageous can be more likely to be determined for the mega symbol(s) 156 as the wager amount (or turnover amount) increases; thus, incentivizing the player to place larger wagers and/or play more rapidly.

Figure 12:
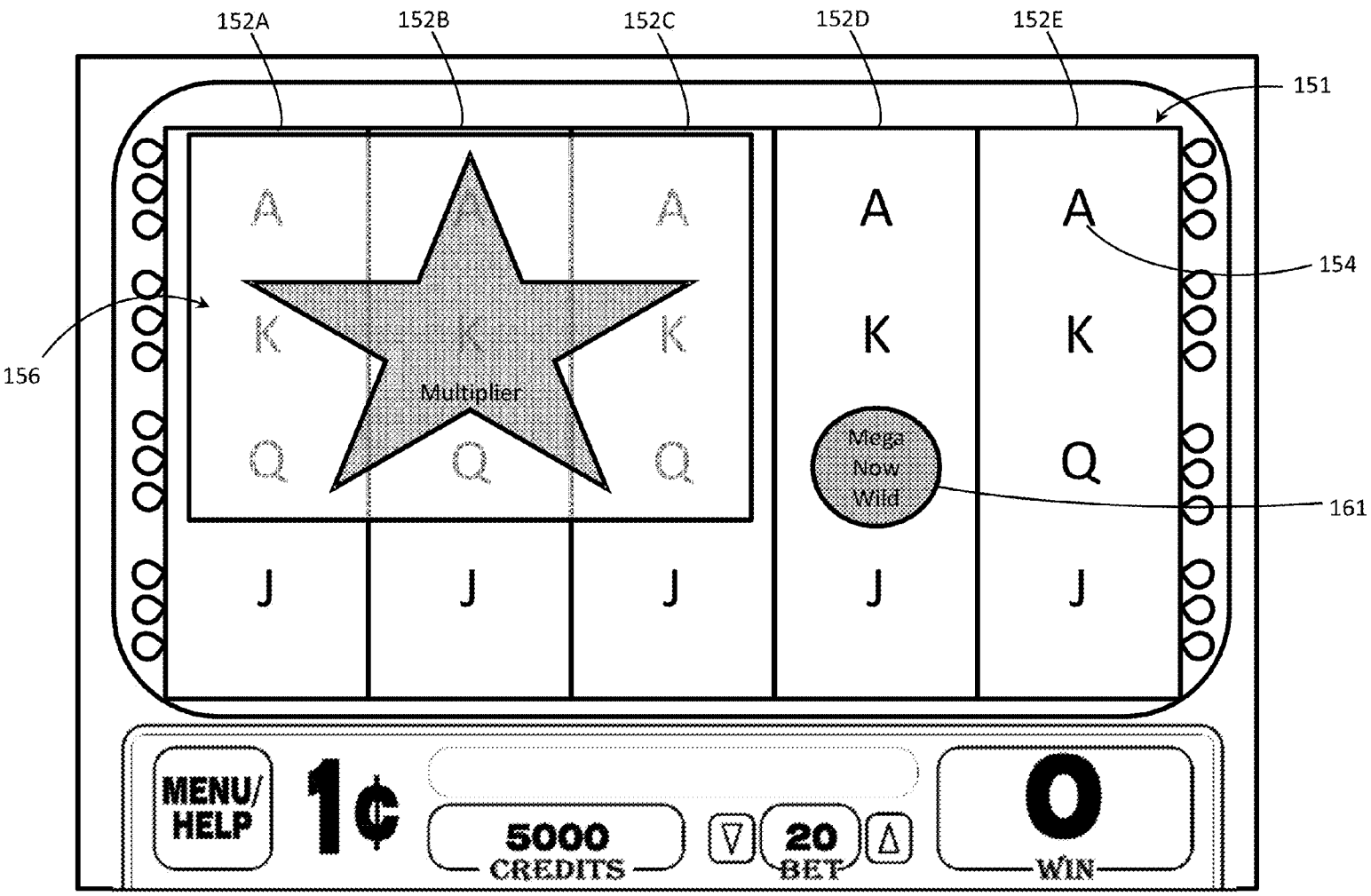
FIG. 12 is an image of an exemplary game screen of a wagering game displayed on a gaming terminal, according to an embodiment of the present invention.
Figure 13A:
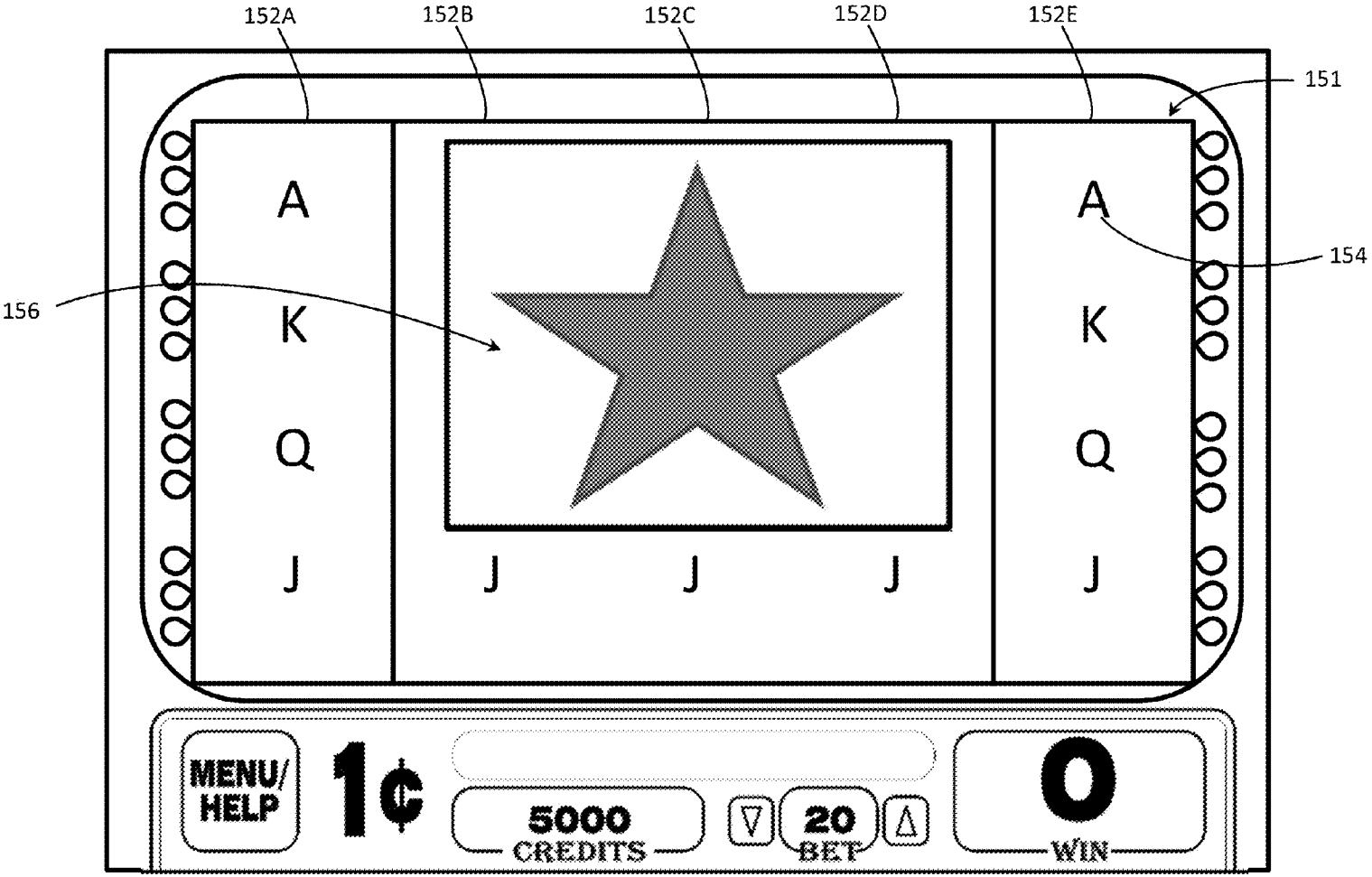
FIGS. 13A-13D are images of exemplary game screens of a wagering game displayed on a gaming terminal, according to an embodiment of the present invention.
Figure 13B:
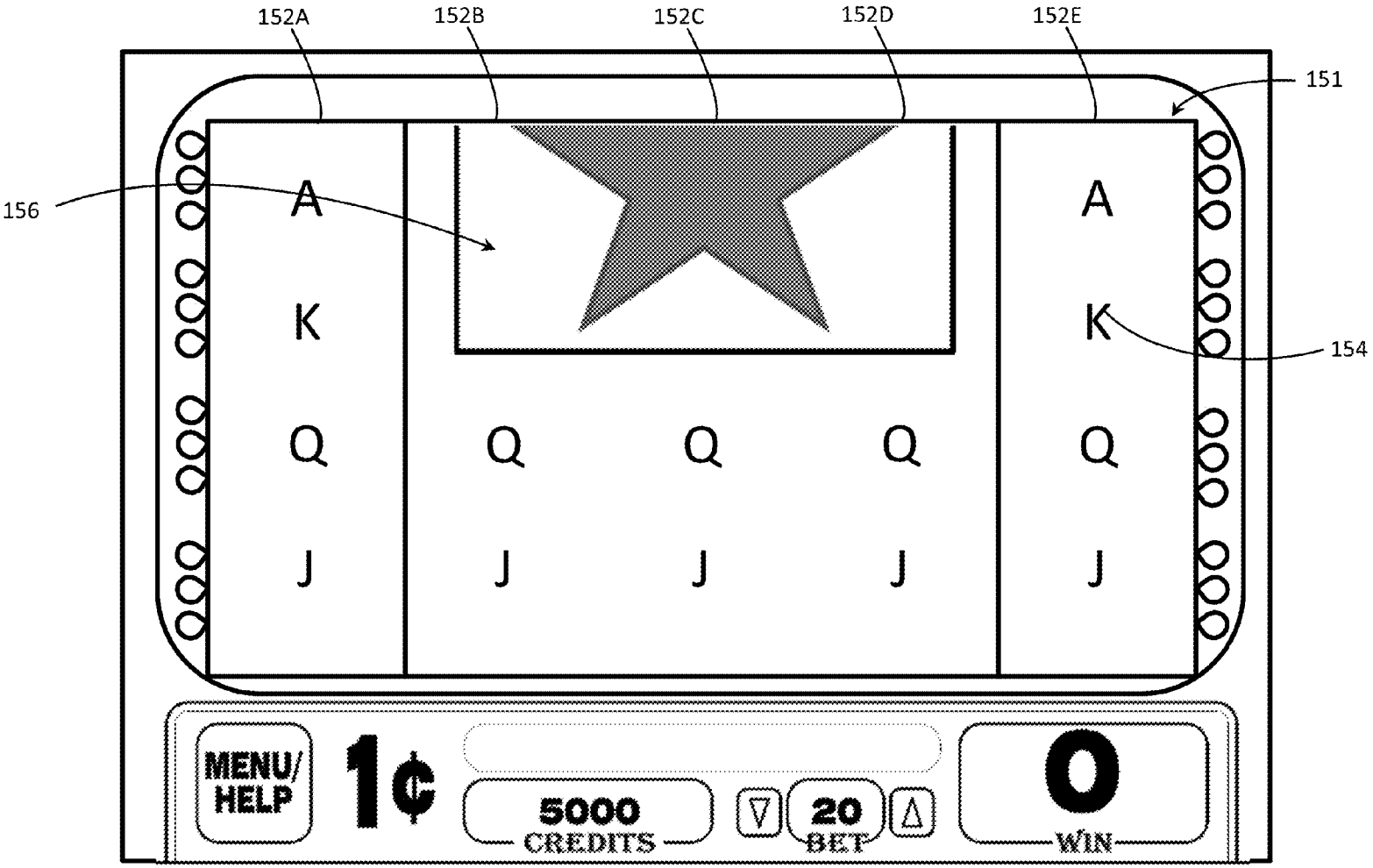
Figure 13C:
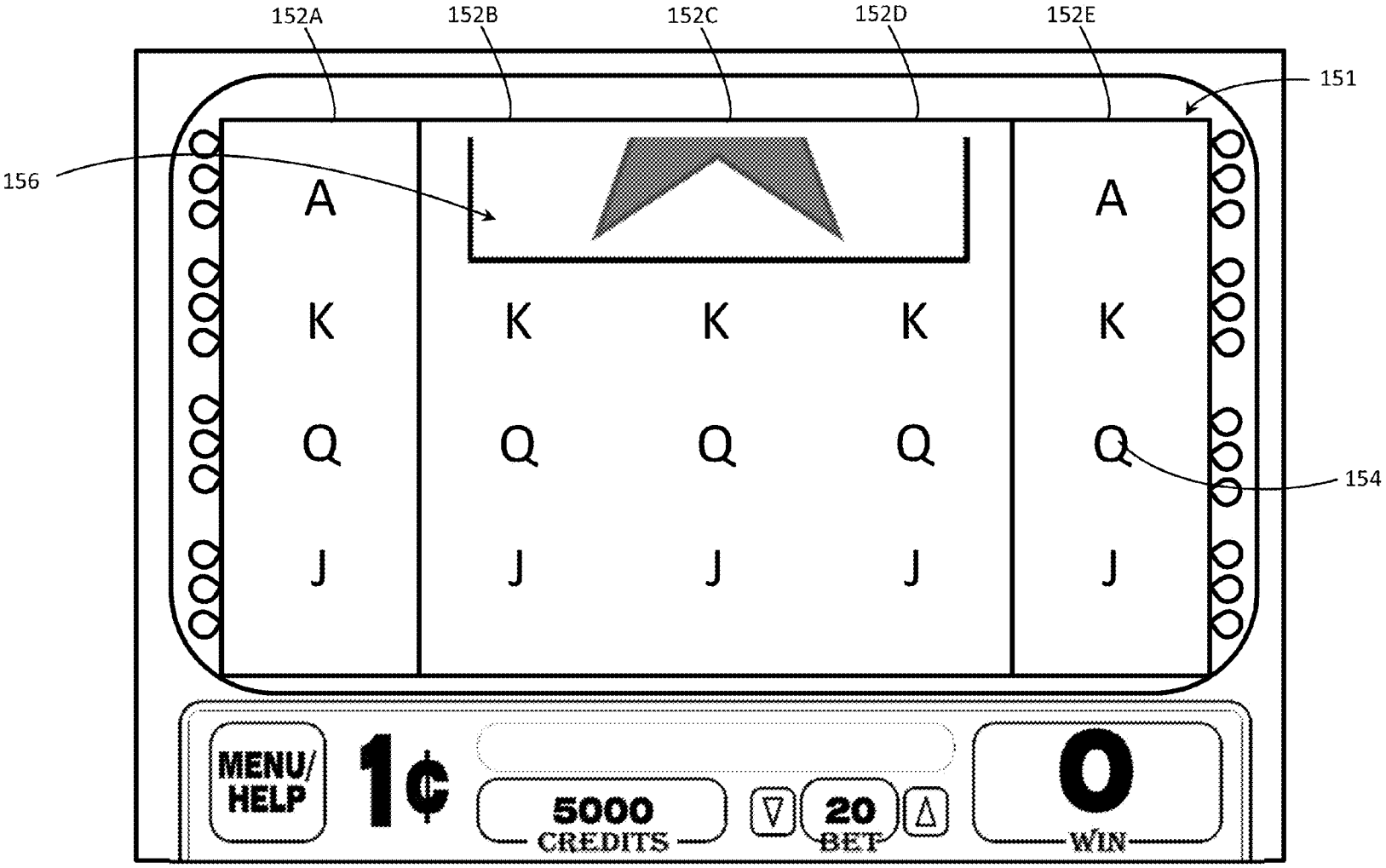
Figure 13D:
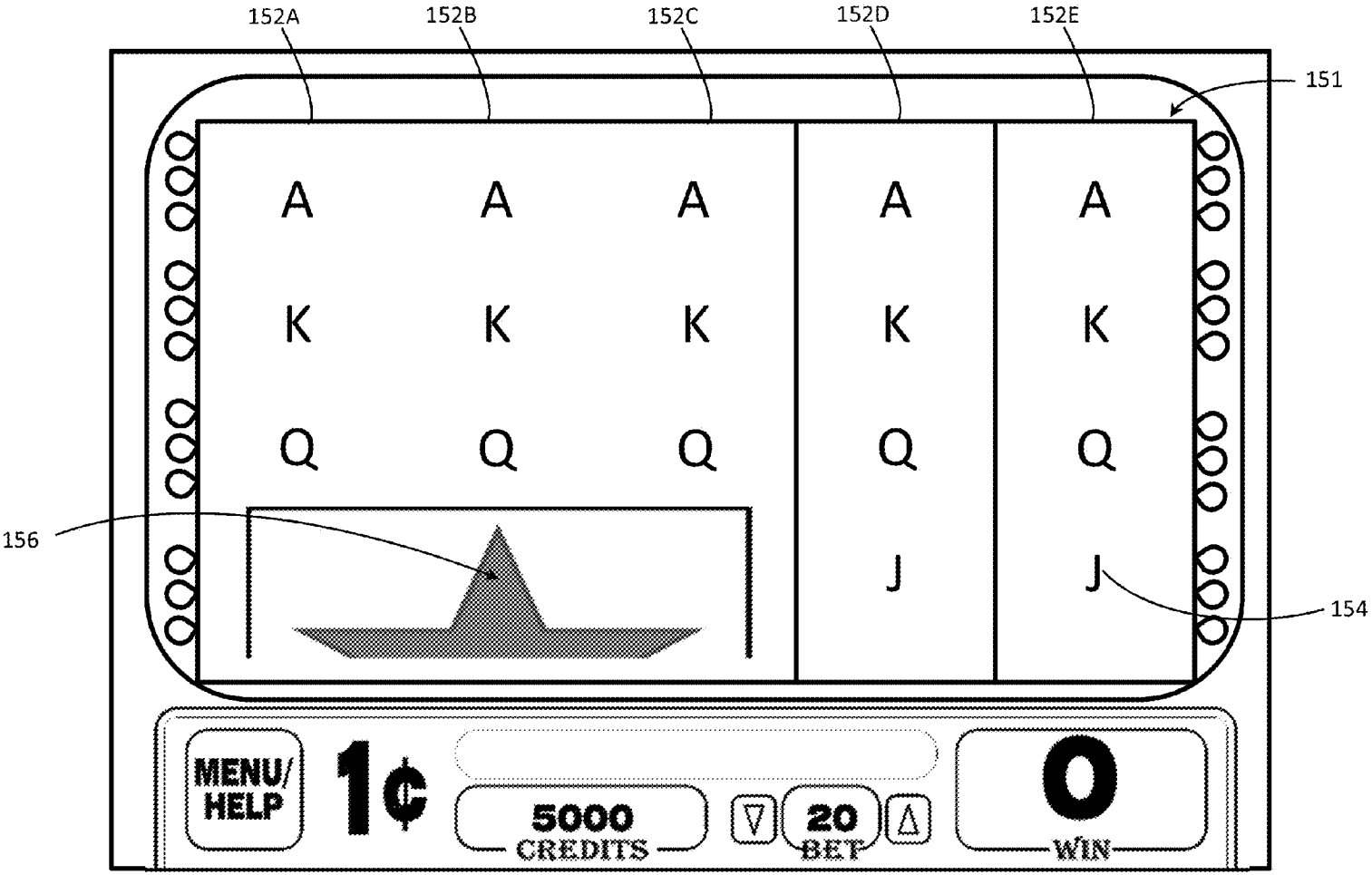

As another example, the functionality associated with the one or more mega symbols 156 can be based on one or more of the symbols 154 in a prior spin or a current spin. As a non-limiting example, FIG. 12 illustrates an exemplary outcome of a wagering game that includes a mega symbol 156 having a first functionality and a predetermined symbol (i.e., a "functionality-changing symbol" 161) configured to cause the mega symbol 156 to change functionalities (e.g., the type of a functionality and/or the magnitude of a functionality can be changed). The functionality-changing symbol 161 can be configured to cause the first functionality (e.g., a multiplier functionality in FIG. 12 as indicated by the functionality-changing symbol 161) of the mega symbol 156 to change to a different second functionality (e.g., a wild functionality in FIG. 12) for the current play of the wagering game and/or for one or more future plays of the wagering game.

In some instances, the functionality-changing symbol(s) 161 cause the functionality of the mega symbol 156 to change if the functionality-changing symbol(s) 161 appear anywhere in the array 151. In other instances, the functionality-changing symbol(s) 161 cause the functionality of the mega symbol 156 to change only if the functionality-changing symbol(s) 161 overlap with the mega symbol 156.

In some implementations, after the functionality of the mega symbol 156 changes from the first functionality to the second functionality, the mega symbol 156 can be associated with the second functionality until another functionality-changing symbol 161 causes the functionality of the mega symbol 156 to change again. In other implementations, the mega symbol 156 can be associated with the different second functionality until a predetermined number of spins occur or another functionality-changing symbol 161 triggers another change to the functionality of the mega symbol 156. In yet another implementation, the mega symbol 156 can be associated with the different second functionality until a predetermined amount of time expires or another functionality-changing symbol 161 causes another change to the functionality of the mega symbol 156. In other words, in some implementations, the mega symbol 156 can have a default functionality, which can be changed for a predetermined number of spins and/or a predetermined period of time based on one or a combination of functionality-changing symbols 161.

Although the example illustrated in FIG. 12 included a functionality-changing symbol 161 as a trigger for causing the functionality of the mega symbol 156 to change, it is contemplated that any other scatter symbol and/or combination of symbols 154 (overlapped and/or not overlapped by the mega symbol 156) can, additionally and/or alternatively, be utilized to cause a change in the functionality of the mega symbol 156. That is, the functionality-changing symbol 161 can have another function in addition to causing the change in functionalities of a mega symbol 156 (e.g., the functionality-changing symbol 161 can be a symbol 154 that can form a winning combination with other symbols 154 in accordance with the pay table).

According to some aspects of the present disclosure, the functionality of the mega symbol 156 can be based on an amount of the mega symbol 156 displayed within the array 151. That is, the functionality can be based on the number of array positions on which the mega symbol 156 is displayed within the array 151 (i.e., based on the number of positions within the array 151 occupied by the mega symbol 156).

For example, a three-by-three sized mega symbol 156 is displayed in FIGS. 13A-13D. The mega symbol 156 occupies nine positions within the array 151 illustrated in FIG. 13A, six positions within the array 151 illustrated in FIG. 13B, three positions within the array 151 illustrated in FIG. 13C, and three positions within the array 151 illustrated in FIG. 13D. Accordingly, the mega symbol 156 can have a first functionality in FIG. 13A, a second functionality in FIG. 13B, and a third functionality in both FIG. 13C and FIG. 13D. The mega symbol 156 can have the same functionality for the outcomes illustrated in FIG. 13C and FIG. 13D because, although the mega symbols 156 are located on different positions of the array 151 and have a different portion of the mega symbol 156 displayed in the array 151 (i.e., a bottom portion in FIG. 13C and a top portion in FIG. 13D), the mega symbol 156 occupies three array positions in both FIG. 13C and FIG. 13D.

It is contemplated that, according to some aspects, the functionalities associated with the different amounts of a displayed mega symbol 156 can all be different from one another (i.e., the first functionality, the second functionality, and the third functionality can all be different in FIGS. 13A-13D). According to other aspects, one or more but not all of the functionalities associated with different amounts of a displayed mega symbol 156 can be the same (e.g., the first functionality can be the same as the second functionality but different from the third functionality in FIGS. 13A-13D).

The different functionalities associated with the different amounts of the mega symbol(s) 156 displayed within the array 151 can include different types of functionalities and/or different magnitudes of functionalities. In one non-limiting implementation of the example illustrated in FIGS. 13A-13D, the first functionality can be a bonus trigger functionality, the second functionality can be a morph functionality, and the third functionality can be a scatter conversions functionality. In another non-limiting implementation, the first functionality can be a 5× multiplier, the second functionality can be a 3× multiplier, and the third functionality can be a 2× multiplier. In still another non-limiting implementation, the first functionality can be a first bonus trigger, the second functionality can be a second bonus trigger, and the third functionality can be a third bonus trigger, where the first bonus trigger, the second bonus trigger, and the third bonus trigger can trigger different bonus game opportunities (e.g., different types of bonus games, different potential bonus awards, etc.)

Figure 14A:
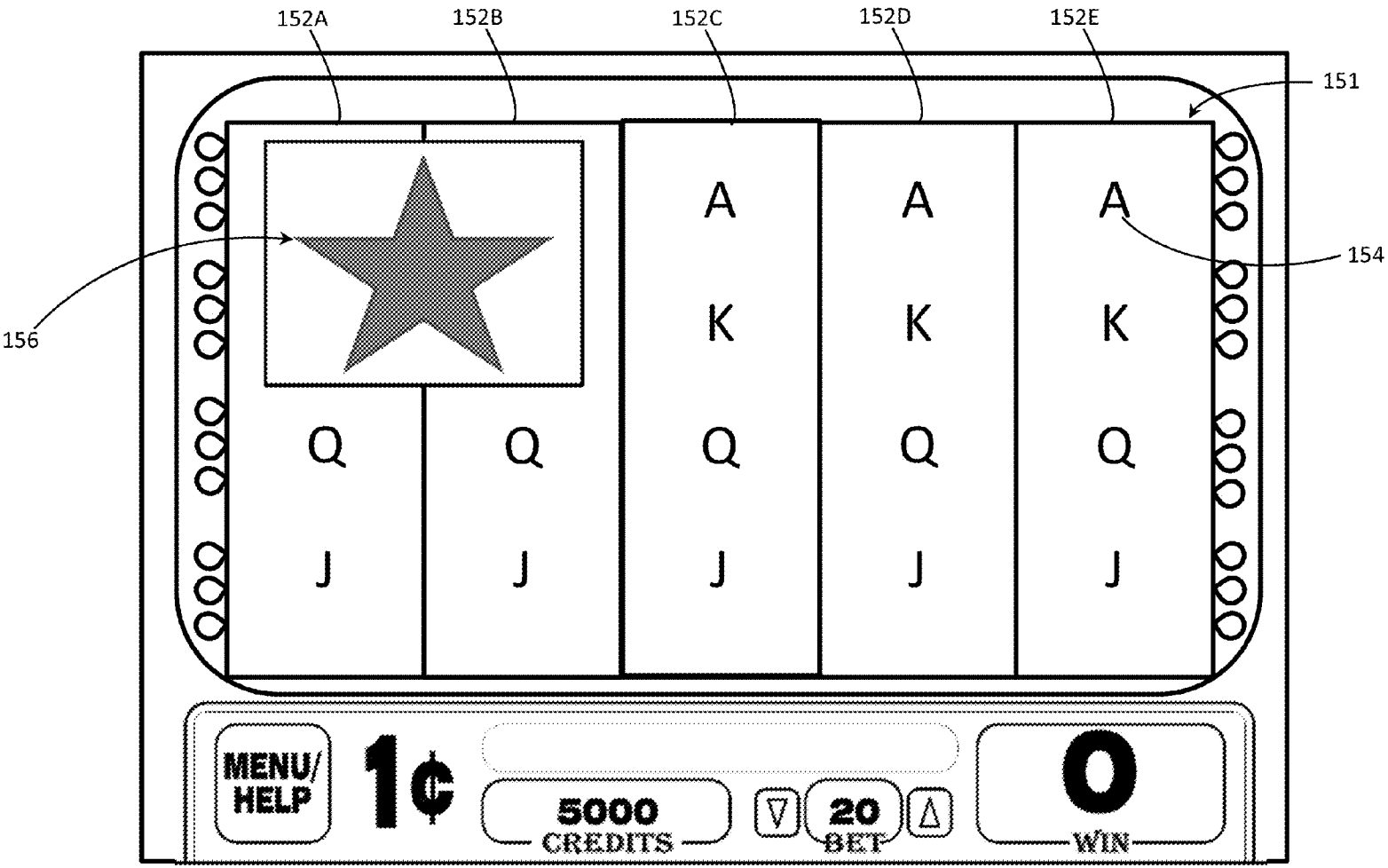
FIGS. 14A-14B are images of exemplary game screens of a wagering game displayed on a gaming terminal, according to an embodiment of the present invention.
Figure 14B:
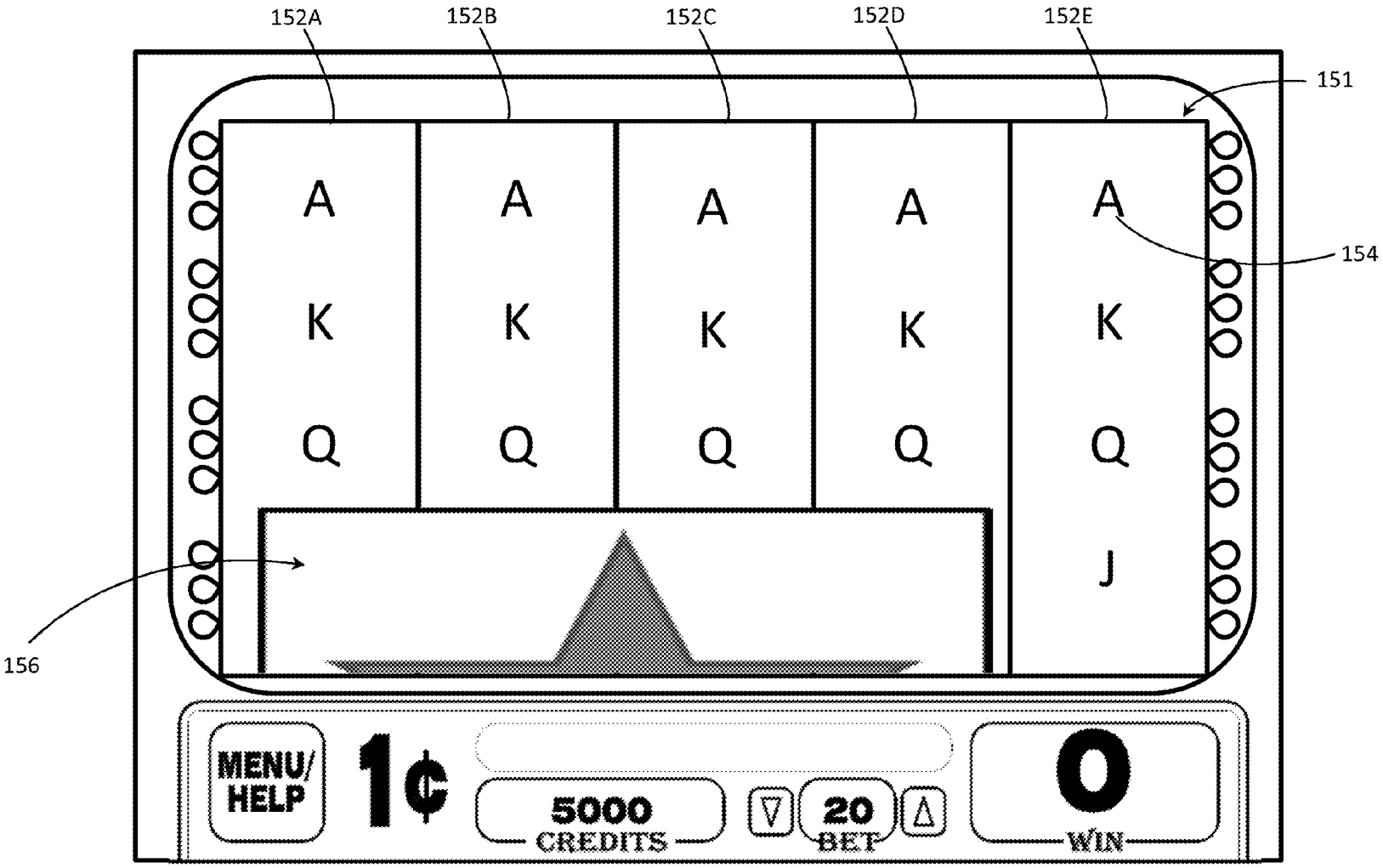

While the example illustrated in FIGS. 13A-13D included a three-by-three sized mega symbol 156, it is contemplated that, according to some aspects, the functionality of the mega symbol 156 can be based on the amount of a mega symbol 156 displayed within the array 151 regardless of the size of the mega symbol 156. For example, FIGS. 14A-14B each illustrate a mega symbol 156 having a different size but occupying the same number of array positions and, thus, providing the same functionality. More particular, FIG. 14A illustrates a two-by-two mega symbol 156 occupying four array positions and FIG. 14B illustrates a four-by-three mega symbol 156 occupying four array positions. As such, according to some aspects, the mega symbol 156 displayed in FIG. 14A can have the same functionality as the mega symbol 156 displayed in FIG. 14B.

According to alternative aspects, the functionality of the mega symbol 156 can be based on the amount of the mega symbol 156 displayed within the array 151 and the size of the mega symbol 156. According to such alternative aspects, the two-by-two mega symbol 156 occupying four positions of the array 151 in FIG. 14A can provide a different functionality than the four-by-three mega symbol 156 occupying four positions of the array 151 in FIG. 14B.

Figure 15A:
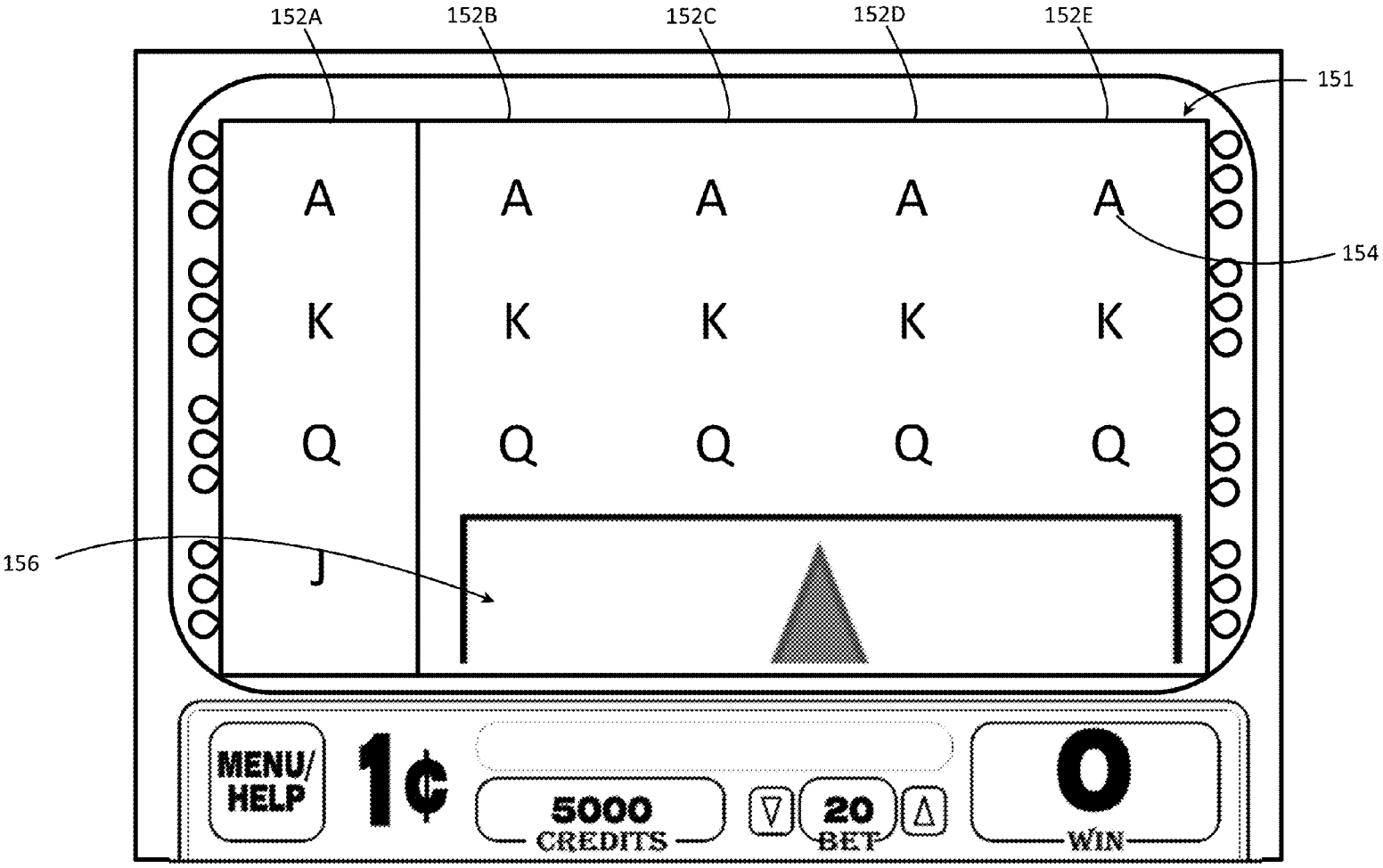
FIGS. 15A-15G are images of exemplary game screens of a wagering game displayed on a gaming terminal, according to an embodiment of the present invention.
Figure 15B:
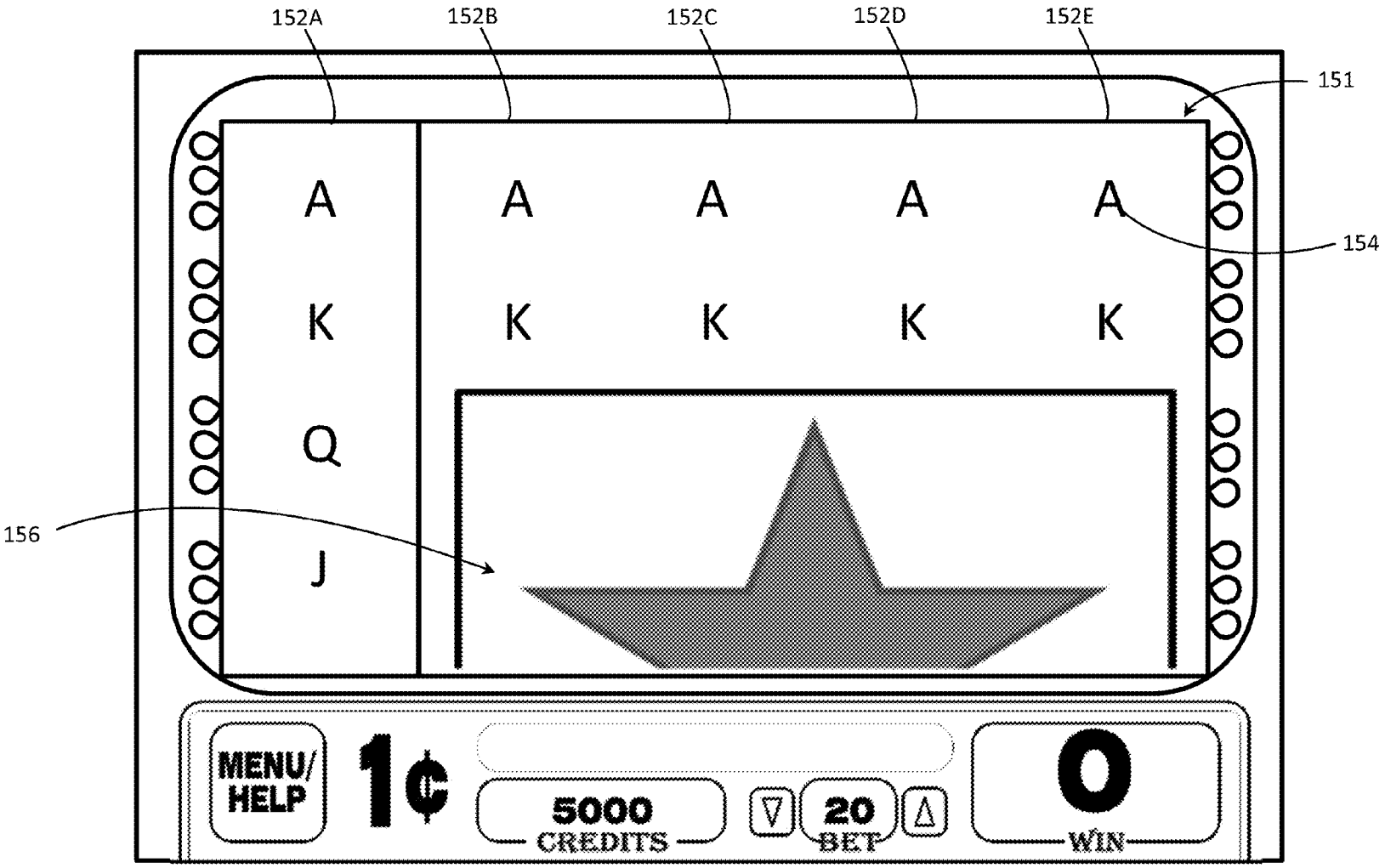
Figure 15C:
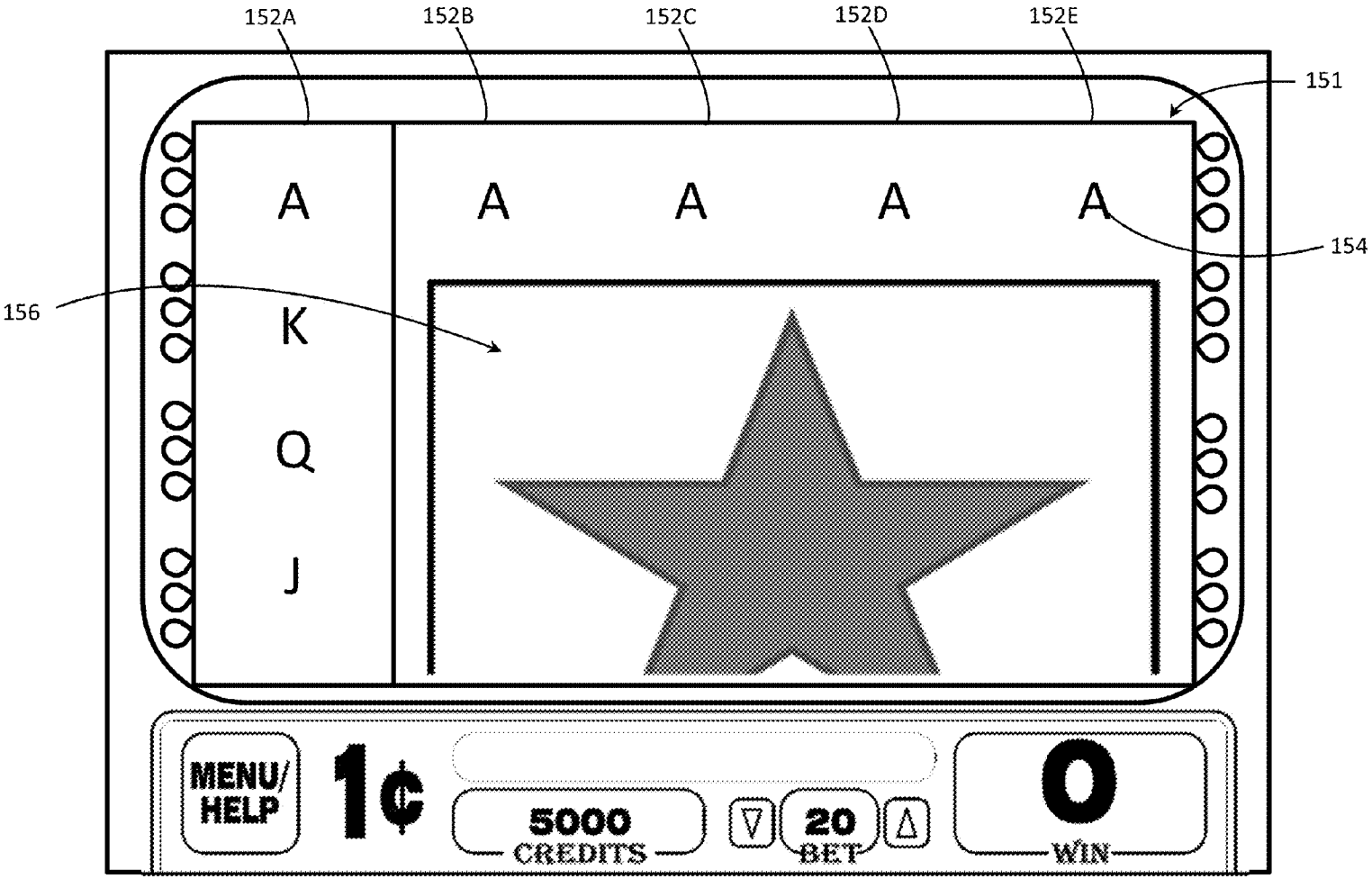
Figure 15D:
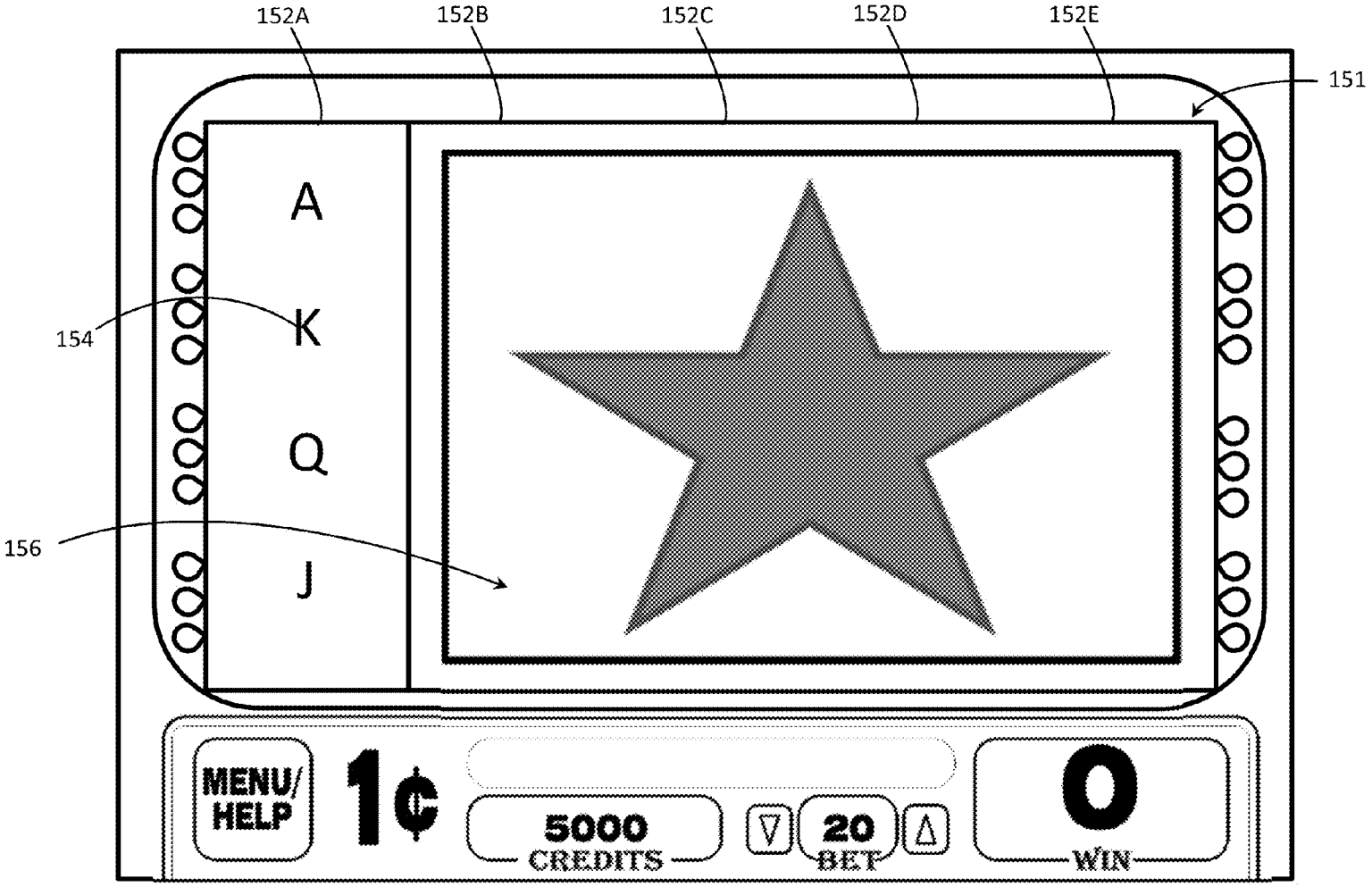
Figure 15E:
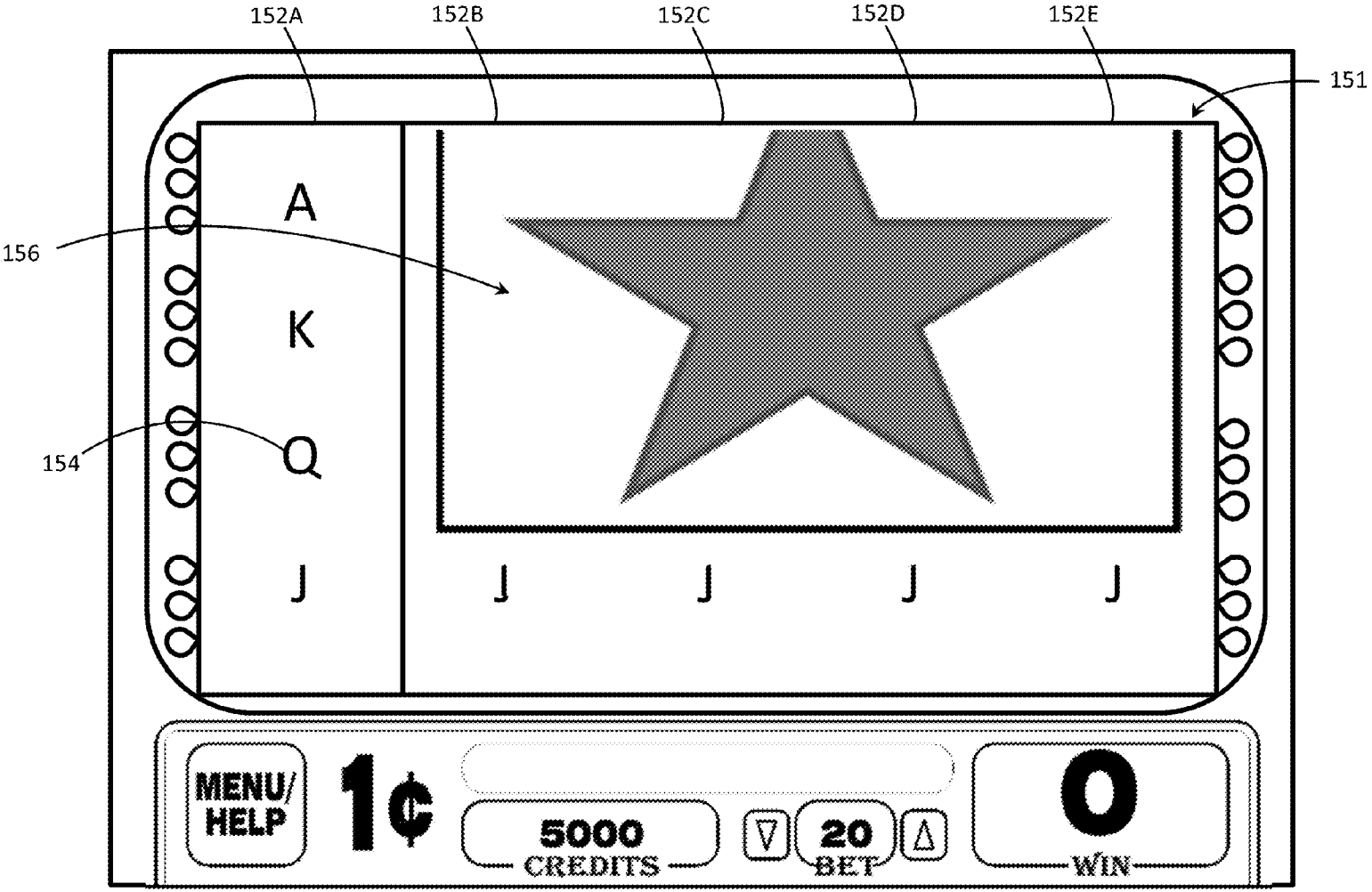
Figure 15F:
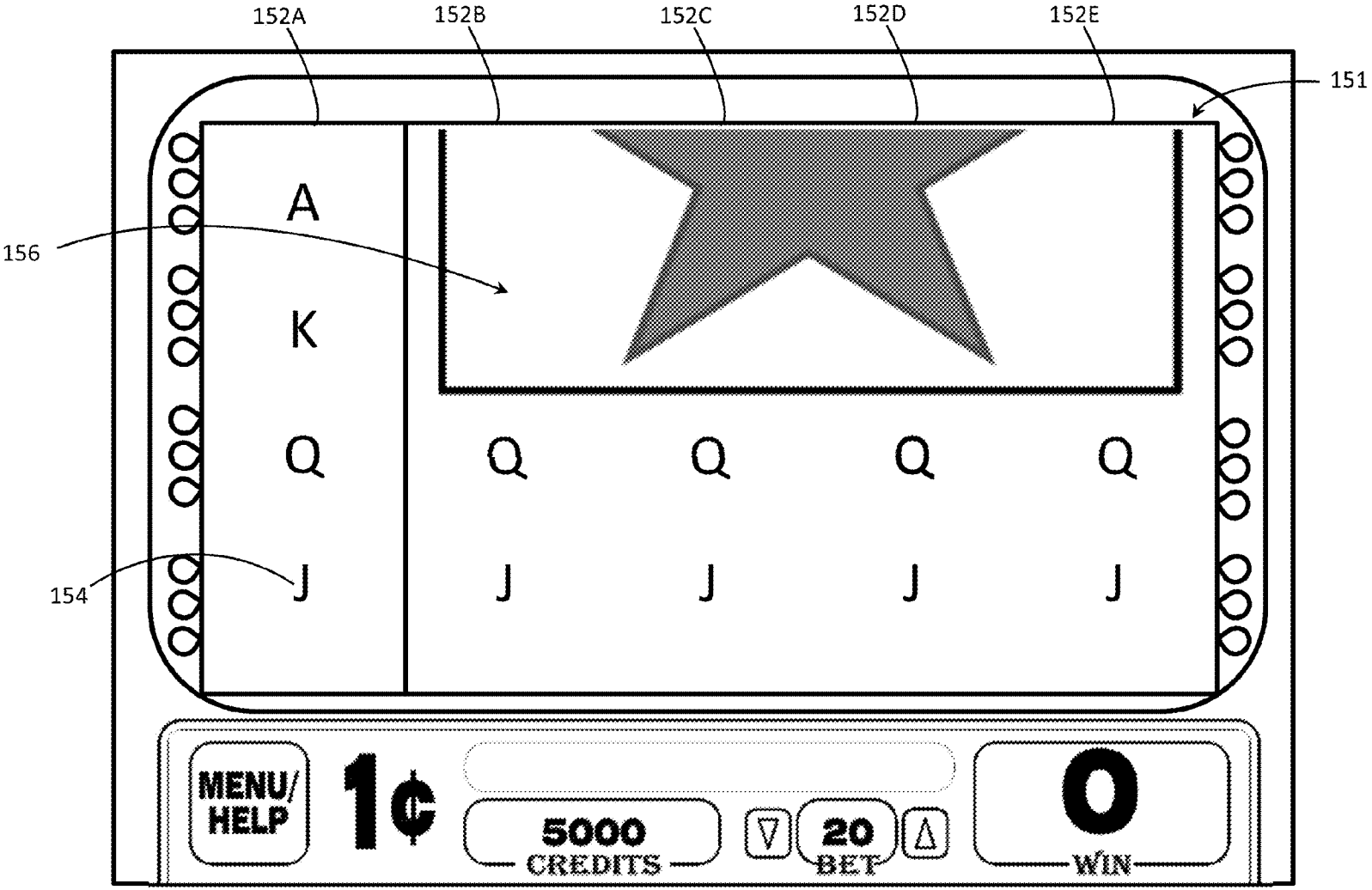
Figure 15G:
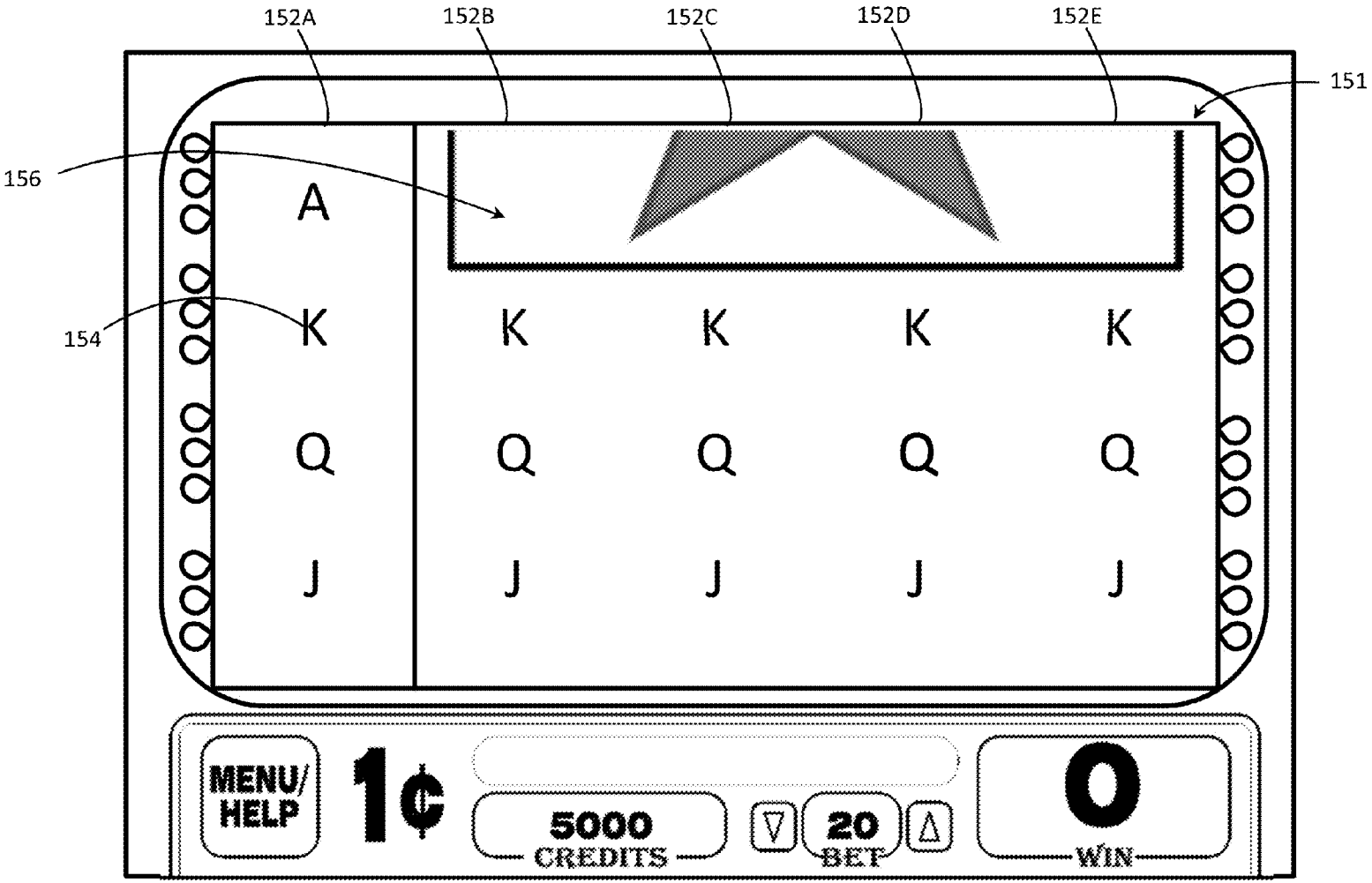

According to additional and/or alternative aspects of the present disclosure, the functionality of the mega symbol 156 can be based on the portion of the mega symbol 156 displayed on the array 151. For example, FIGS. 15A-15G illustrate outcomes of a wagering game including different portions of a four-by-four sized mega symbol 156 displayed within the array 151. FIG. 15A illustrates a top quarter portion of the mega symbol 156 displayed within the array 151, FIG. 15B illustrates a top half portion of the mega symbol 156 displayed within the array 151, FIG. 15C illustrates a top three quarters portion of the mega symbol 156 displayed within the array 151, FIG. 15D illustrates the entire mega symbol 156 displayed within the array 151, FIG. 15E illustrates a bottom three quarters portion of the mega symbol 156 displayed within the array 151, FIG. 15F illustrates a bottom half portion of the mega symbol 156 displayed within the array 151, and FIG. 15G illustrates a bottom quarter portion of the mega symbol 156 displayed within the array 151.

In some implementations, the mega symbol 156 can be provided with a different functionality for each outcome illustrated in FIGS. 15A-15G as a different portion of the mega symbol 156 is displayed within the array 151 for the outcomes illustrated in FIGS. 15A-15G. That is, the functionalities associated with the different portions of the mega symbol 156 can all be different from one another. According to other implementations, one or more but not all of the functionalities associated with the different portions of the mega symbol 156 can be the same (e.g., the functionality of the mega symbol 156 displayed in FIG. 15A can be the same as the functionality of the mega symbol 156 displayed in FIG. 15B but different from the functionalities of the mega symbols 156 displayed in FIGS. 15C-15G). As described above, the different functionalities associated with the different portions of the mega symbol(s) 156 displayed within the array 151 can provide different types of functionalities and/or different magnitudes of functionalities.

According to some aspects of the present disclosure, the size of a mega symbol 156 can remain the same (or fixed) for all plays of a wagering game. According to additional and/or alternative aspects of the present disclosure, the size of a mega symbol 156 can vary from one spin to the next and/or from one series of spins to the next.

Figure 16A:
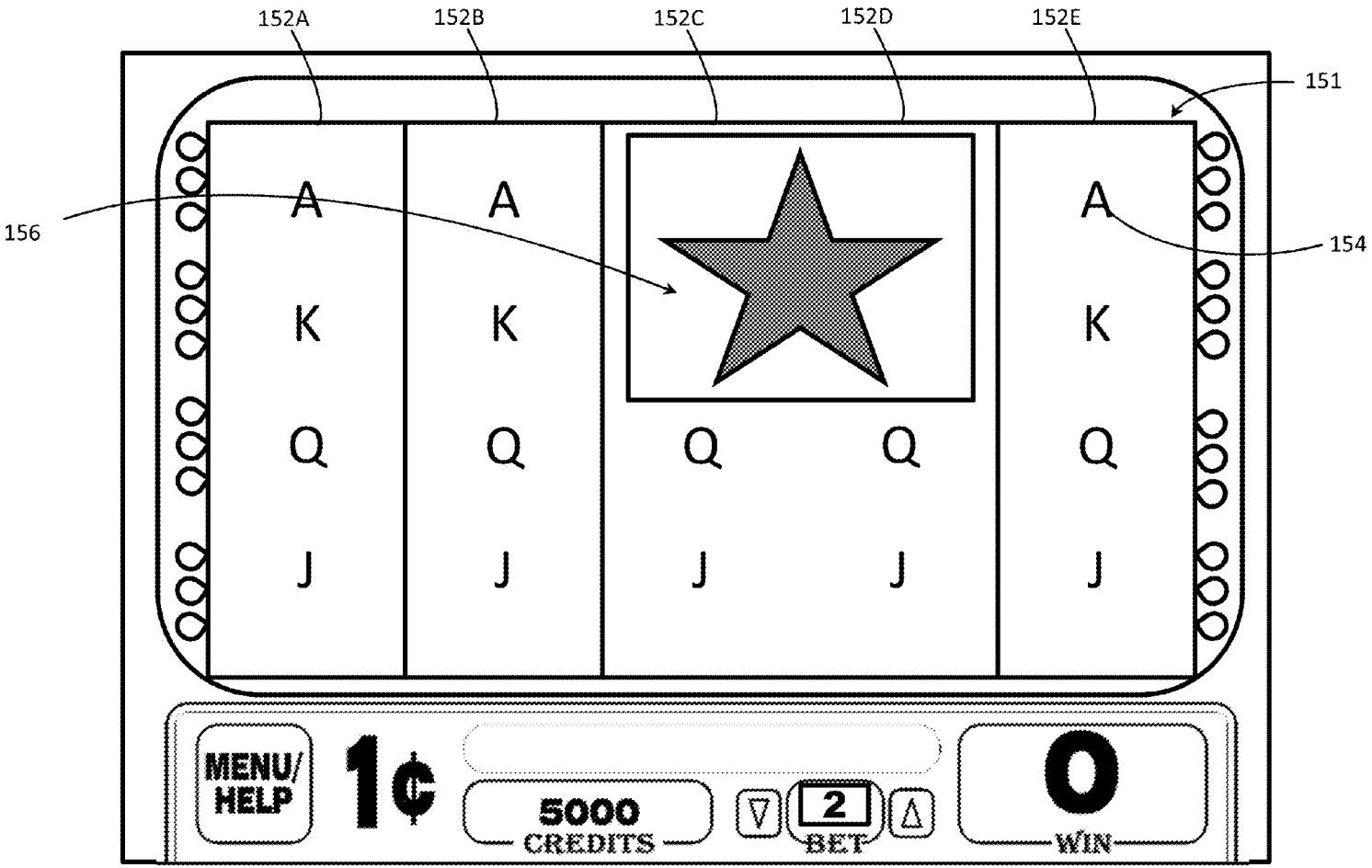
FIGS. 16A-16C are images of exemplary game screens of a wagering game displayed on a gaming terminal, according to an embodiment of the present invention.
Figure 16B:
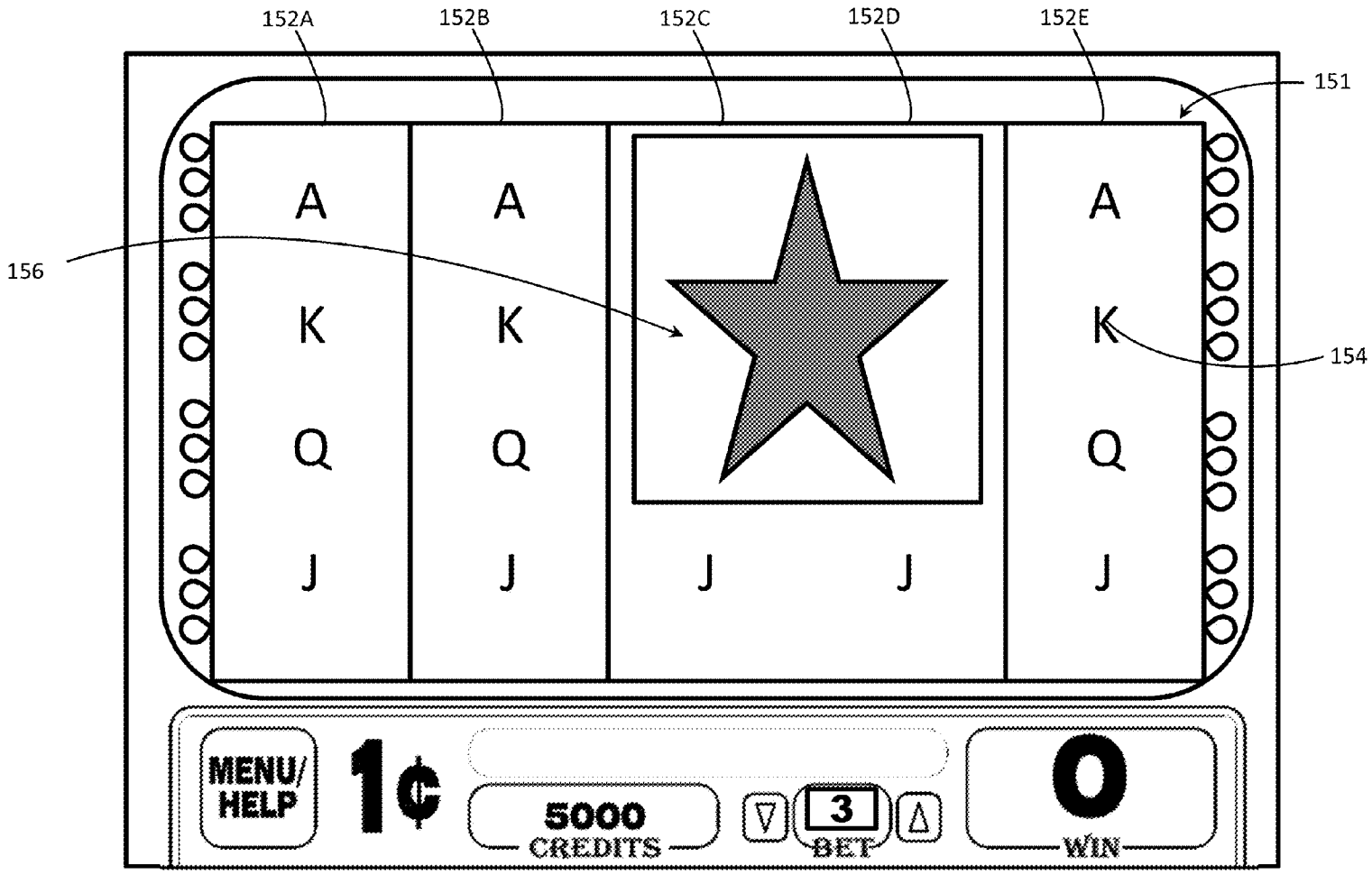
Figure 16C:
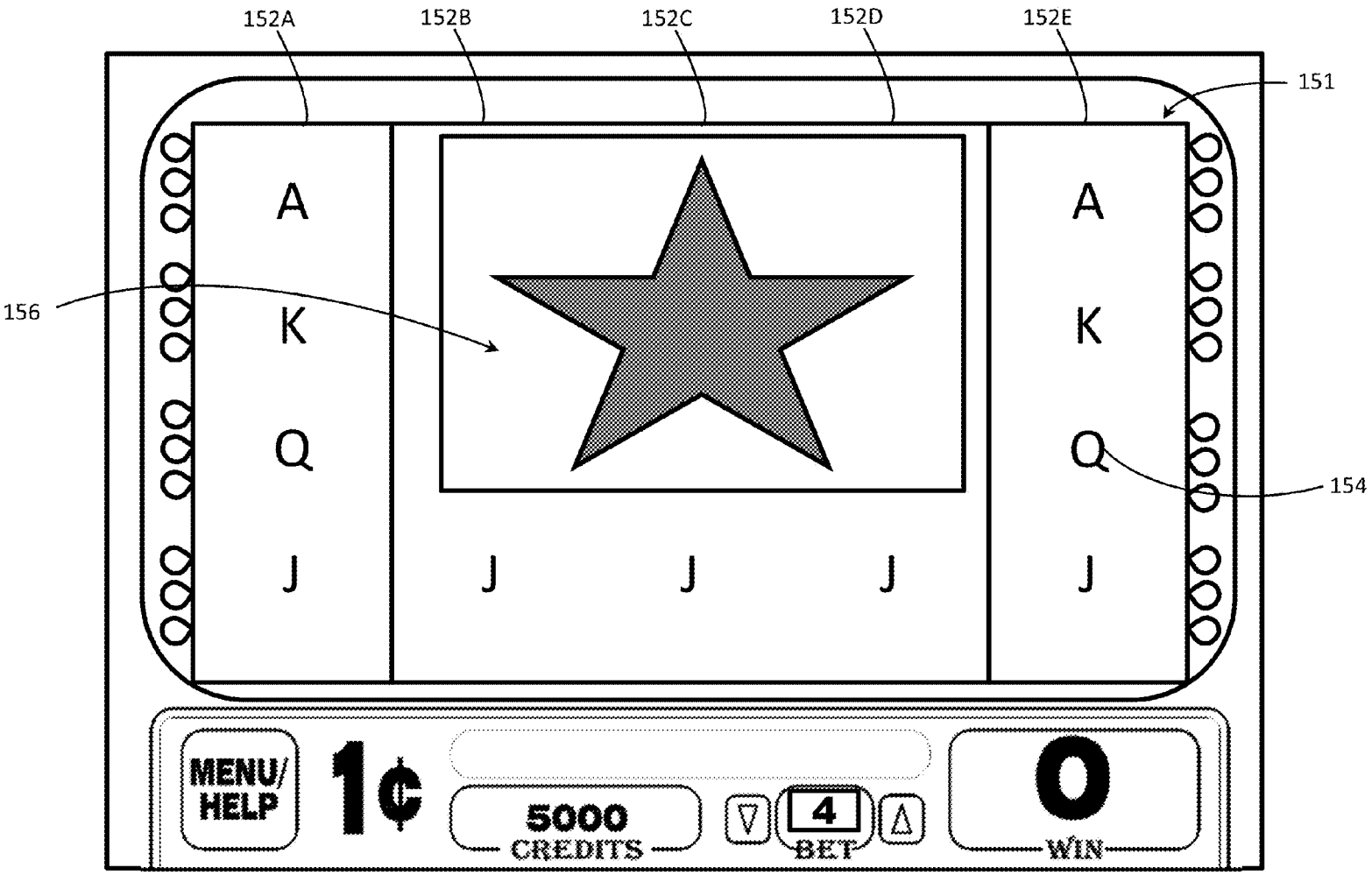

For example, the size of the mega symbol 156 can be randomly determined prior to, during, and/or after a play of the wagering game. As another example, the size of a mega symbol 156 can be based on a wager amount for a single play and/or a turnover amount over a plurality of plays of a wagering game. In one exemplary implementation, a mega symbol 156 can have a size of two-by-two for a wager of two credits as shown in FIG. 16A, a size of two-by-three for a wager of three credits as shown in FIG. 16B, and a size of three-by-three for a wager of four credits as shown in FIG. 16C.

Figure 17A:
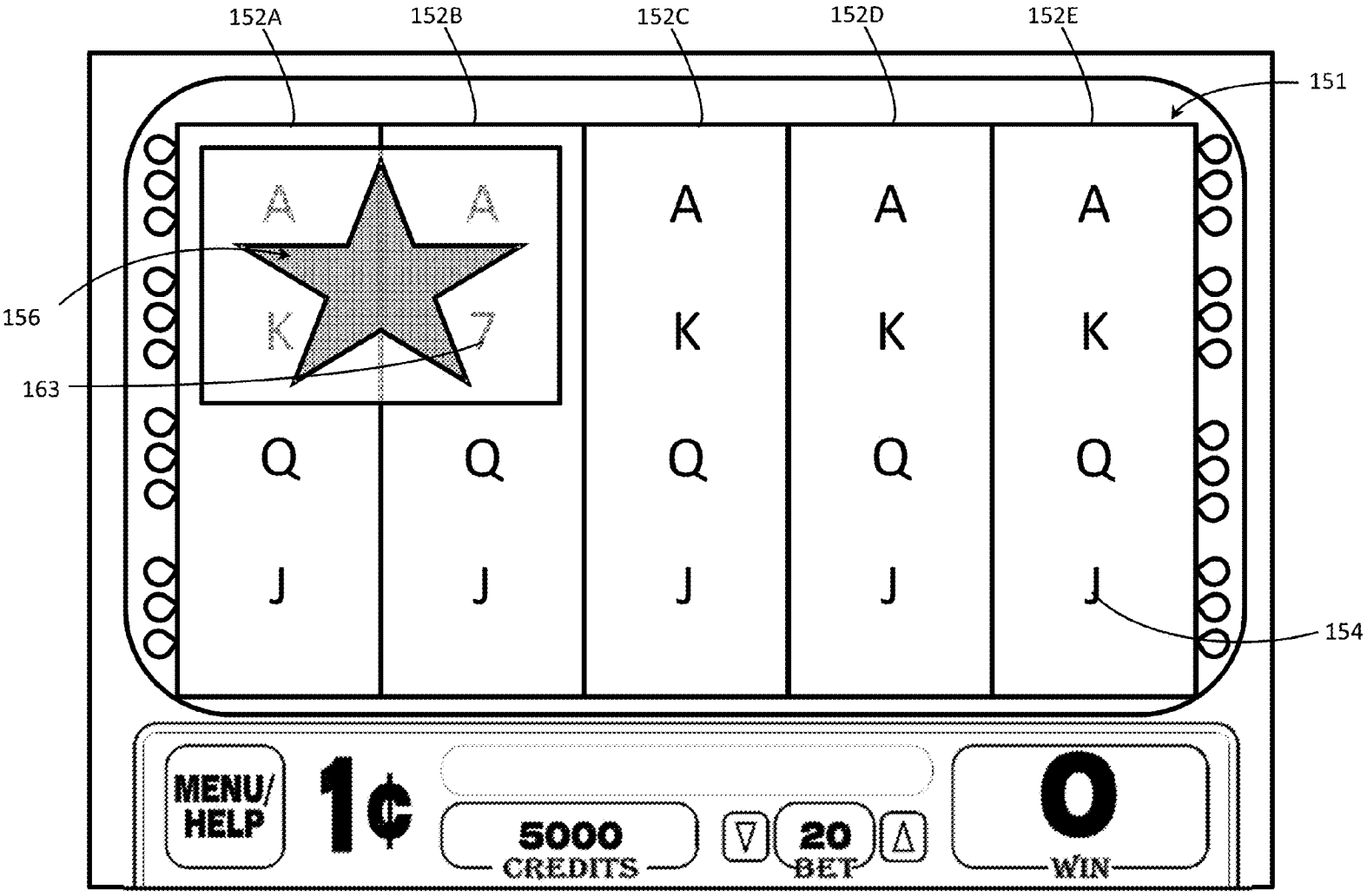
FIGS. 17A-17B are images of exemplary game screens of a wagering game displayed on a gaming terminal, according to an embodiment of the present invention.
Figure 17B:
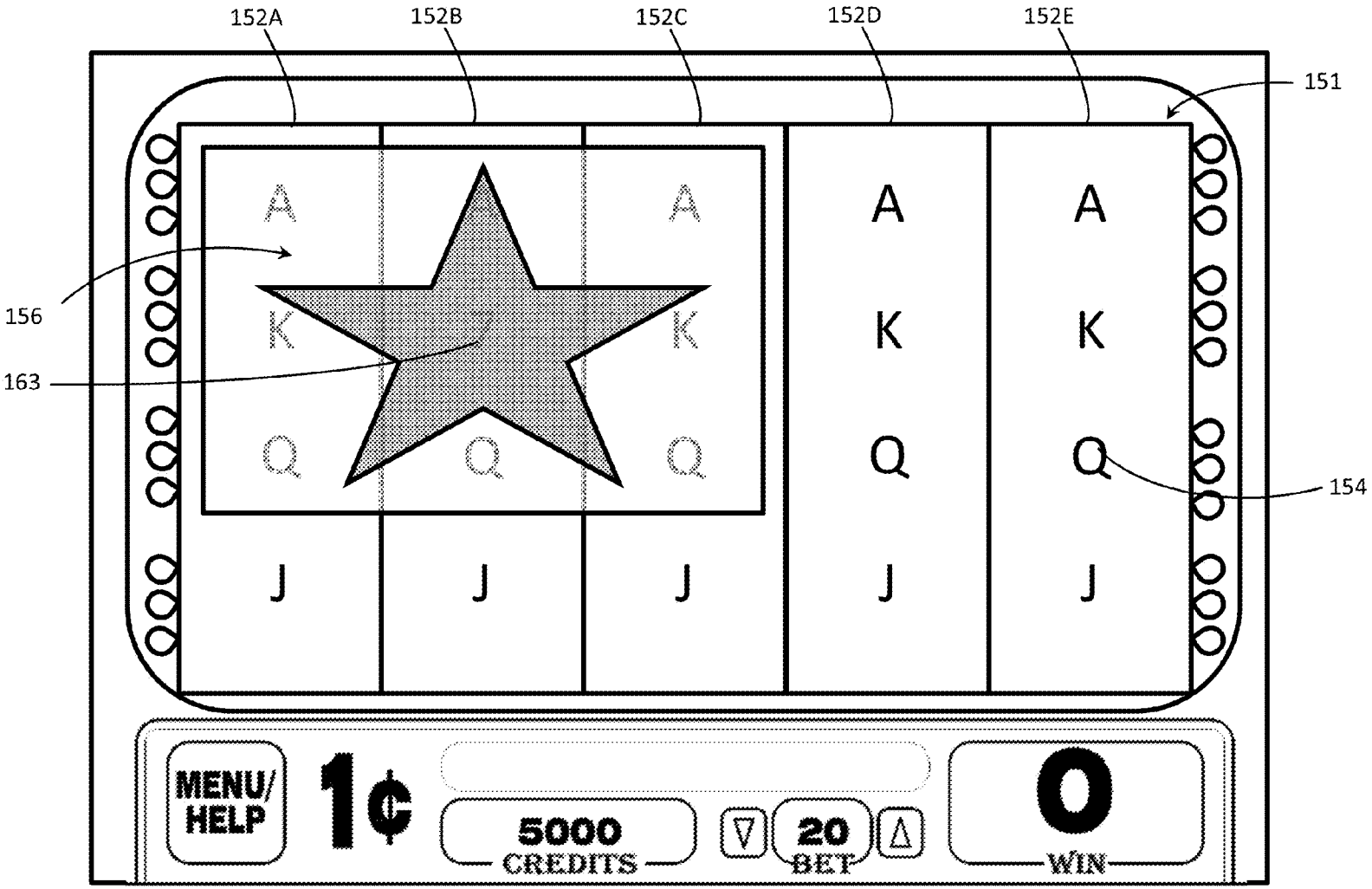

As a further example, the size of the mega symbol 156 can be based on one or more of the symbols 154 displayed in an array 151 for a prior spin or the current spin of the wagering game. In some implementations, the mega symbol 156 can increase in size when an outcome of a current spin and/or a prior spin of the wagering game includes a predetermined symbol (i.e., a "mega-enlarging symbol" 163). As a non-limiting example, FIG. 17A illustrates an outcome in which the plurality of symbols 154 include a "seven" symbol 163, which can be a mega-enlarging symbol configured to cause the mega symbol 156 to increase in size before the symbols 154, 156 of the array 151 are evaluated for the current play of the wagering game. FIG. 17B illustrate the outcome of FIG. 17A after the mega symbol 156 has increased in size in response to the "seven" symbol 163. The symbols 154, 156 of the array 151 for the play of the wagering game illustrated in FIG. 17A can be evaluated after the mega symbol 156 has increased in size as illustrated in FIG. 17B. Advantageously, if the mega symbol 156 is associated with a functionality, more of the symbols 154 can be eligible to be evaluated with the functionality due to the mega symbol 156 overlapping with more of the symbols 154 after the size of the mega symbol 156 is increased.

Figure 18A:
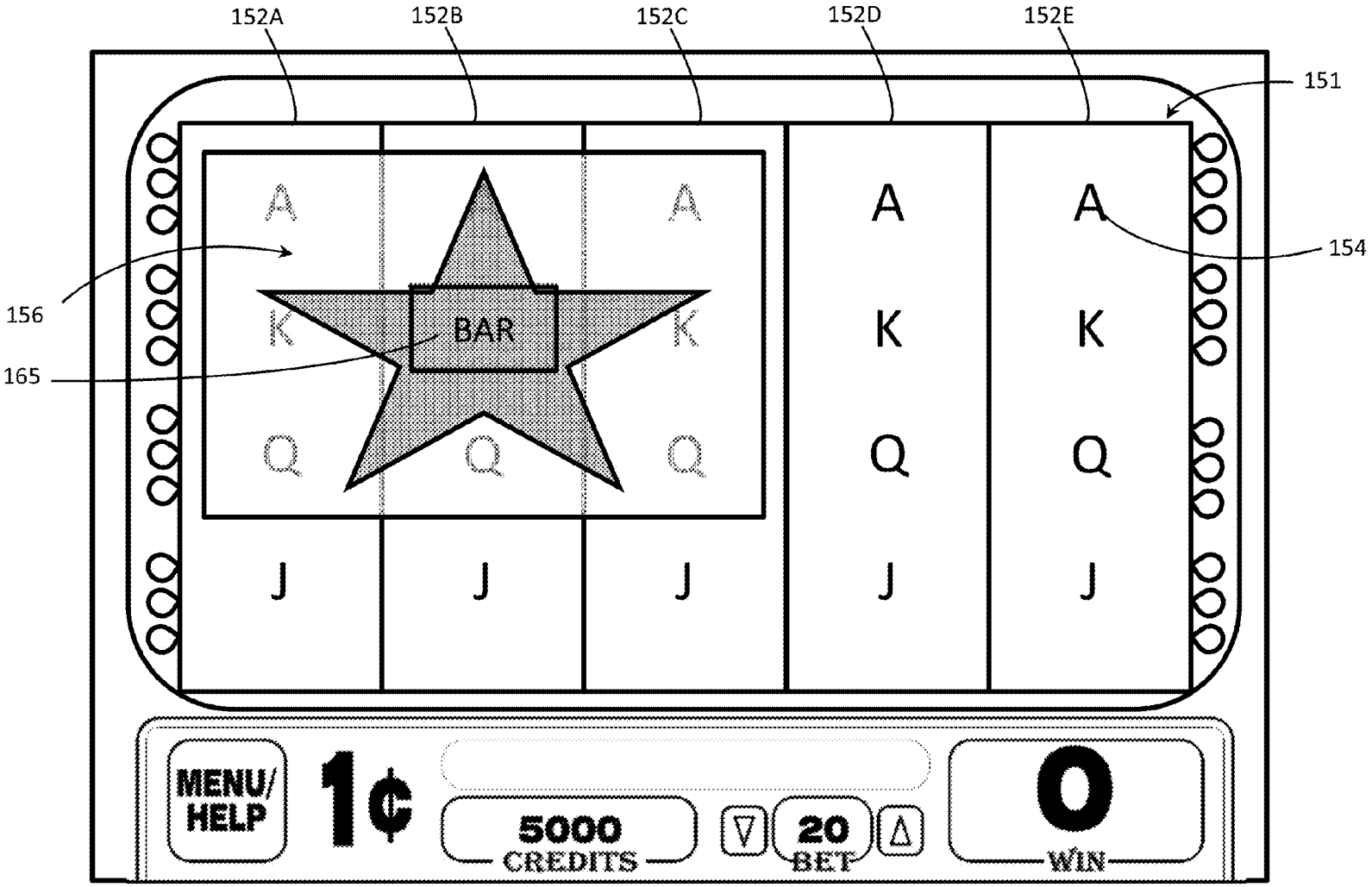
FIGS. 18A-18B are images of exemplary game screens of a wagering game displayed on a gaming terminal, according to an embodiment of the present invention.
Figure 18B:
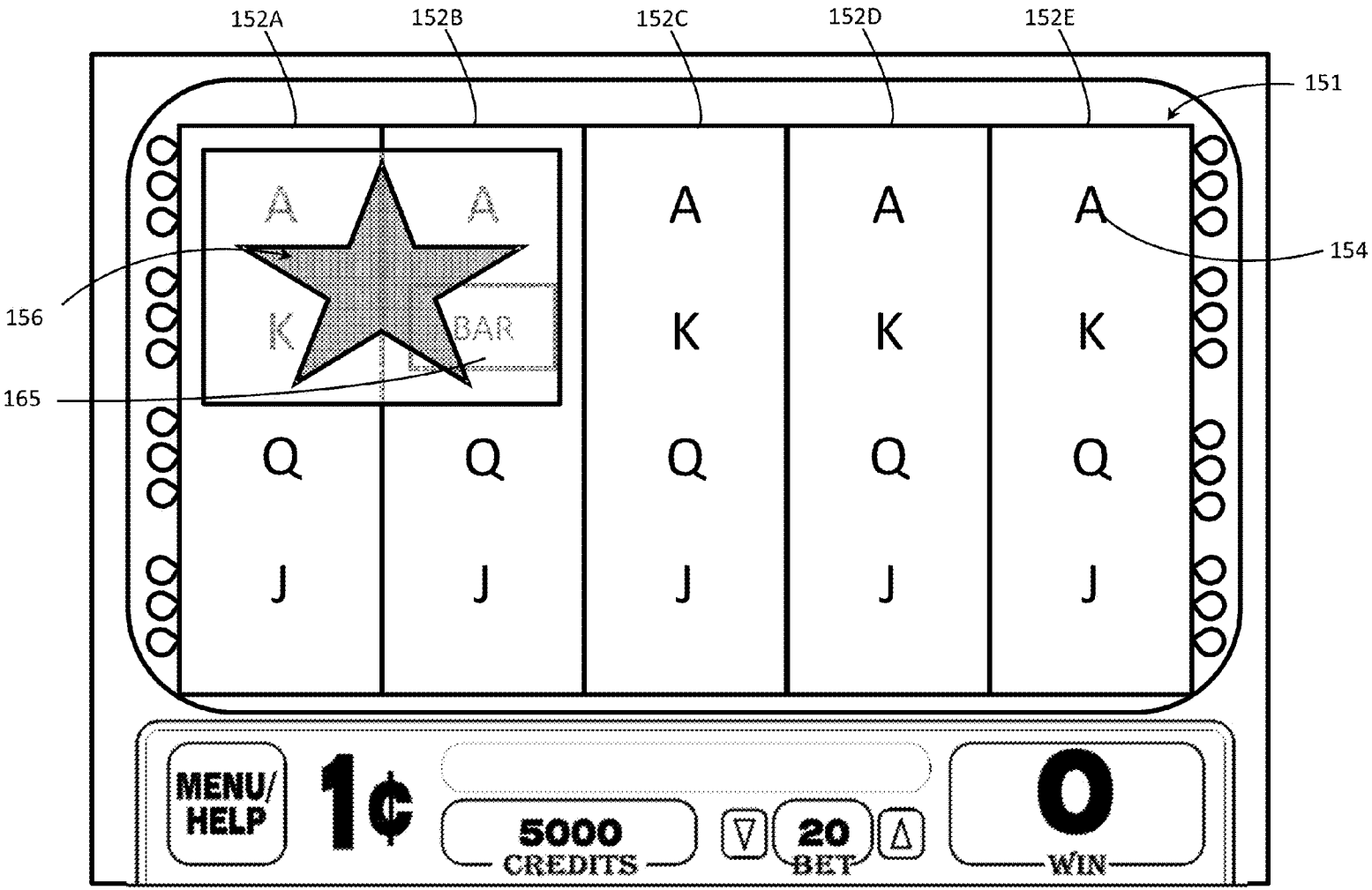

In additional and/or alternative implementations, the mega symbol 156 can decrease in size when an outcome of a current spin and/or a prior spin of the wagering game includes a predetermined symbol (i.e., a "mega-shrinking symbol"). As a non-limiting example, FIG. 18A illustrates an outcome in which the plurality of symbols 154 include a "BAR" symbol 165, which can be a mega-shrinking symbol configured to cause the mega symbol 156 to decrease in size before the symbols 154, 156 of the array 151 are evaluated for the current play of the wagering game. FIG. 18B illustrates the outcome of FIG. 18A after the mega symbol 156 has decreased in size in response to the "BAR" symbol 165. The symbols 154, 156 of the array 151 for the play of the wagering game illustrated in FIG. 18A can be evaluated after the mega symbol 156 has decreased in size as illustrated in FIG. 18B.

Figure 19A:
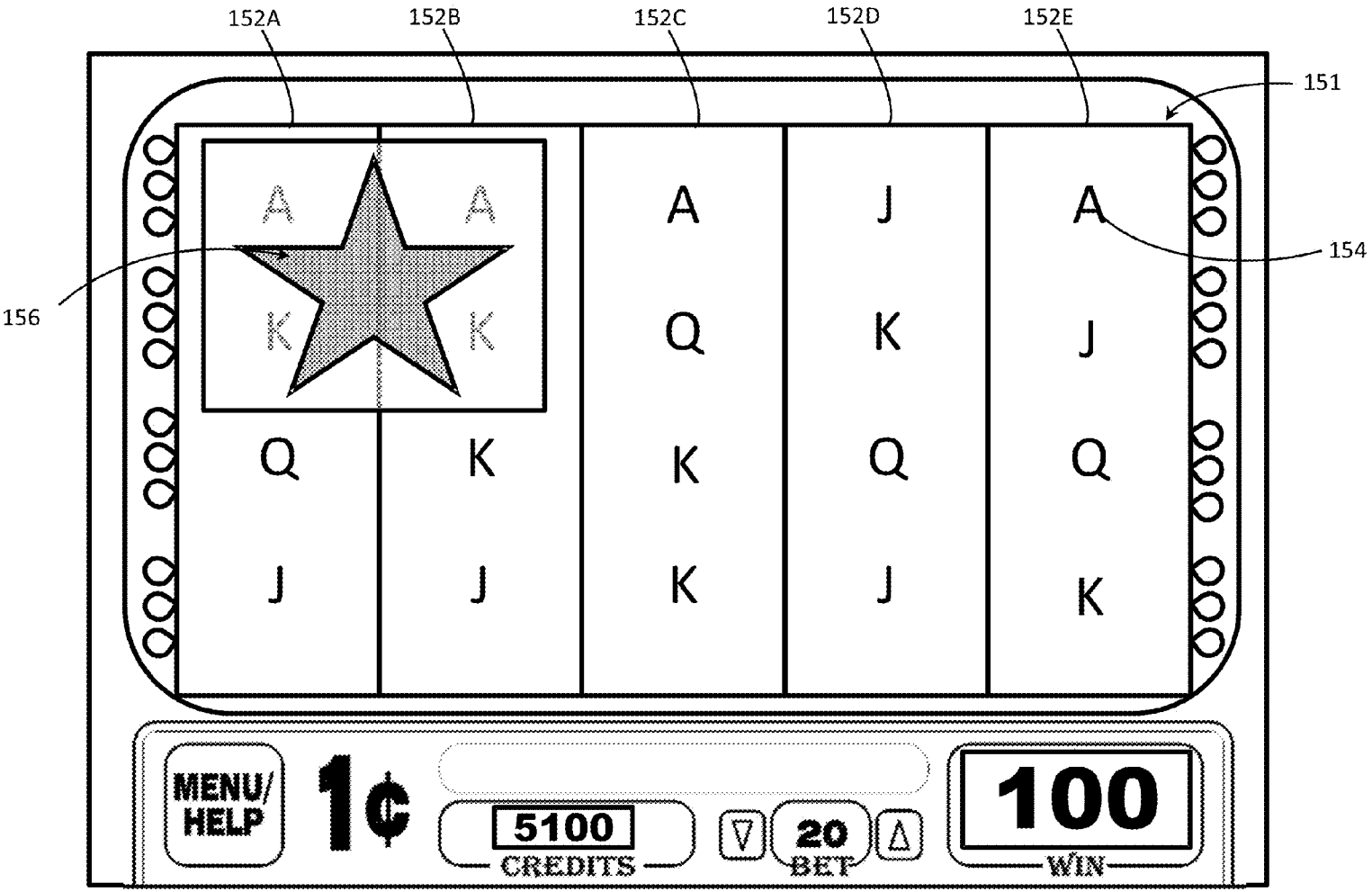
FIGS. 19A-19F are images of exemplary game screens of a wagering game displayed on a gaming terminal, according to an embodiment of the present invention.
Figure 19B:
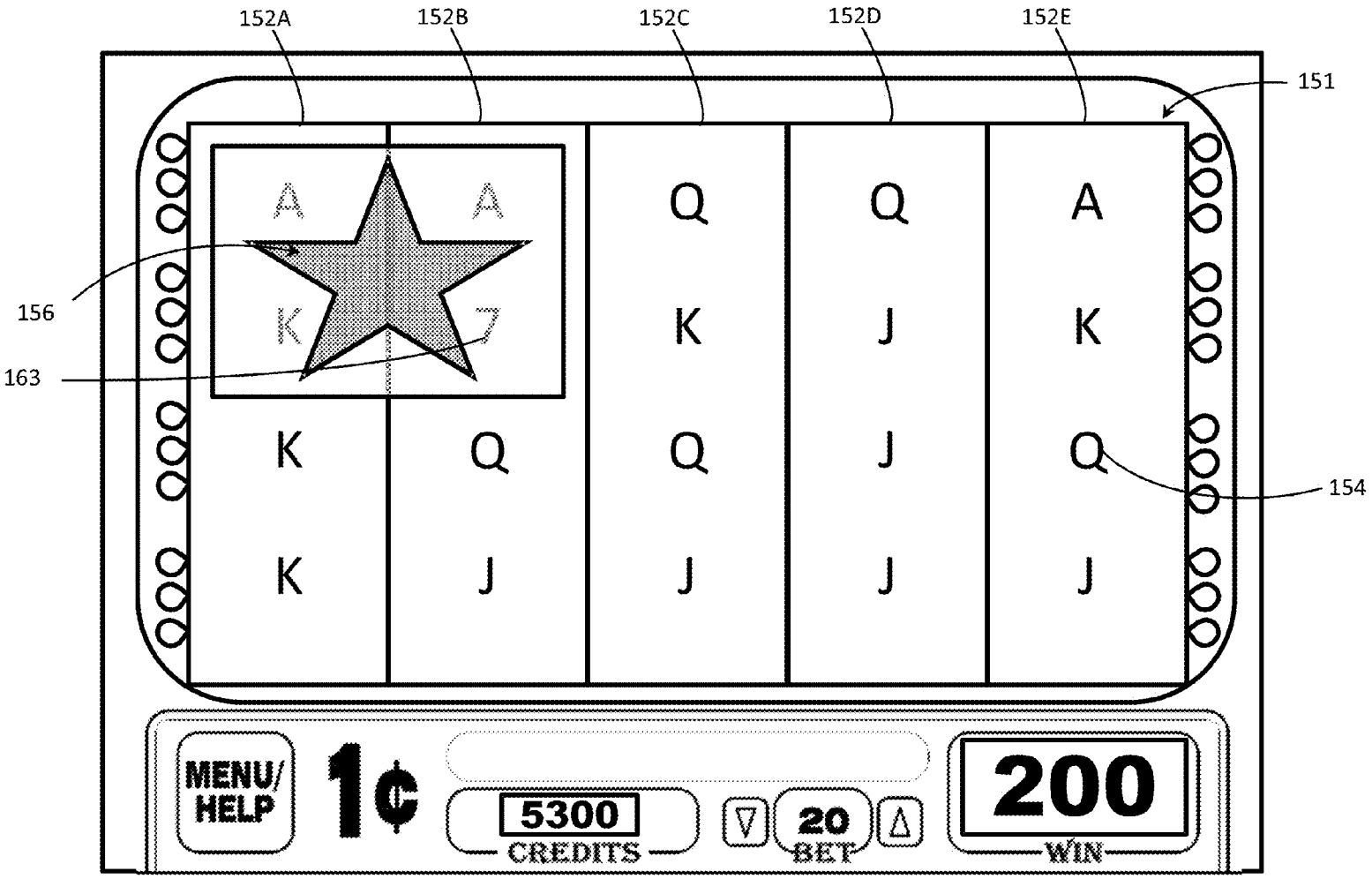
Figure 19C:
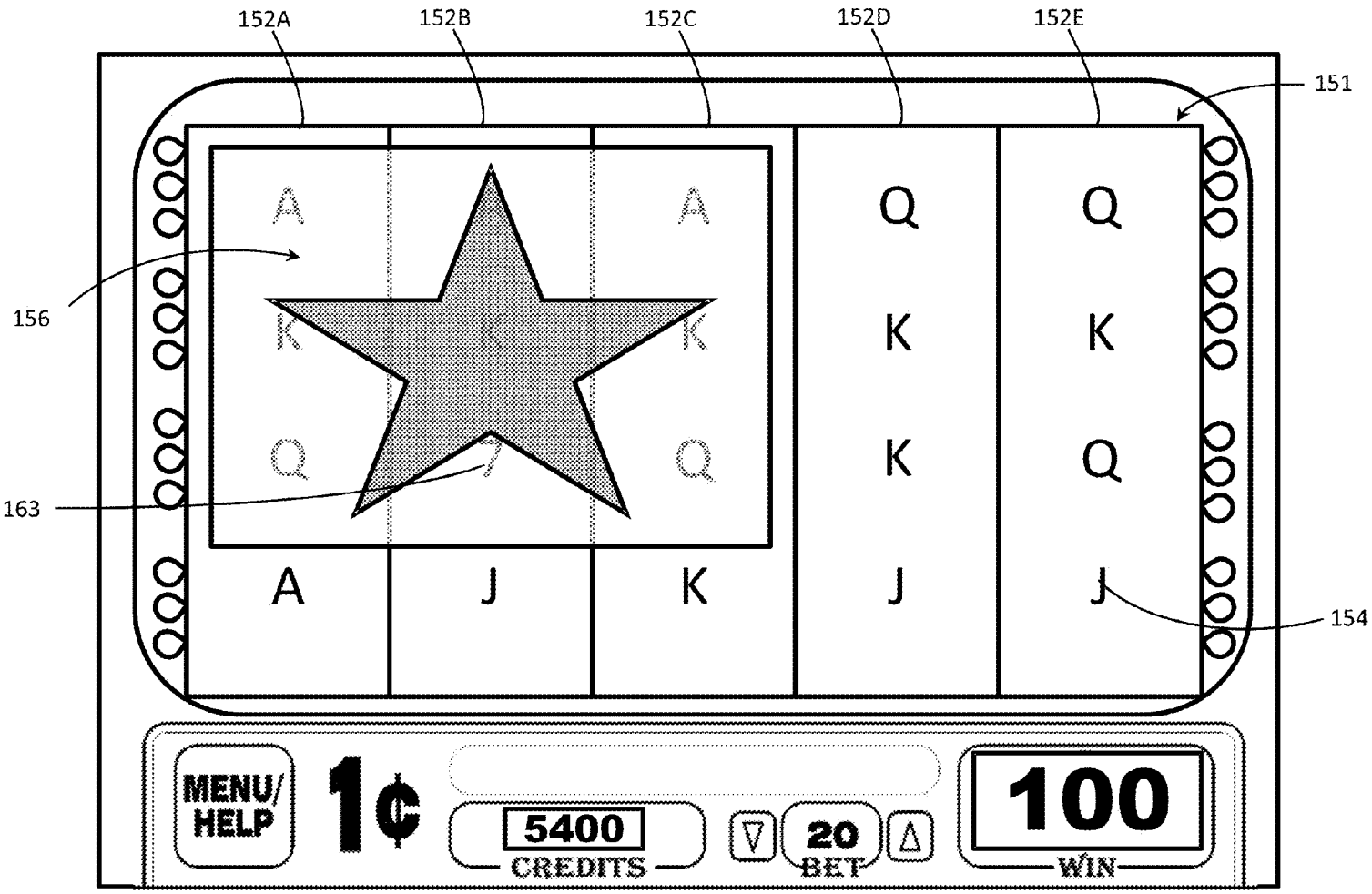
Figure 19D:
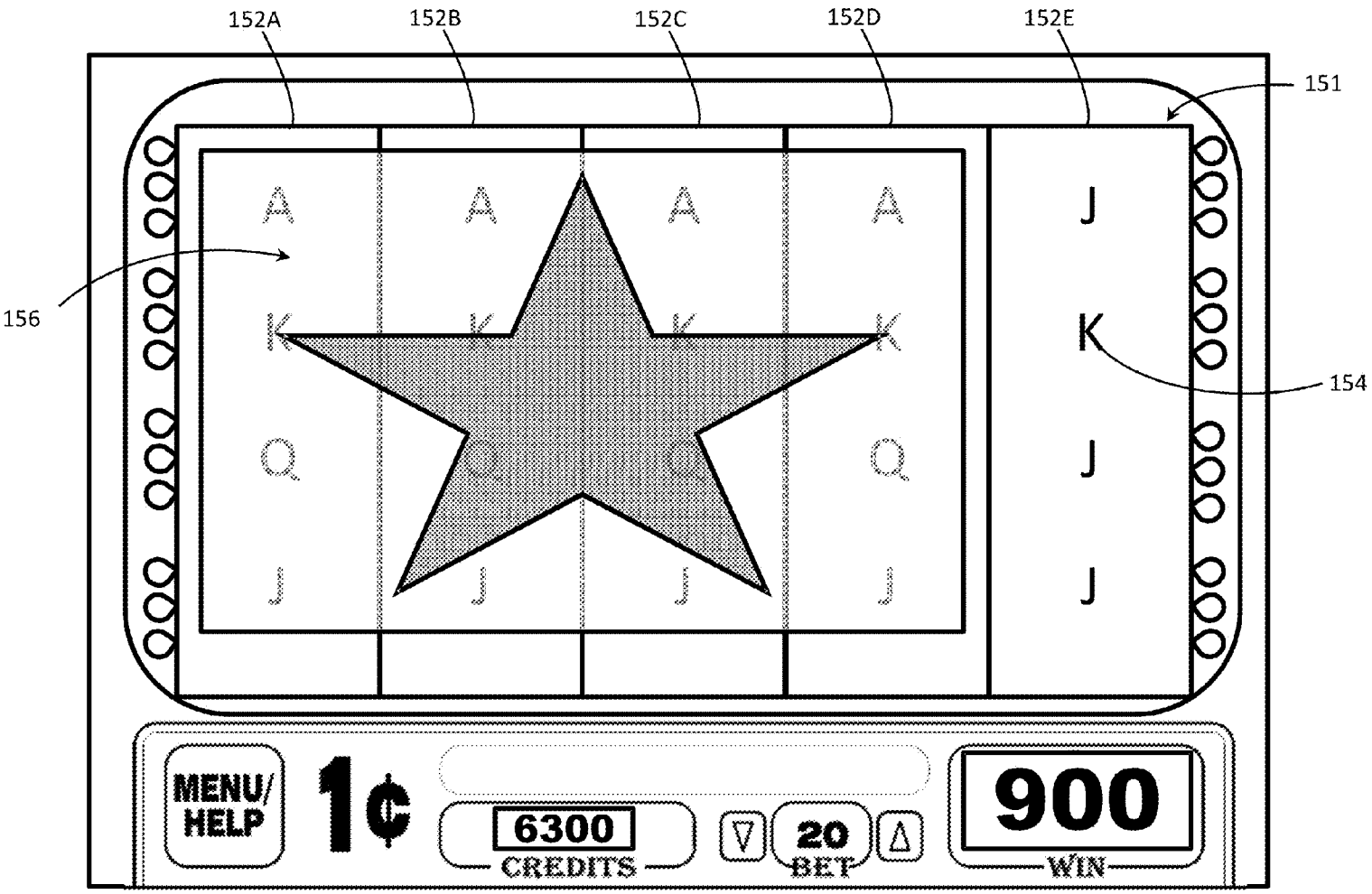

While FIGS. 17A-18B illustrated non-limiting examples of a mega symbol 156 increasing and decreasing in size in response to one or more predetermined symbols in a current spin, FIGS. 19A-19F illustrate a non-limiting example of a mega symbol 156 increasing and decreasing based on one or more predetermined symbols 163, 165 in a prior spin(s). In FIG. 19A, an outcome for a first play of a wagering game includes a two-by-two sized mega symbol 156. In FIG. 19A, the outcome for the first play includes no mega-enlarging symbol(s) 163 or mega-shrinking symbol(s) 165. Thus, in the next play, the mega symbol 156 can have the same two-by-two size. FIG. 19B shows an outcome for a second play of the wagering game after the first play of the wagering game shown in FIG. 19A. In FIG. 19B, the outcome includes the mega symbol 156 and a mega-enlarging symbol 163 (i.e., the "seven" symbol). In response to the second outcome including the mega-enlarging symbol 163, the mega symbol 156 can increase in size for next play of the wagering game. FIG. 19C illustrates an outcome for a third play of the wagering game after the second play shown in FIG. 19B. As shown in FIG. 19C, the mega symbol 156 now has a three-by-three size due to the mega-enlarging symbol 163 in the outcome of the second play. The outcome for the third play of the wagering game also includes the mega-enlarging symbol 163 and, thus, the size of the mega symbol 156 can again be increased for the next play. FIG. 19D illustrates an outcome for a fourth play of the wagering game after the third play shown in FIG. 19C. As shown in FIG. 19D, the mega symbol 156 now has a four-by-four size due to the mega-enlarging symbol 163 in the outcome of the third play. The outcome of the fourth play does not include a mega-enlarging symbol 163 or a mega-shrinking symbol 165 and, thus, the mega symbol 156 can again have a four-by-four size for the next play of the wagering game.

Figure 19E:
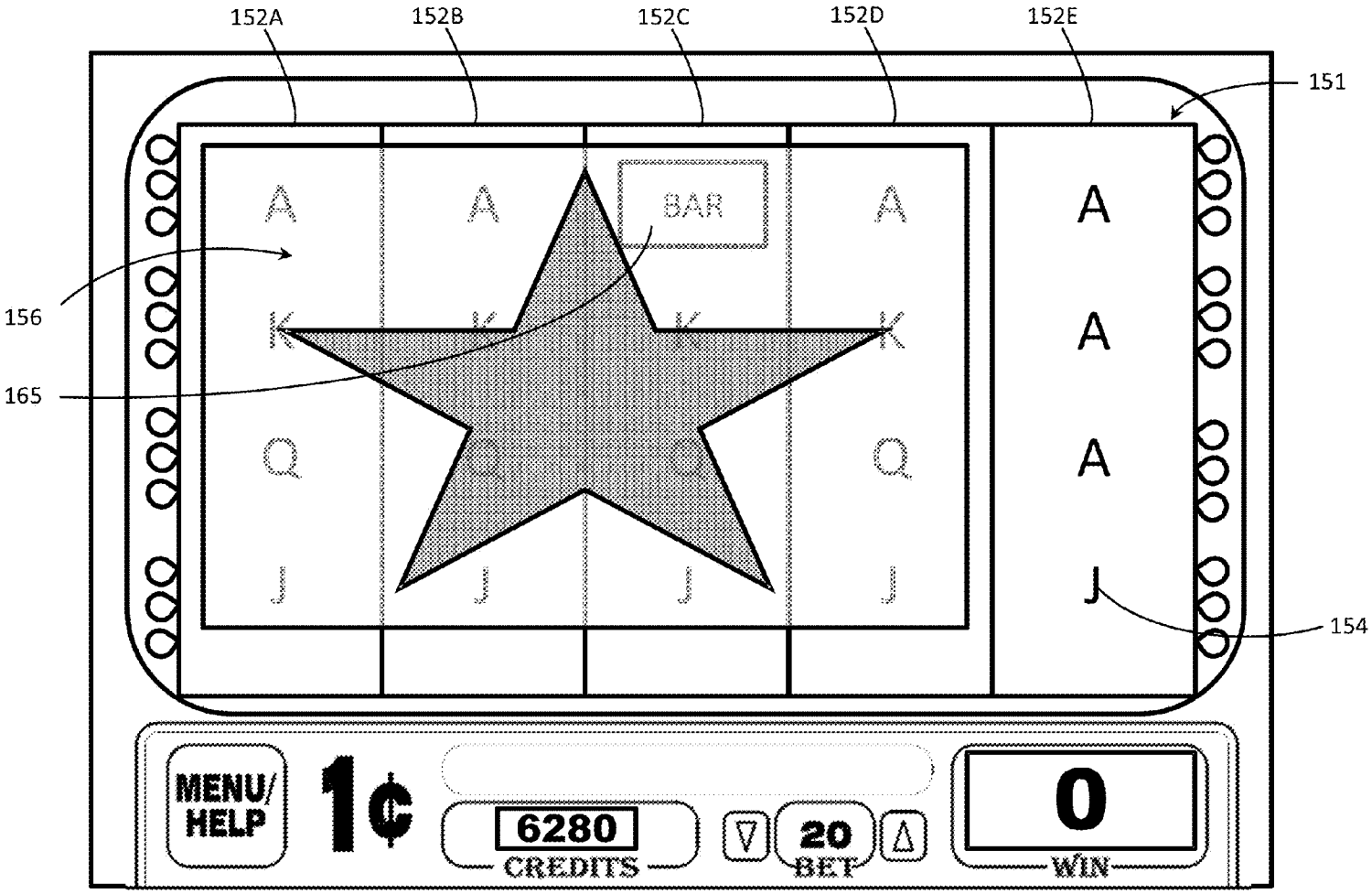
Figure 19F:
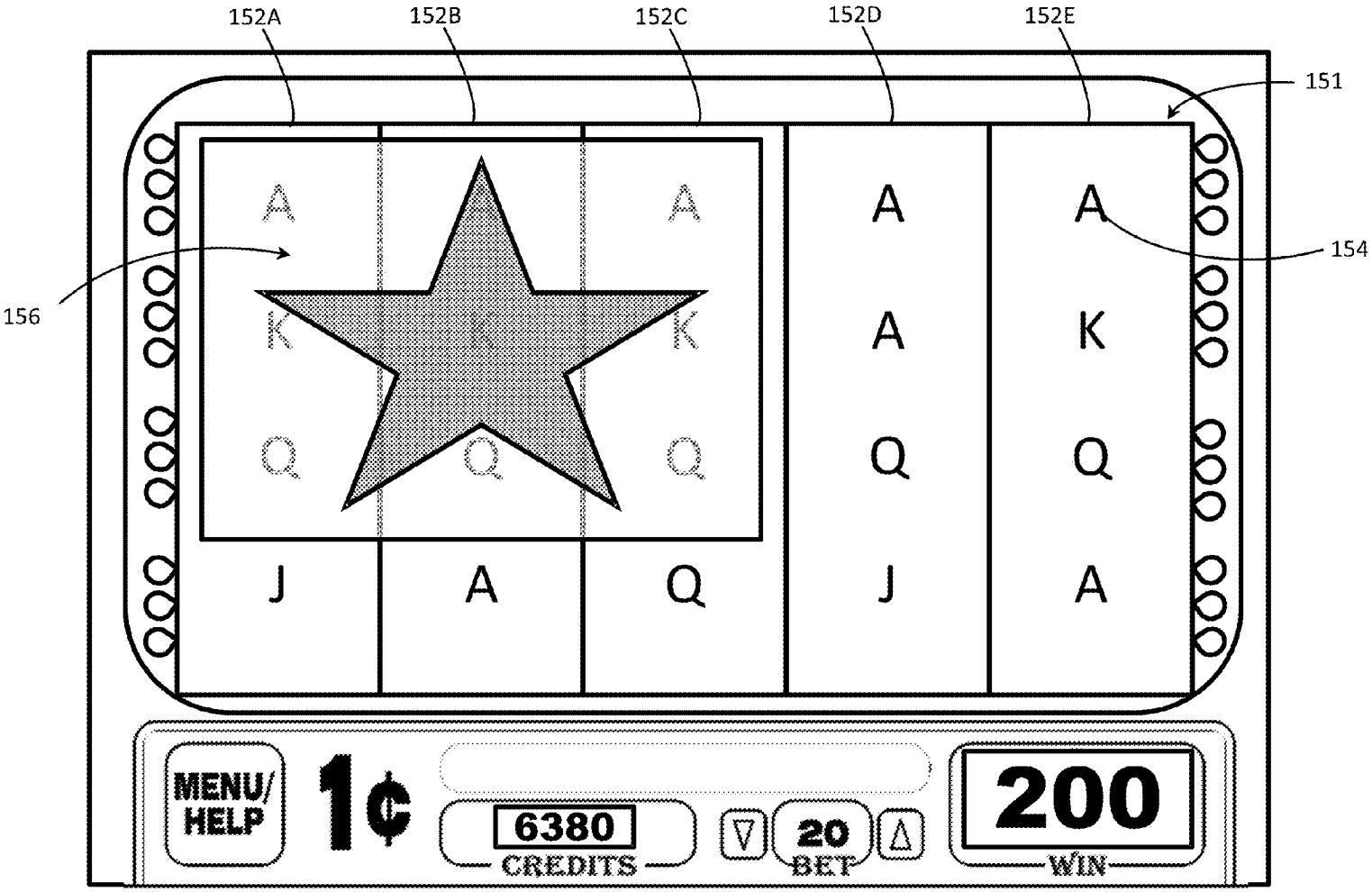

FIG. 19E illustrates an outcome for a fifth play of the wagering game after the fourth play shown in FIG. 19D. The mega symbol 156 still has a size of four-by-four due to the occurrence of the mega-enlarging symbols 163 in outcomes of the prior plays of the wagering game. The outcome of the fifth play includes a mega-shrinking symbol 165 (i.e., the "BAR" symbol) and, thus, the size of the mega symbol 156 can be decreased for the next play. FIG. 19F illustrates an outcome for a sixth play of the wagering game after the fifth play shown in FIG. 19E. As shown in FIG. 19F, the mega symbol 156 now has a three-by-three size due to the mega-shrinking symbol 165 in the outcome of the fifth play.

In some instances, the predetermined symbol(s) (i.e., the mega-enlarging symbol 163 and/or the mega-shrinking symbol 165) can cause the size of the mega symbol 156 to change if the predetermined symbol(s) appear anywhere in the array 151. In other instances, the predetermined symbol(s) can cause the size of the mega symbol 156 to change only if the predetermined symbol(s) overlaps with the mega symbol 156. Although the examples illustrated in FIGS. 17A-19F included a single predetermined symbol 163, 165 as a trigger for causing the size of the mega symbol 156 to change, it is contemplated that any other scatter symbol and/or combination of symbols 154 can, additionally and/or alternatively, be utilized to cause a change in the size of the mega symbol 156. It is also contemplated that if multiple different predetermined symbols cause a change in size of the mega symbol 156, the different predetermined symbols can cause different magnitudes change to the size of the mega symbol 156.

It is contemplated that, according to some aspects, if an outcome includes multiple mega-enlarging symbols 163 and/or mega-shrinking symbols 165, the size of the mega symbol 156 can be proportionally changed according to the number of mega-enlarging symbols 163 and/or mega-shrinking symbols 165. For example, if an outcome included two mega-enlarging symbols 163, the mega symbol 156 can be enlarged by twice as much as if one mega-enlarging symbol 163 had been included in the outcome. According to alternative aspects, if an outcome includes multiple mega-enlarging symbols 163 and/or mega shrinking symbols 165, the size of the mega symbol 156 can be incrementally adjusted once for each mega-enlarging symbol 163 and/or mega-shrinking symbol 165. For example, if an outcome included two mega-enlarging symbols 163, the size of the mega symbol 156 can be enlarged by two increments (e.g., the change in size that would occur if a mega-enlarging symbol 163 were received in consecutive spins).

As still another example, the mega symbol 156 can change in size based on a period of time and/or a number of spins. In one exemplary implementation, the mega symbol 156 can decrease in size over a period of time and/or a number of spins. The period of time and/or the number of spins can be predetermined, random, and/or based on an outcome of a wagering game. In this way, the mega symbol 156 can decay over a plurality of plays or a period of time.

According to some aspects of the present disclosure, the size of the array 151 can be based on a wager amount for a single play of a wagering game and/or a turnover amount over a plurality of plays of the wagering game (or a period of time). As the size of the array 151 increases, the likelihood of achieving a greater portion or the entirety of a mega symbol 156 displayed within the array 151 increases, thus encouraging the player to wager greater amounts. The player may be particularly incentivized to increase the wager amount for embodiments in which the functionality of the mega symbol 156 is provided only when the entire mega symbol 156 is displayed within the array 151.

As one-non limiting example, a five-by-three array 151 can be provided for a wager of two credits, a five-by-four array 151 can be provided for a wager of three credits, and a five-by five array 151 can be provided for a wager of five credits. According to other examples, the size of the array 151 can range from three-by-three to eight-by-twenty based on a wager amount and/or a turnover amount.

In the various aspects of the present disclosure described above, the illustrated exemplary wagering game outcomes generally include one mega symbol 156 (or a portion thereof) displayed in the array 151; however, it should be understood that a plurality of mega symbols 156 (or portions thereof) can be displayed in an array 151 in accordance with the aspects of the of the present disclosure described above. That is, according to some aspects of the present disclosure, an outcome of a wagering game can include more than one mega symbol 156.

The mega symbols 156 can each be of the same type of symbol (e.g., three different mega symbols 156 can each be "star" symbols) and/or a different type of symbols (e.g., a first mega symbol 156 can be a "star" symbol and a second mega symbol 156 can be a "cherry" symbol). The plurality of mega symbols 156 can each have the same size and/or different sizes, which can be determined as described above (e.g., the size of each mega symbol 156 can be fixed, randomly determined, based on the symbol(s) displayed in the array 151, based on a wager amount, based on a turnover amount, etc.).

The plurality of mega symbols 156 each can be indexed to the same or different reel(s) and/or special reel(s) (e.g., the reels 152A-152E described and illustrated above for FIGS. 4A-6 and/or the special reel 153 described and illustrated above for FIG. 6). It is contemplated that, according to some aspects, the reel(s) 152A-152E and/or the special reel(s) 153 to which the mega symbols 156 are indexed do not change from one spin to the next and/or one series of spins to the next. According to alternative aspects, the reel(s) 152A-152E and/or the special reel(s) 153 to which the mega symbols 156 are indexed can change from one spin to the next and/or from one series of spins to the next.

The plurality of mega symbols 156 can be similarly and/or differently evaluated with respect to a pay table as a single symbol (e.g., as described and illustrated with respect to FIG. 8A), a plurality of symbols (e.g., as described and illustrated with respect to FIG. 8B) and/or in connection with the symbol(s) 154 overlapping with the mega symbols (e.g., as described and illustrated with respect to FIGS. 9A-9B) as described above.

The plurality of mega symbols 156 can each be associated with the same functionality (or the same subset of potential functionalities) and/or different functionalities (or different subsets of potential functionalities), which can be determined as described above (e.g., the functionality of each of the mega symbols 156 can be fixed, randomly determined, based on a wager amount, based on a turnover amount, based on the size of the mega symbol 156, based on the amount of the mega symbol 156 displayed within the array 151, based on the portion of the mega symbol 156 displayed within the array 15, etc.)

Figure 20A:
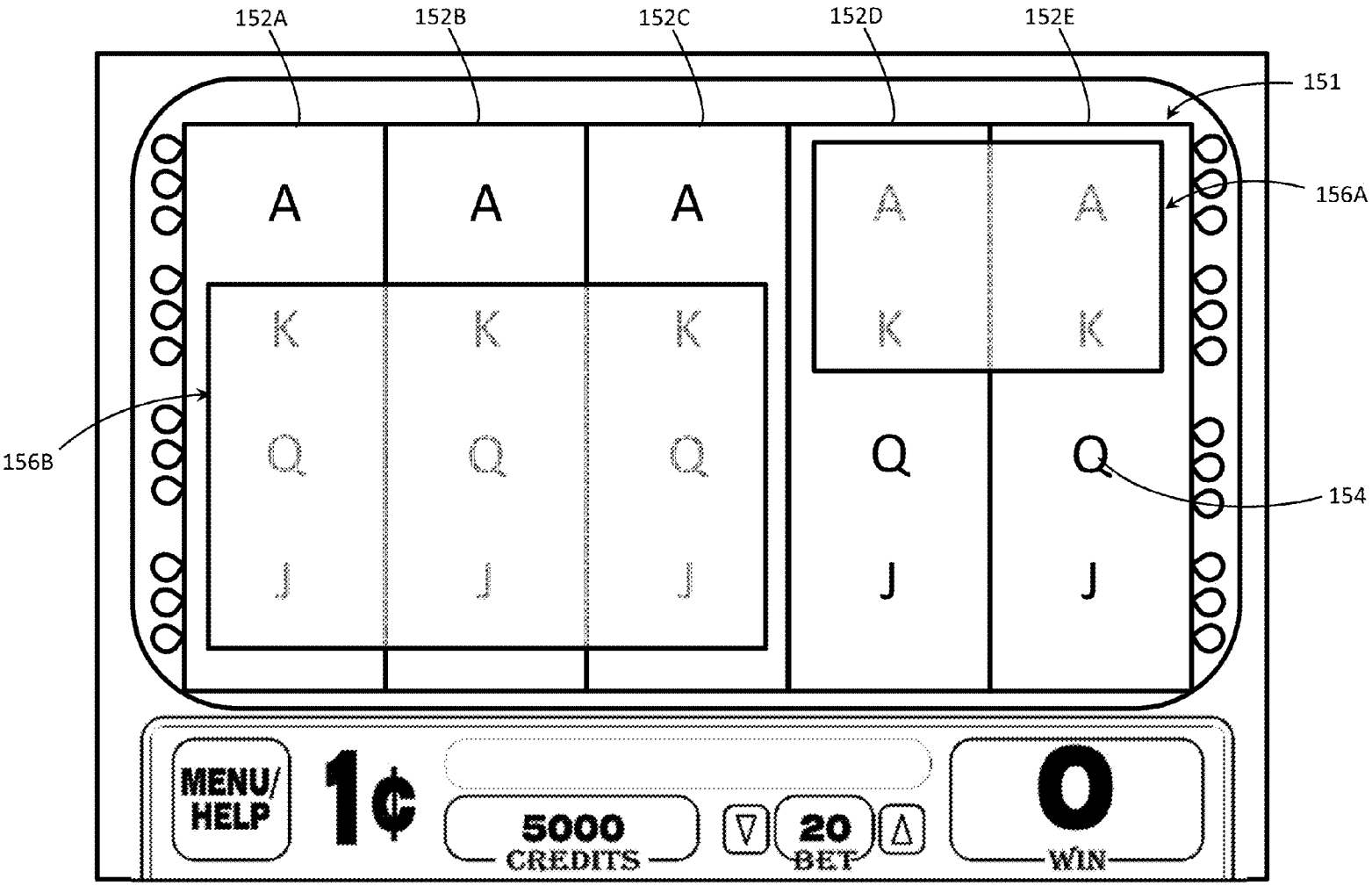
FIGS. 20A-20C are images of exemplary game screens of a wagering game displayed on a gaming terminal, according to an embodiment of the present invention.

FIG. 20A illustrates an exemplary outcome of a wagering including a first mega symbol 156A and a second mega symbol 156B displayed within an array 151. In a first exemplary implementation, the first mega symbol 156A can be associated with a 2× multiplier and the second mega symbol 156B can be associated with a 3× multiplier. In a second exemplary implementation, both the first mega symbol 156A and the second mega symbol 156B can be associated with a wild functionality and a multiplier functionality. In a third exemplary implementation, the first mega symbol 156A can be associated with a bonus trigger and the second mega symbol 156B can be associated with a morph functionality. In a fourth exemplary implementation, the size of the first mega symbol 156A can be determined randomly and the size of the second mega symbol 156B can be based on a wager amount. In a fifth exemplary implementation, the functionality associated with the first mega symbol 156A can be based on a turnover amount and the functionality associated with the second mega symbol 156B can based on the portion of the second mega symbol 156B displayed within the array 151.

According to additional and/or alternative aspects of the present disclosure, the functionalities associated with one or more of a plurality of mega symbols 156 can be changed (e.g., the type and/or magnitude of a functionality can be changed) in response to the position of the plurality of mega symbols 156 with respect to each other within an array 151. For example, the functionality of one or more of the mega symbols 156 (or portions thereof) can be changed when the mega symbols 156 at least partially overlap. As another example, the functionality of one or more of the mega symbols 156 (or portions thereof) can be changed when at least one of the mega symbols 156 fully overlaps with another of the mega symbols 156. As still another example, the functionality of one or more of the mega symbols 156 (or portions thereof) can be changed when the mega symbols 156 are positioned to be flush against and/or adjacent to each other.

Figure 20B:
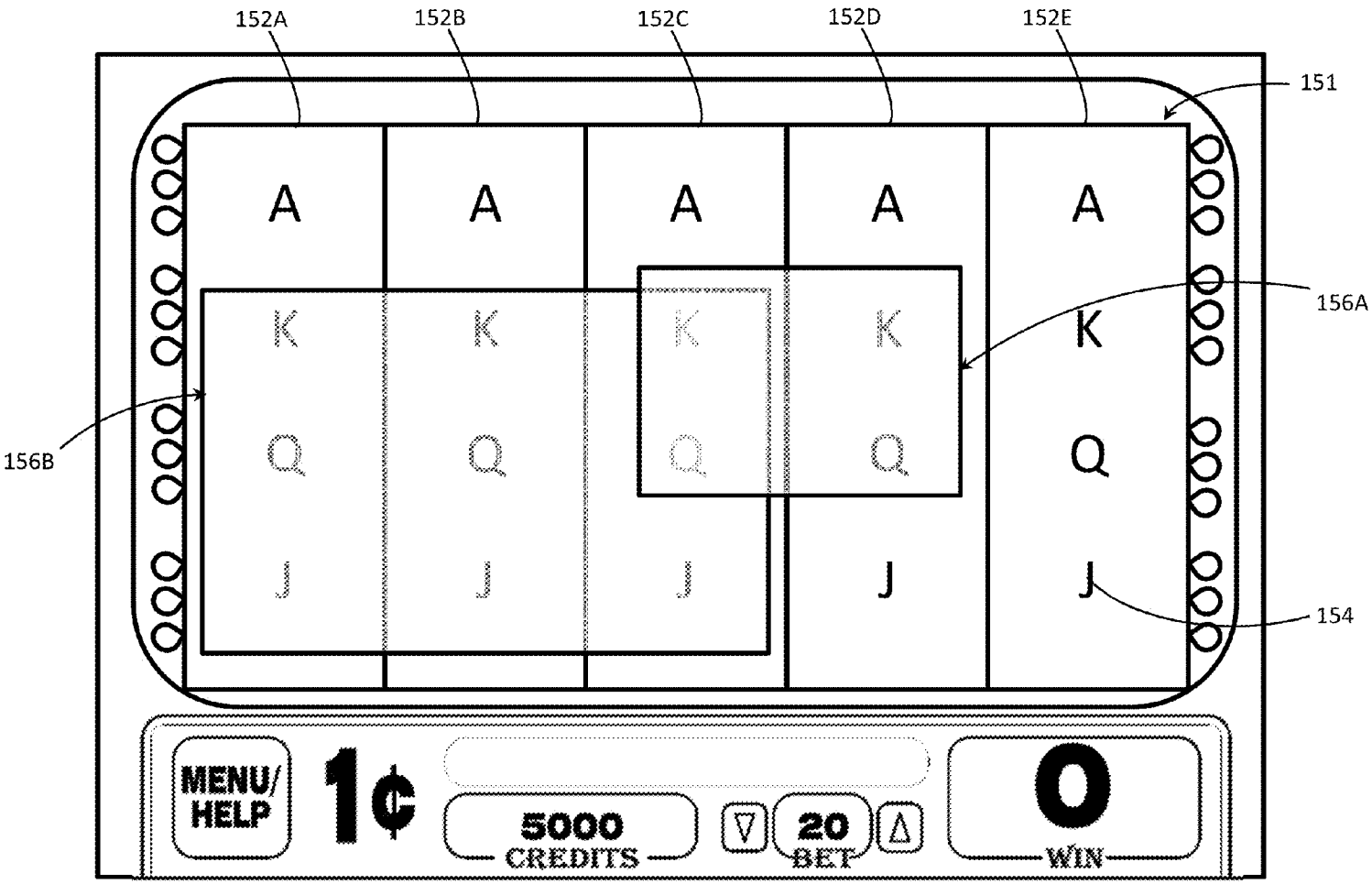

FIG. 20B illustrates an exemplary outcome in which the first mega symbol 156A and the second mega symbol 156B illustrated in FIG. 20A partially overlap at two positions of the array 151 (i.e, the array positions also occupied by the "K" and "Q" symbols 154 on reel 152C in FIG. 20B). According to some exemplary implementations, the functionality of only the overlapping portion of the mega symbols 156 can be changed in response to at least a portion of a plurality of mega symbols 156A, 156B overlapping within the array 151. According to additional and/or alternative implementations, the functionalities of both the first mega symbol 156A and the second mega symbol 156B can be changed in response to at least a portion of a plurality of mega symbols 156A, 156B overlapping within the array 151. According to further additional and/or alternative implementations, the functionalities of at least one but not all of the mega symbols 156A, 156B can be changed in response to at least a portion of a plurality of mega symbols 156A, 156B overlapping within the array 151.

For example, in the first exemplary implementation described above for FIG. 20A, the first mega symbol 156A can be associated with a 2× multiplier and the second mega symbol 156B can be associated with a 3× multiplier. In response to the outcome illustrated in FIG. 20B, the 2× multiplier can be provided for the portions of the first mega symbol 156A that are not overlapped by the second mega symbol 156 (i.e., the array positions also occupied by the "K" and "Q" symbols 154 on the reels 152A-152B and the "J" symbols 154 on the reels 152A-152C in FIG. 20B), the 3× multiplier can be provided for the portions of the second mega symbol 156B that are not overlapped by the first mega symbol 156 (i.e., the array positions also occupied by the "K" and "Q" symbols 154 on the reel 152D in FIG. 20B), and a 6× multiplier can be provided for portions of the mega symbols 156 that overlap with each other (i.e, the array positions also occupied by the "K" and "Q" symbols 154 on reel 152C in FIG. 20B). In other words, the functionality applied to the symbols 154 overlapping with the first mega symbol 156A and the second mega symbol 156B can be a combination of the functionality of the first mega symbol 156A and the functionality of the second mega symbol 156. It is contemplated that any other functionalities of the mega symbols 156A, 156B can be combined for overlapping portions of the mega symbols 156A, 156B (e.g., a multiplier functionality can be combined with a wild functionality, a bonus trigger functionality can be combined with a morph functionality, etc.).

The following additional non-limiting examples illustrate some further ways the functionality can be changed for the overlapping portion(s) of the mega symbols 156A, 156B, the non-overlapping portions of the mega symbols 156A, 156B, and/or the entire mega symbols 156A, 156B in response to at least a partial overlapping of the mega symbols 156A, 156B. In one non-limiting example, if the first mega symbol 156A is associated with a 2× multiplier and the second mega symbol 156B is associated with a 3× multiplier, the overlapping portions of the first mega symbol 156A and the second mega symbol 156B can be changed to a wild functionality while the functionality of the non-overlapping portions of the first mega symbol 156A and the second mega symbol 156B remain unchanged. In another non-limiting example, if the first mega symbol 156A is associated with a 2× multiplier and the second mega symbol 156B is associated with a 3× multiplier, the functionality of the entire first multiplier can be changed to a 3× multiplier while the functionality of the second mega symbol 156B remains unchanged in response to the overlapping of the first mega symbol 156A and the second mega symbol 156. In yet another non-limiting example, if the first mega symbol 156A is associated with a 2× multiplier and the second mega symbol 156B is associated with a 3× multiplier, the functionality of the entire first mega symbol 156A can be changed to a 4× multiplier and the functionality of the entire second mega symbol 156B can be changed to a scatter conversion functionality in response to the overlapping of the first mega symbol 156A and the second mega symbol 156. In a further non-limiting example, if the first mega symbol 156A is associated with a 2× multiplier and the second mega symbol 156B is associated with a 3× multiplier, the functionality of the non-overlapping portion of the first mega symbol 156A can be changed to a 4× multiplier, the functionality of the non-overlapping portion of the second mega symbol 156B can be changed to a scatter conversion functionality in response to the overlapping of the first mega symbol 156A and the second mega symbol 156, and the functionality of the overlapping portions of the first mega symbol 156A and the second mega symbol 156B can be changed to a morph functionality.

Figure 20C:
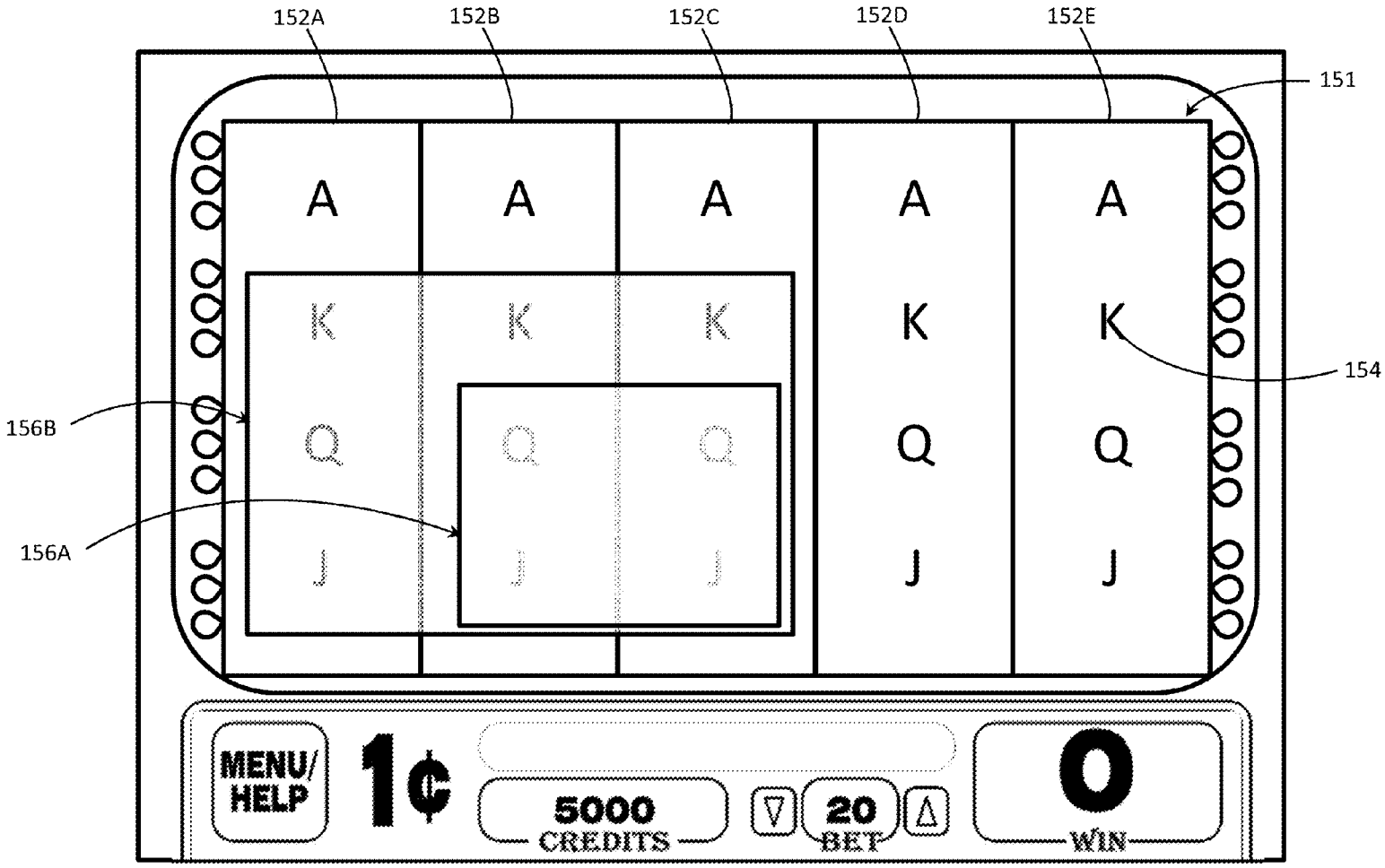

FIG. 20C illustrates an exemplary outcome in which the first mega symbol 156A fully overlaps with the second mega symbol 156B (i.e., the first mega symbol 156A is positioned entirely within the second mega symbol 156B). According to some exemplary implementations, the functionality of only the fully overlapping mega symbol 156A can be changed. According to additional and/or alternative implementations, the functionalities of both the first mega symbol 156A and the second mega symbol 156B can be changed.

Figure 21A:
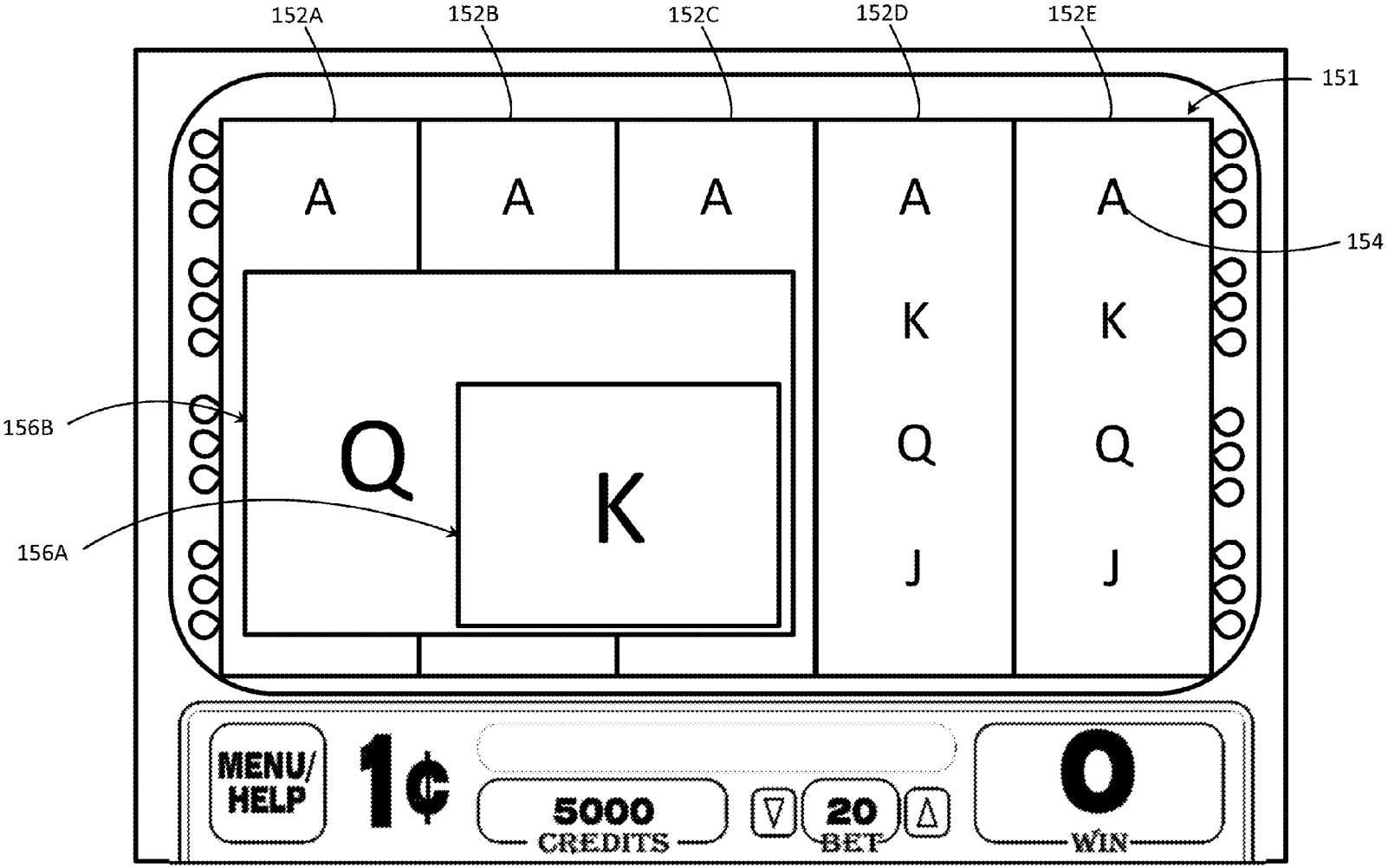
FIGS. 21A-21B are images of exemplary game screens of a wagering game displayed on a gaming terminal, according to an embodiment of the present invention.
Figure 21B:
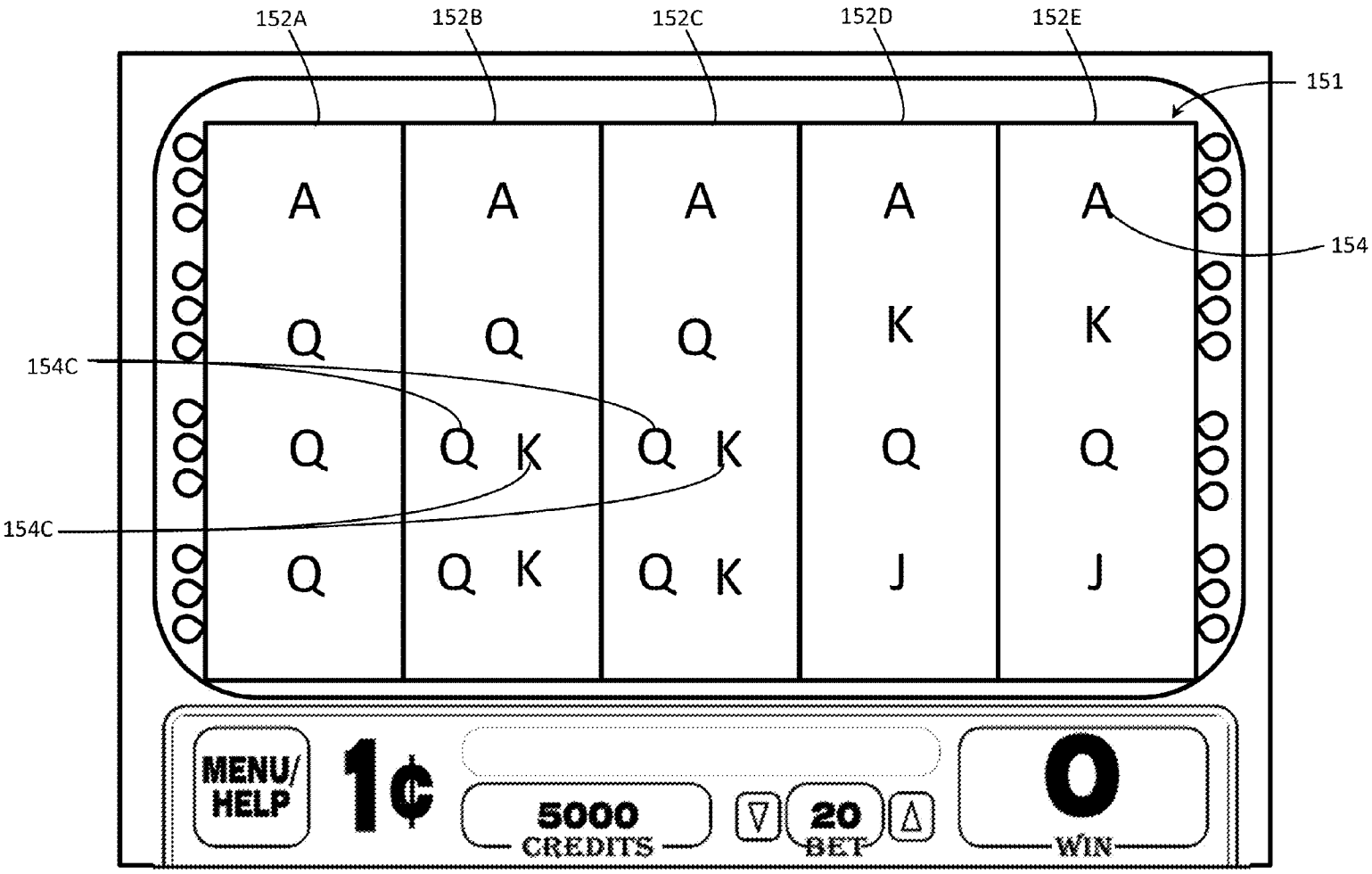

It is contemplated that if two or more mega symbols 156A, 156B overlap, the array positions of the overlapping mega symbols 156A, 156B can include a plurality of symbols 154C as described above with respect to FIGS. 8A-9B such that two or more symbols 154C occupy each array position. For example, FIG. 21A illustrates a first mega symbol 156A overlapping a second mega symbol 156B on the reels 152B, 152C. As a result, the array positions of the overlapping mega symbols 156A, 156B can be evaluated as including two symbols 154C as shown in FIG. 21B—a symbol 154C based on the first mega symbol 156A and a symbol 154C based on the second mega symbol 156. As described above with respect to FIGS. 9A-9B, a pay table can include line pay combinations based on array positions including multiple symbols 154, 154C and/or the array 151 can be evaluated multiple times with each of the two symbols 154C separately occupying the shared array positions. It is contemplated that, according to some aspects, the array positions occupied by the two symbols 154C from the mega symbols 156A, 156B can also include one or more symbols 154 on the reels 152A-152E. Although FIGS. 21A-21B include two overlapping mega symbols 156A, 156B resulting in two symbols 154C in the co-occupied array positions, it should be understood that more than two mega symbols 156 can overlap such that a position of the array 151 can include as many symbols 154C as there are mega symbols 156 overlapping at the position of the array 151.

Figure 22A:
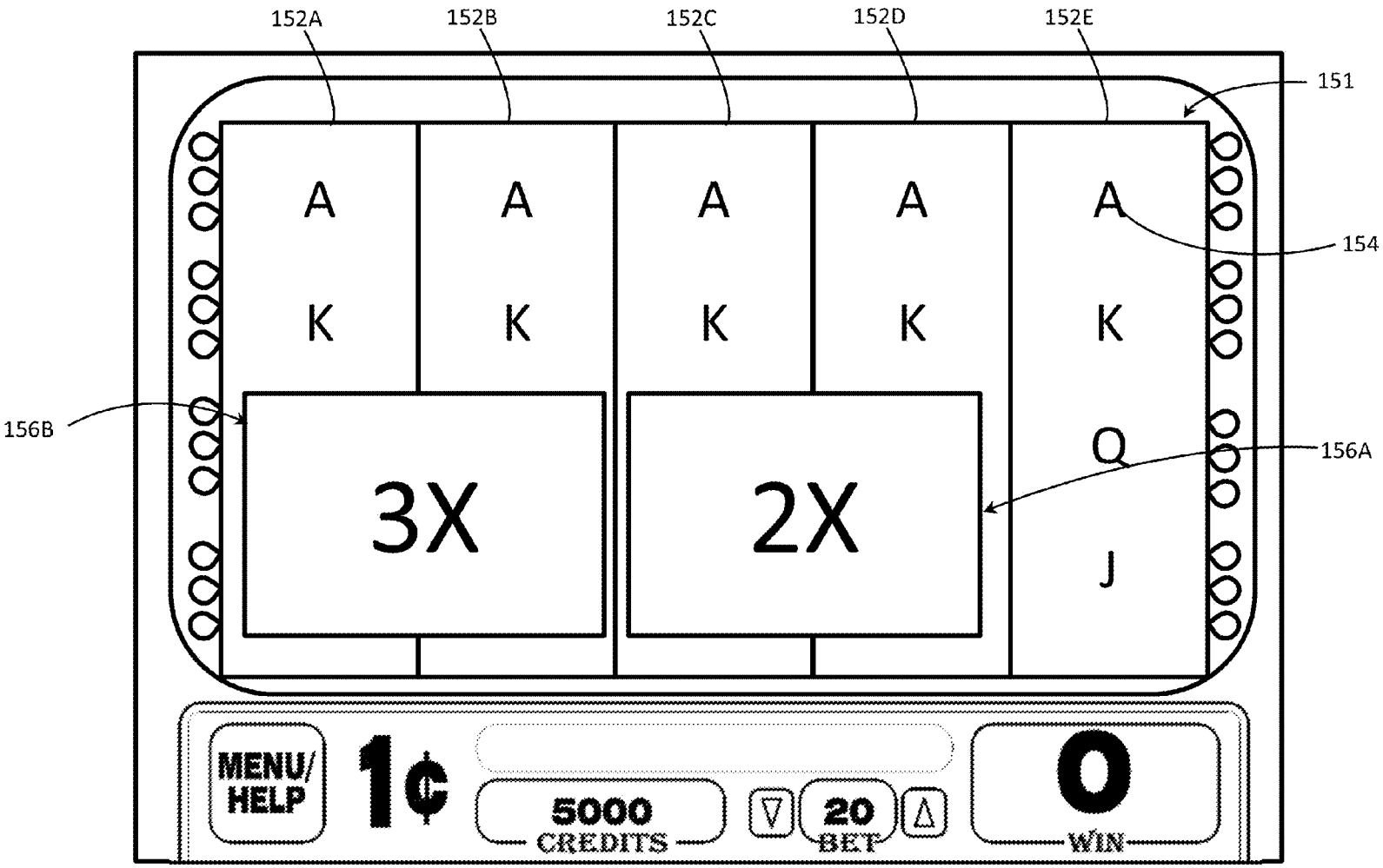
FIGS. 22A-22B are images of exemplary game screens of a wagering game displayed on a gaming terminal, according to an embodiment of the present invention.
Figure 22B:
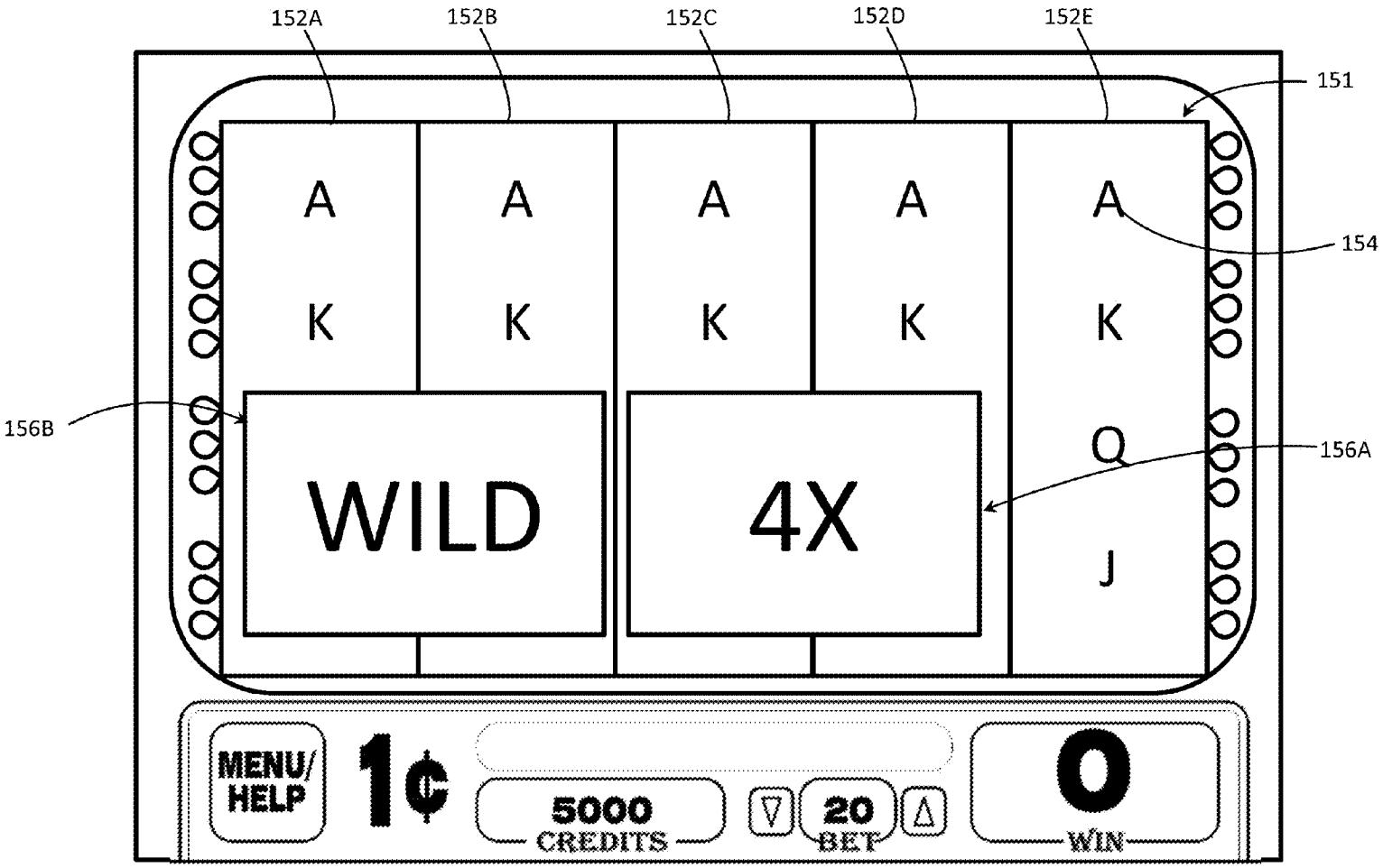

FIG. 22A illustrates an exemplary outcome in which a first mega symbol 156A associated with a 2× multiplier functionality is positioned flush and adjacent to a second mega symbol 156B associated with a 3× multiplier. According to some implementations, the functionality of both the first mega symbol 156A and the functionality of the second mega symbol 156B can change in response to the mega symbols 156A, 156B being flush and adjacent to one another. For example, as shown in FIG. 22B, the functionality of the first mega symbol 156A can be changed to a wild functionality and the functionality of the second mega symbol 156B can be changed to a 4× multiplier in response to the first mega symbol 156A being positioned flush and adjacent to the second mega symbol 156B. It is contemplated that, according to additional and/or alternative implementations, the functionalities of only one of the mega symbols 156A, 156B can be changed in response to the mega symbols 156A, 156B being flush and adjacent to one another. Additionally, it is contemplated that, according to additional and/or alternative implementations, the functionalities of the mega symbols 156A, 156B can be changed to the same functionality.

Although FIGS. 22A-22B illustrate an exemplary outcome in which the first mega symbol 156A and the second mega symbol 156B are laterally positioned relative to each other, it is contemplated that the functionality of one or more of the mega symbols 156A, 156B can be changed in response to the mega symbols 156A, 156B being vertically positioned flushed and adjacent relative to each other. Additionally, it is contemplated that, according to additional and/or alternative aspects, the functionalities of the mega symbols 156 can be changed based on the number of mega symbols 156 positioned adjacent and/or flush to one another. For example, the functionalities of the mega symbols 156 can change to more advantageous functionalities as the number of adjacent and/or flush mega symbols 156 increases.

Figure 23A:
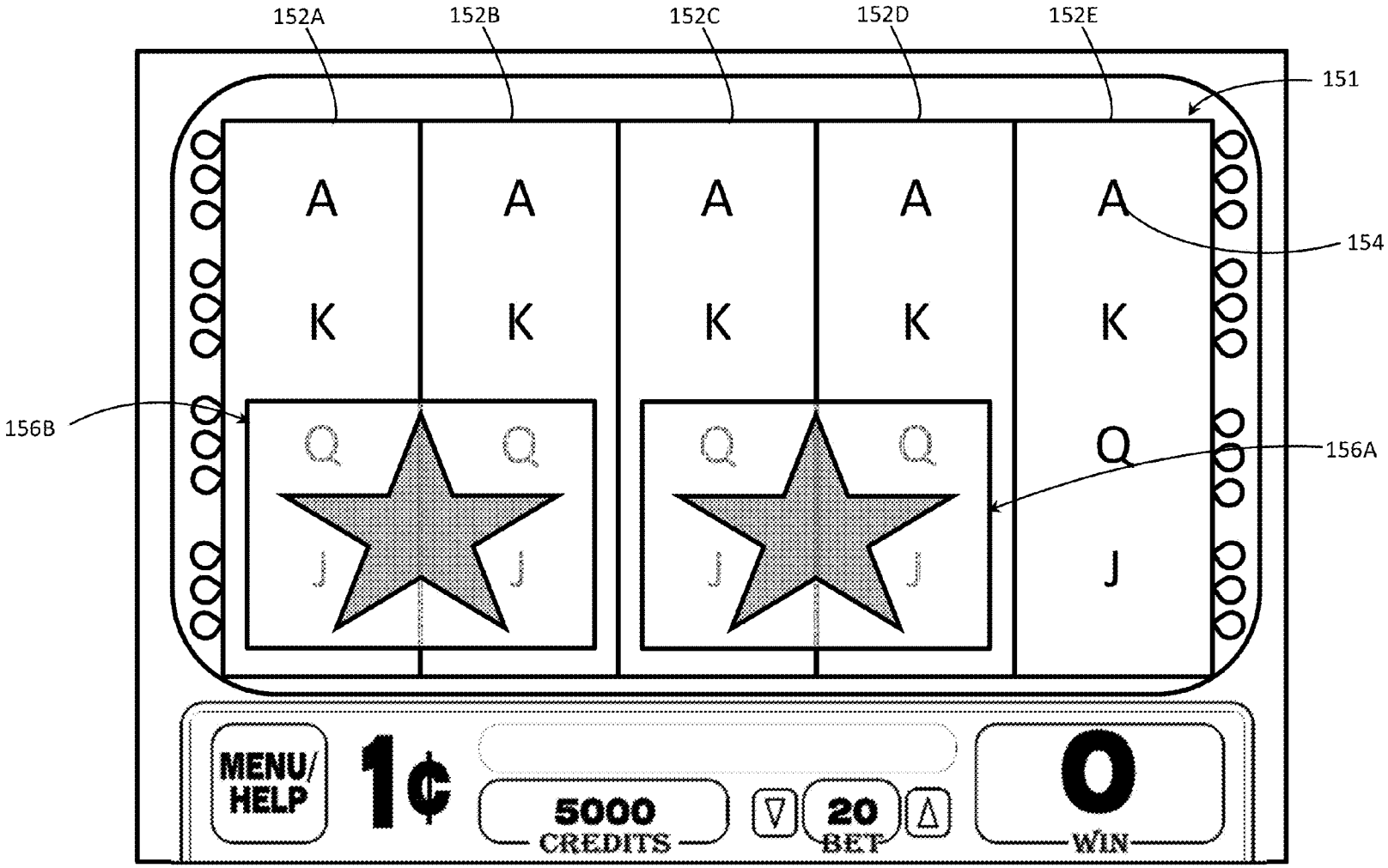
FIGS. 23A-23B are images of exemplary game screens of a wagering game displayed on a gaming terminal, according to an embodiment of the present invention.
Figure 23B:
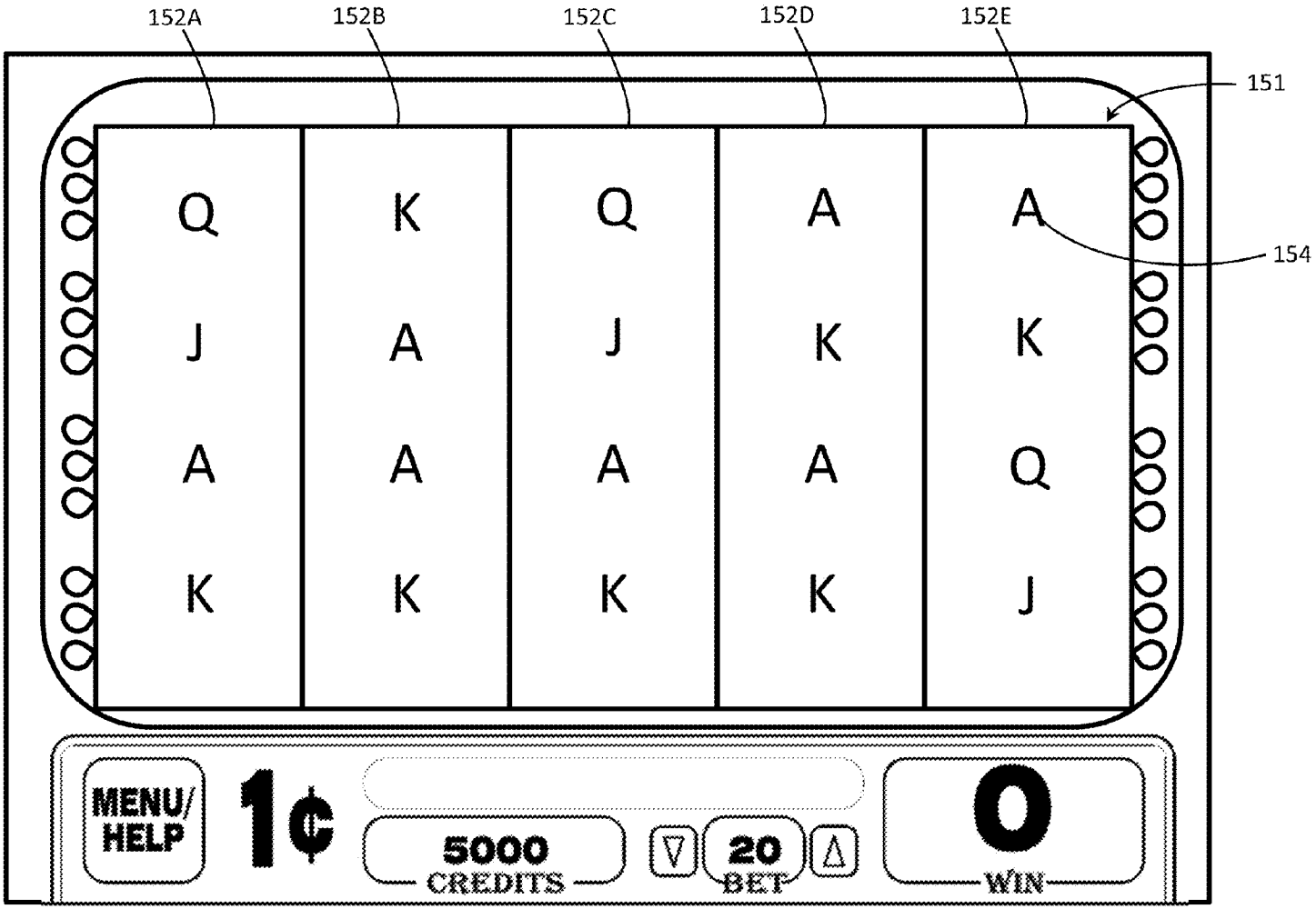

According to additional and/or alternative aspects of the present disclosure, when a plurality of mega symbols 156 are positioned to partially overlap, fully overlap, and/or be flush and adjacent, the mega symbols 156 can cause a cascading effect to occur. The cascading effect can cause the mega symbols 156 to disappear so that the reels 152A-152E can rotate to fill the positions previously occupied by the mega symbols 156. For example, FIG. 23A illustrates exemplary outcome in which a first mega symbol 156A is positioned flush and adjacent to a second mega symbol 156. FIG. 23B illustrates the array 151 shown in FIG. 23A after the cascading effect has caused the mega symbols 156 to disappear and the reels 152A-152D have rotated to fill the positions of the array 151 previously occupied by the mega symbols 156. As shown in FIG. 23B, the top two rows of symbols 154 on the reels 152A-152D have rotated down two array positions to fill the array positions previously occupied by the mega symbols 156A, 156B. In some exemplary implementations, the array 151 can be evaluated before and after the cascading effect occurs so as to provide the player with additional opportunities to achieve winning outcomes.

Although, two mega symbols 156A, 156B are illustrated in FIGS. 20A-23B, it should be understood that the aspects of the present disclosure described for FIGS. 20A-23B can also be applied for outcomes including three or more mega symbols 156 similarly positioned with respect to each other.

Figure 24A:
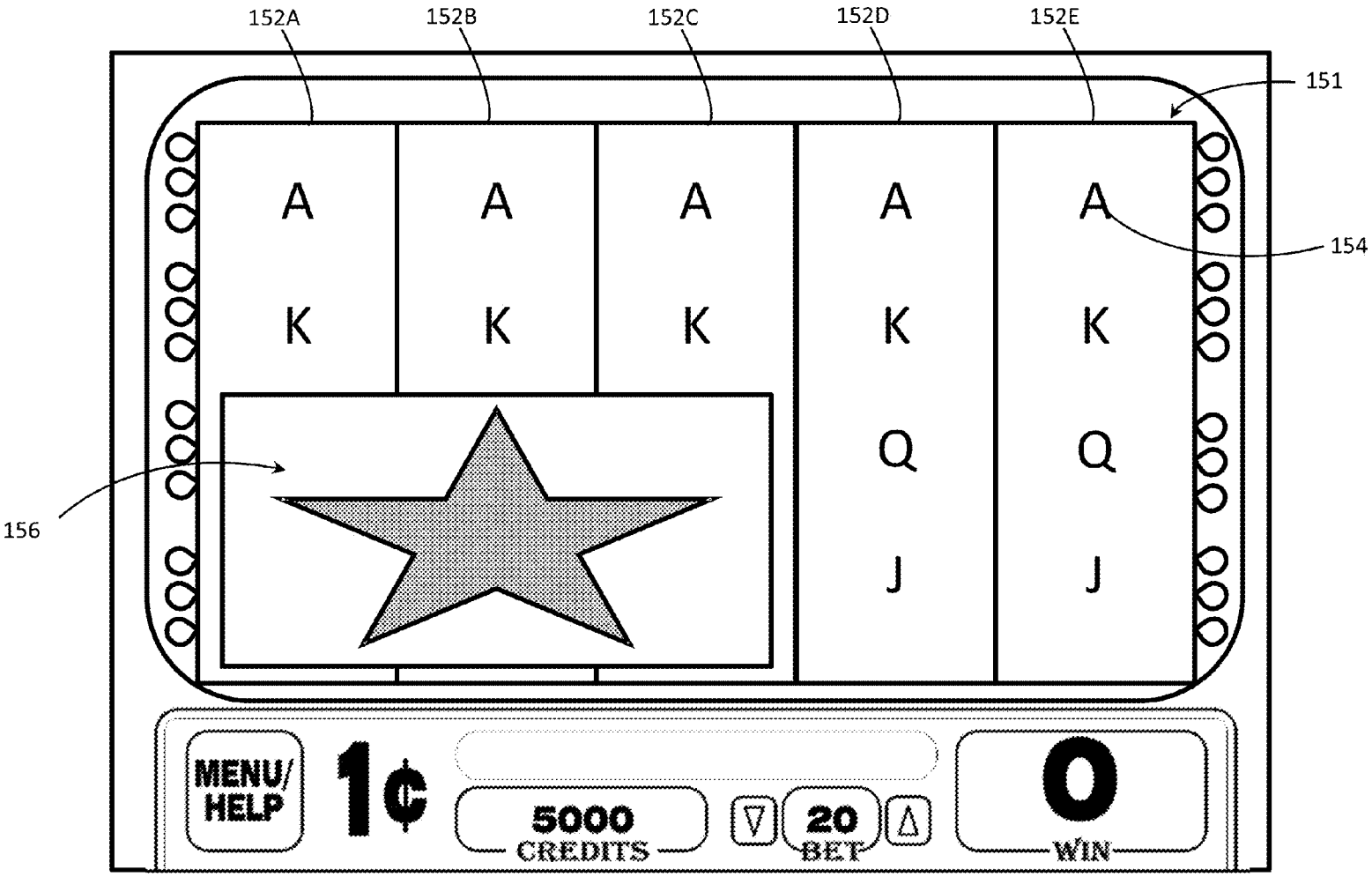
FIGS. 24A-24B are images of exemplary game screens of a wagering game displayed on a gaming terminal, according to an embodiment of the present invention.
Figure 24B:
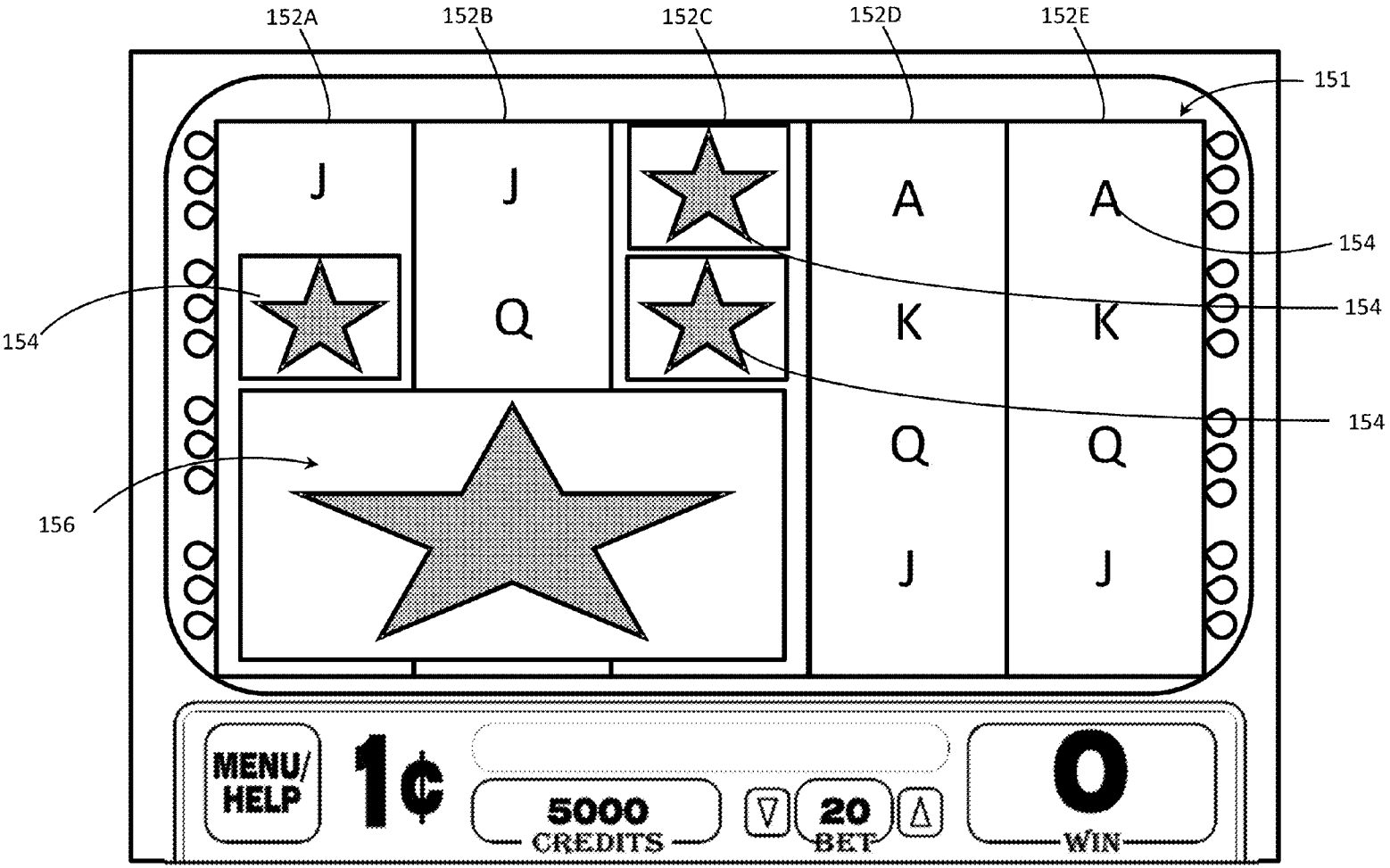

According to some aspects of the present disclosure, the mega symbol(s) 156 can have a stopper symbol functionality. When the mega symbol 156 provides a stopper symbol functionality, the mega symbol 156 is configured to stop and hold one or more predetermined symbols in the array positions above the mega symbol 156 as the reels 152A-152E (and/or a special reel 153) spin. For example, FIGS. 24A-24B illustrate a mega symbol 156 having a stopper symbol functionality. According to one exemplary implementation, the mega symbol 156 can stop prior to the reels 152A-152C (e.g., the mega symbol 156 can be indexed to a special reel 153 as described above with respect to FIG. 6). In FIG. 24A, the mega symbol 156 has stopped while the reels 152A-152C continue to spin. When a "star" symbol 154 (i.e., the predetermined symbol in the illustrated example) on the reels 152A-152C spins into visual association with an array position above the mega symbol 156, the "star" symbol 154 is held in that position. As shown in FIG. 24B, the "star" symbols 154 can continue to stack above the mega symbol 156 until a predetermined amount of time has expired, a predetermined amount of rotation of the reels 152A-152E has occurred, the array positions above the mega symbol 156 are all occupied by the "star" symbols 154, and/or some other event causes the reels 152A-152C to stop. In another exemplary implementation, the mega symbol 156 can be achieved in an initial spin and then the stacking of the "star" symbols 154 can occur during one or more subsequent spins of the wagering game.

It is contemplated that, according to some aspects, an anticipation spin effect can be utilized as the reels 152A-

152E and the predetermined symbol(s) 154 stack above the mega symbol 156 so as to increase the excitement and add drama to the presentation of the wagering game. It is also contemplated that, according to some aspects, a payout or other award can be provided to the player if the predetermined symbol(s) 154 can be stacked to reach a particular position within the array 151. For example, a payout or other award can be provided in response to the predetermined symbol 154 being stacked above the mega symbol 156 to the top of the array 151. It is contemplated that, according to some aspects, one or more targets can be indicated above the mega symbol 156 at one or more positions within and/or above the array 151 and the player is awarded if the predetermined symbol(s) 154 are stacked to reach the target(s).

Figure 25A:
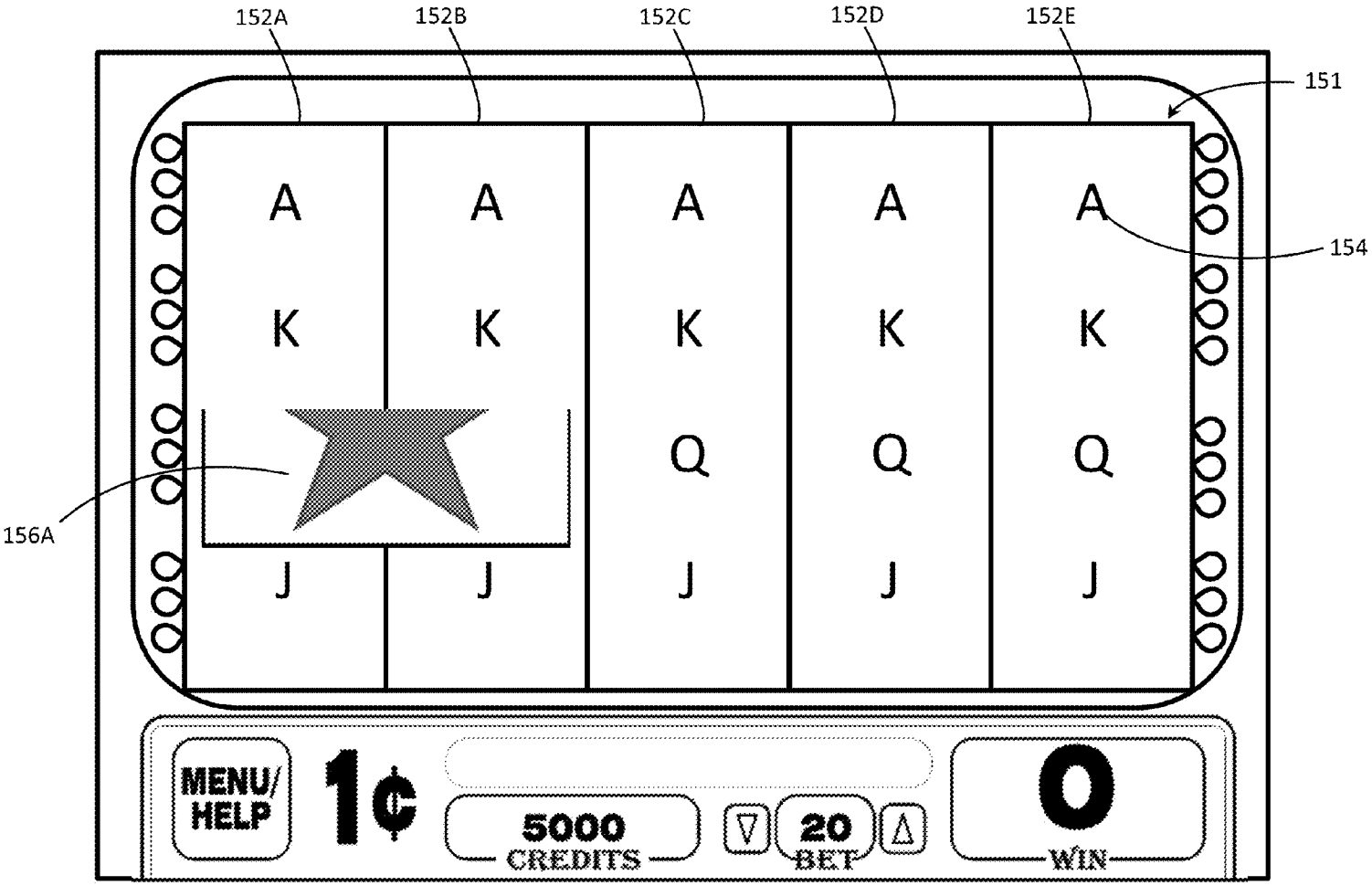
FIGS. 25A-25C are images of exemplary game screens of a wagering game displayed on a gaming terminal, according to an embodiment of the present invention.
Figure 25B:
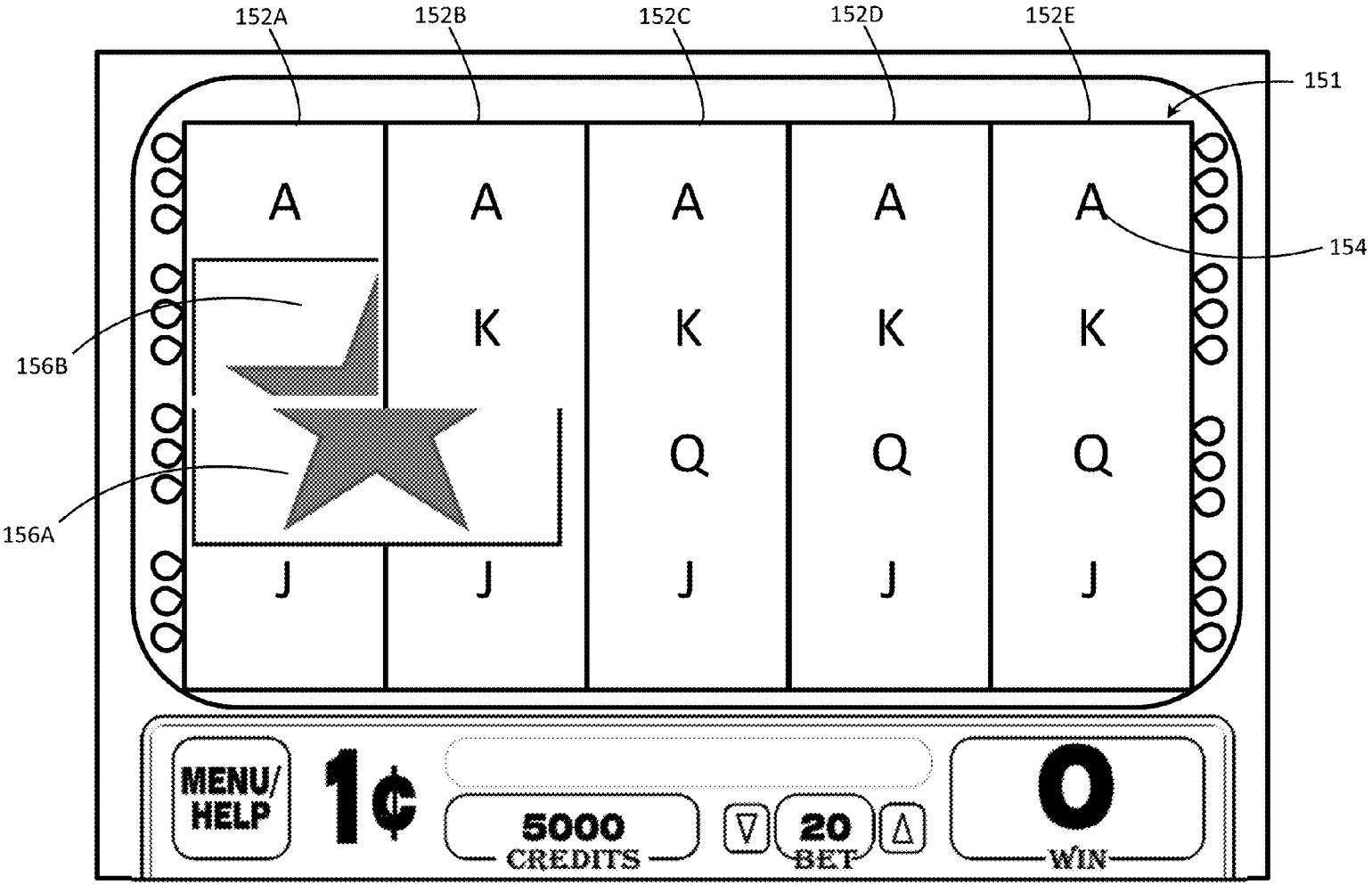
Figure 25C:
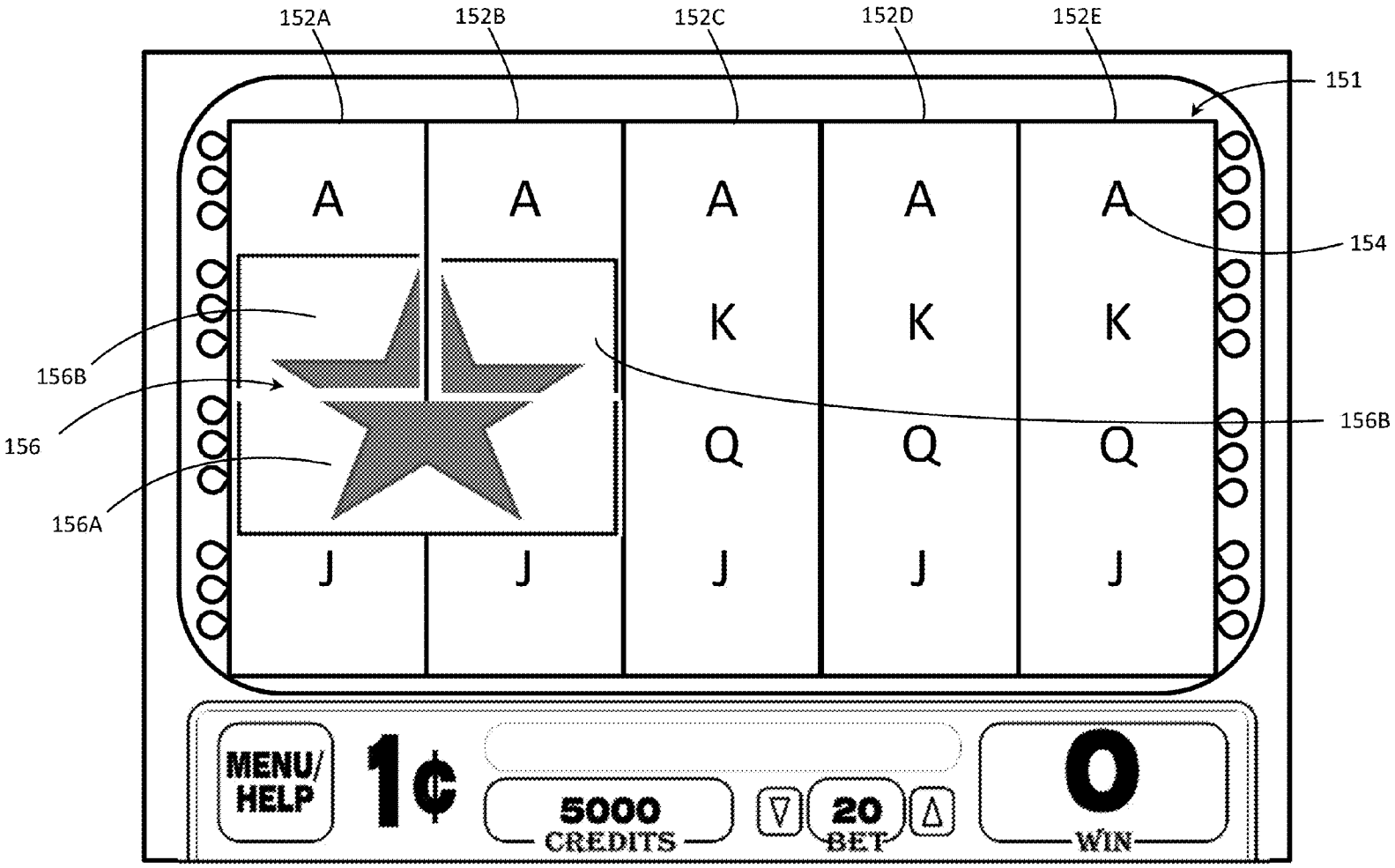

Another example of a mega symbol 156 having a stopper symbol functionality is illustrated in FIGS. 25A-25C. As shown in FIG. 25A, a bottom portion 156A of the mega symbol 156 has stopped on the first reel 152A and the second reel 152B. The bottom portion 156A of the mega symbol 156 can function as a stopper symbol such that other portions 156B of the mega symbol 156 can be stacked above the bottom portion 156A of the mega symbol 156 as the reels 152A-152B continue to spin for the current play of the wagering game and/or subsequent play(s) of the wagering game. As shown in FIGS. 25B-25C, the upper portions 156B of the mega symbol 156 have been stacked above the bottom portion 156A to complete the mega symbol 156. In some exemplary implementations, a functionality associated with the mega symbol 156 can be provided only if the entire mega symbol 156 is completed by stacking the upper portions 156B above the bottom portion 156A. In other exemplary implementations, a functionality associated with the mega symbol 156 can be provided even if the entire mega symbol 156 is not fully formed.

Each of these embodiments and obvious variations thereof is contemplated as falling within the spirit and scope of the claimed invention, which is set forth in the following claims. Moreover, the present concepts expressly include any and all combinations and subcombinations of the preceding elements and aspects. As a non-limiting example, a mega symbol 156 can have an associated functionality that is based on the amount of the mega symbol 156 displayed within the array and a size that is based on a wager amount. As another non-limiting example, a plurality of mega symbols 156 can be achieved in an outcome where one of the mega symbols 156 has a size based on the symbols 154 displayed in a prior spin, another one of the mega symbols 156 has a functionality that is based on the portion of the mega symbol 156 displayed within the array 151, and still another one of the mega symbols 156 has a functionality that is only provided when entirely displayed within the array 151. As yet another non-limiting example, a mega symbol 156 can have an associated functionality that is based on the size of the mega symbol 156 and the size of the mega symbol 156 is based on the symbols 154 displayed in the array 151.

What is claimed is:

1. A gaming system primarily dedicated to conducting at least one regulated casino wagering game, the gaming system comprising:

an electronic slot machine with a gaming cabinet configured to house electronic components operable for conducting a casino wagering game, one or more electronic input devices coupled to the gaming cabinet and configured to receive a physical input from a player to initiate the casino wagering game and transform the physical input into an electronic data signal, and one or more electronic display devices coupled to the gaming cabinet and operable to display aspects of the casino wagering game, the casino wagering game including a plurality of symbol-bearing reels;

one or more electronic random element generators dedicated to generating one or more random elements associated with play of the casino wagering game;

one or more processors; and one or more memory devices storing instructions that, when executed by at least one of the one or more processors, cause the gaming system to:

receive, via at least one of the one or more electronic input devices, an input indicative of a wager;

initiate the casino wagering game in response to an electronic data signal from the at least one of the one or more electronic input devices indicative of the received wager input;

determine an outcome of the casino wagering game based, at least in part, on one or more random elements generated by at least one of the one or more electronic random element generators;

display, via at least one of the one or more electronic display devices, an array having a plurality of array positions filled with symbols of the symbol-bearing reels to indicate randomly determined outcomes of the casino wagering game, each of the array positions being populated by at least one of a plurality of symbols, the plurality of symbols including a mega symbol configured to occupy at least two symbol positions on each of at least two adjacent symbol-bearing reels and further configured to occupy array positions on each of at least two adjacent columns of the array when part of the outcome;

in response to at least a portion of the mega symbol being displayed in the array in the outcome of the wagering game, select a game-modifying functionality for the mega symbol from a plurality of potential game-modifying functionalities based on the number of array positions on which the at least a portion of the mega symbol is displayed; and award a payout based on the symbols displayed in the array and the selected game-modifying functionality of the mega symbol.

2. The gaming system of claim 1, wherein the plurality of potential game-modifying functionalities includes a first game-modifying functionality and a second game-modifying functionality, the first game-modifying functionality being of a first type of functionality and the second game-modifying functionality being of a second type of functionality, the first type of functionality being different from the second type of functionality.

3. The gaming system of claim 1, wherein the mega symbol is assigned a multiplier functionality in response to the mega symbol being displayed on a first number of the array positions and a wild-symbol functionality in response to the mega symbol being displayed on a second number of the array positions.

4. The gaming system of claim 1, wherein the plurality of potential game-modifying functionalities includes a plurality of multiplier functionalities having different multiplier magnitudes.

5. The gaming system of claim 1, wherein the plurality of potential game-modifying functionalities includes a plurality of bonus triggers for different bonus games.

6. The gaming system of claim 1, wherein each of the array positions on which the mega symbol is displayed also includes at least one additional symbol from the plurality of symbols, the additional symbols also being displayed on the array.

7. The gaming system of claim 6, wherein the selected functionality of the mega symbol is applied to a winning combination of symbols including one or more of the additional symbols.

8. The gaming system of claim 6, wherein the plurality of potential game-modifying functionalities includes changing the additional symbols to one or more different symbols.

9. The gaming terminal of claim 8, wherein the mega symbol changes the additional symbols to a first predetermined symbol in response to the mega symbol being displayed on a first number of the symbol positions and a second predetermined symbol in response to the mega symbol being displayed on a second number of the symbol positions.

10. A gaming system primarily dedicated to conducting at least one regulated casino wagering game, the gaming system comprising:

an electronic slot machine with a gaming cabinet configured to house electronic components operable for conducting a casino wagering game, one or more electronic input devices coupled to the housing and configured to receive one or more physical inputs from a player and generate one or more electronic data signals indicative thereof, one or more electronic display devices coupled to the housing and operable to display aspects of the casino wagering game, the casino wagering game including a plurality of symbol-bearing reels;

one or more electronic random element generators configured to generate one or more random elements associated with play of the casino wagering game;

one or more processors;

one or more memory devices storing instructions that, when executed by at least one of the one or more processors, cause the gaming system to:

receive, via at least one of the one or more electronic input devices coupled to the housing, an input from the player indicative of a wager;

initiate the casino wagering game in response to an electronic data signal from the at least one of the one or more electronic input devices indicative of the wager input received from the player;

determine an outcome of the casino wagering game based, at least in part, on one or more random elements generated by at least one of the one or more electronic random element generators;

display, via at least one of the one or more electronic display devices coupled to the housing, an array comprising a plurality of array positions filled with symbols of the symbol-bearing reels to indicate randomly determined outcomes of the casino wagering game, each of the array positions being populated by at least one of a plurality of symbols, the plurality of symbols including a mega symbol configured to occupy at least two symbol positions on each of at least two adjacent symbol-bearing reels and further configured to occupy array positions on each of at least two adjacent columns of the array when part of the outcome;

select a size of the mega symbol from a plurality of different potential sizes, the size of the mega symbol being a maximum number of array positions on which the mega symbol is configured to be displayed on the array;

spin and stop the plurality of symbol-bearing reels to populate the plurality of array positions with at least some of the plurality of symbols;

evaluate the symbols in the array positions of the array to determine whether the array includes a winning outcome; and award a payout to the player for any evaluated winning outcomes.

11. The gaming system of claim 10, wherein the selected size of the mega symbol is based on an amount of the wager.

12. The gaming system of claim 10, wherein the size of the mega symbol is selected prior to the spin.

13. The gaming system of claim 12, wherein the plurality of symbols includes an enhancer symbol, the size of the mega symbol being increased in response to a prior spin and stop including the enhancer symbol in visual association with the array.

14. The gaming system of claim 12, wherein the plurality of symbols includes a diminish symbol, the size of the mega symbol being decreased in response to a prior spin and stop including the diminish symbol within the array.

15. The gaming system of claim 10, wherein the one or more processors are further configured to change the size of the mega symbol in response to the symbols in visual association with the array for the spin and stop.

16. The gaming system of claim 10, wherein the size of the mega symbol is selected based on the symbols in visual association with the array for a prior spin and stop.

17. The gaming system of claim 10, wherein the size of the mega symbol incrementally decreases over a number of successive spins and stops.

18. The gaming system of claim 10, wherein the mega symbol is configured to overlap with a plurality of overlapped symbols on the plurality of reels such that both the mega symbol and the overlapped symbols are visible when the mega symbol is in visual association with the symbol positions of the array.

19. The gaming system of claim 10, wherein the mega symbol is configured as a frame to indicate the array positions occupied by the mega symbol.

20. A gaming system primarily dedicated to conducting at least one regulated casino wagering game, the gaming system comprising:

an electronic slot machine with a gaming cabinet configured to house electronic components operable for conducting a casino wagering game, one or more electronic input devices mounted on the gaming cabinet and configured to receive physical inputs from a player and transform the physical inputs into electronic data signals, and one or more electronic display devices mounted on the gaming cabinet and operable to display randomly determined outcomes of the casino wagering game, the casino wagering game including a plurality of symbol-bearing reels;

game logic circuitry comprising one or more processors with one or more random element generators configured to generate one or more random elements associated with randomly determined outcomes of the casino wagering game; and one or more memory devices storing instructions that, when executed by at least one of the one or more processors, cause the gaming system to:

receive, via at least one of the one or more electronic input devices, an input indicative of a wager;

initiate the casino wagering game in response to an electronic data signal from the at least one of the one or more electronic input devices indicative of the received wager input;

determine an outcome of the casino wagering game based, at least in part, on one or more random elements generated by at least one of the one or more random element generators;

display on at least one of the one or more electronic display devices an array comprising a plurality of array positions filled with symbols of the symbol-bearing reels to indicate randomly determined outcomes of the casino wagering game, each of the array positions being populated by at least one of a plurality of symbols, the plurality of symbols including a first mega symbol and a second mega symbol, the first mega symbol and the second mega symbol each being configured to occupy at least two symbol positions on each of at least two adjacent symbol-bearing reels and further configured to occupy array positions on each of at least two adjacent columns of the array, the first mega symbol and the second mega symbol each having a respective game-modifying functionality;

in response to at least a portion of the first mega symbol overlapping with at least a portion of the second mega symbol in the outcome of the wagering game, change the game-modifying functionality of the first mega symbol or the second mega symbol, or both, to a new game-modifying functionality selected from a plurality of potential game-modifying functionalities; and award a payout to the player based on the symbols displayed in the array and the respective game-modifying functionalities of the first mega symbol and the second mega symbol.

21. The gaming system of claim 20, wherein the change in game-modifying functionality is only in response to the first mega symbol overlapping with at least a portion of the second mega symbol.

22. The gaming system of claim 20, wherein the game-modifying functionality of the first mega symbol or the game-modifying functionality of the second mega symbol, or both, change for only the array positions populated by the at least a portion of the first mega symbol that overlaps with the at least a portion of the second mega symbol.

23. The gaming system of claim 22, wherein the respective game-modifying functionalities of the first mega symbol and the second mega symbol do not change for the array positions where the first mega symbol and the second mega symbol do not overlap.

24. The gaming system of claim 20, wherein the change of the game-modifying functionality of the first mega symbol or the second mega symbol, or both, combines the respective game-modifying functionalities of the first mega symbol and the second mega symbol.

25. The gaming system of claim 24, wherein the game-modifying functionality of the first mega symbol is a first multiplier having a first magnitude and the game-modifying functionality of the second mega symbol is a second multiplier having a second magnitude, the changed game-modifying functionality being the first magnitude multiplied by the second magnitude.

26. A computer-implemented method for conducting a casino wagering game on a gaming system primarily dedicated to conducting at least one regulated casino wagering game, the gaming system including an electronic slot machine with a cabinet, one or more electronic input devices, and one or more electronic display devices, the gaming system further including one or more electronic random element generators, and one or more processors, the method comprising:

receiving an electronic data signal indicative of a wager in response to an input received from a player via at least one of the one or more electronic input devices of the electronic slot machine;

initiating, via at least one of the one or more processors of the gaming system, the wagering game in response to the electronic data signal indicative of the wager;

determining, via at least one of the one or more processors, an outcome of the wagering game based, at least in part, on one or more random elements generated by at least one of the one or more random element generators of the gaming system, the outcome being randomly determined from a plurality of available wagering-game outcomes;

displaying on at least one of the one or more electronic display devices an array having a plurality of array positions operable to fill with symbols borne by symbol-bearing reels to indicate randomly determined outcomes of the casino wagering game, each of the array positions being populated by at least one of a plurality of symbols, the plurality of symbols including a mega symbol configured to occupy at least two symbol positions on each of at least two adjacent symbol-bearing reels and further configured to occupy array positions on each of at least two adjacent columns of the array when part of the outcome;

in response to at least a portion of the mega symbol being displayed in the array in the outcome of the wagering game, selecting a game-modifying functionality for the mega symbol from a plurality of potential game-modifying functionalities based on at least one of a number of array positions on which the at least a portion of the mega symbol is displayed, the portion of the mega symbol displayed in the array, the size of the mega symbol displayed in the array, a random determination, the received wager, or a turnover amount over a plurality of plays of a wagering game; and transmit to the player an indication of an award based on the symbols displayed in the array and the selected game-modifying functionality of the mega symbol.

* * * * *